US007144693B2

(12) United States Patent
Oyamada

(10) Patent No.: US 7,144,693 B2
(45) **Date of Patent: *Dec. 5, 2006**

(54) PHOTOTHERMOGRAPHIC MATERIAL

(75) Inventor: Takayoshi Oyamada, Kanagawa (JP)

(73) Assignee: FujiFilm Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/230,644

(22) Filed: Sep. 21, 2005

(65) Prior Publication Data

US 2006/0068344 A1 Mar. 30, 2006

(30) Foreign Application Priority Data

Sep. 24, 2004 (JP) ..... 2004-277857

(51) Int. Cl.
*G03C 1/00* (2006.01)

(52) U.S. Cl. ..... 430/617; 430/618; 430/619; 430/620

(58) Field of Classification Search ..... 430/617–620
See application file for complete search history.

(56) References Cited

U.S. PATENT DOCUMENTS

2005/0208441 A1* 9/2005 Oyamada et al. ..... 430/619

FOREIGN PATENT DOCUMENTS

JP A 11-84573 3/1999
JP A 2002-303953 10/2002

* cited by examiner

*Primary Examiner*—Geraldine Letscher
(74) *Attorney, Agent, or Firm*—Margaret A. Burke; Sheldon J Mess

(57) ABSTRACT

A photothermographic material comprising a support and an image-forming layer, a non-photosensitive intermediate layer A, and an outermost layer provided in this order on at least one side of the support, wherein the image-forming layer comprises a photosensitive silver halide, a non-photosensitive organic silver salt, a reducing agent, and a binder, and at least 50 mass % of a binder in the non-photosensitive intermediate layer A is a polymer latex having a film water absorption of 5 % or lower.

20 Claims, No Drawings

PHOTOTHERMOGRAPHIC MATERIAL

CROSS-REFERENCE TO RELATED APPLICATION

This application claims priority under 35 USC 119 from Japanese patent Application No. 2004-277857, the disclosure of which is incorporated by reference herein.

BACKGROUND OF THE INVENTION

1. Field of the Invention

The present invention is related to a photothermographic material which is used advantageously in the fields of films for medical diagnosis and films for photoengraving.

2. Description of the Related Art

Reduction of waste solutions to be treated has been strongly desired in recent years in the medical field from the viewpoints of environmental protection and space saving. Under such circumstances, technologies on photothermographic image-recording materials as films for medical diagnosis and photoengraving which can be exposed to light efficiently with a laser image setter or a laser imager, and can form a clear black image having high resolution and sharpness have been demanded. With these photosensitive photothermographic photographic materials, it is possible to supply to customers a heat development treatment system which has eliminated the necessity of using solvent system processing chemicals, and is simpler and does not impair the environment.

The similar requirements also exist in the field of general image forming materials. However, the image for medical use is required to have a high image quality excellent in sharpness and graininess, because fine details of the image are required. In addition, the medical image is characterized by preferably exhibiting a blue black image tone from the viewpoint of ease of medical diagnosis. Currently, various hard copy systems utilizing pigments or dyes such as inkjet printers and apparatuses for electrophotography are prevailing as general image forming systems. However, there is no system which is satisfactory as a medical image-output system.

On the other hand, thermal image forming systems utilizing organic silver salts are described, for example, in U.S. Pat. Nos. 3,152,904 and 3,457,075, as well as in "Thermally Processed Silver systems" (Imaging Processes and Materials), Neblette, 8th edition, written by D. Klosterboer, edited by J. Sturge, V. Warlworth, and A. Shepp, Chapter 9, page 279 in 1989. Particularly, the photothermographic material generally comprises a photosensitive layer in which a catalytically active amount of photocatalyst (for example, a silver halide), a reducing agent, a silver salt capable of being reduced (for example, an organic silver salt) and, optionally, a toner for controlling the tone of developed silver image dispersed in a matrix of a binder. The photothermographic material, when heated to high temperature (for example, 80° C. or higher) after imagewise exposure, forms black-toned silver images by oxidation/reduction reaction between a silver salt capable of being reduced (functioning as an oxidizer) and a reducing agent. The oxidation/reduction reaction is promoted by a catalytic activity of latent images of silver halide formed by exposure. Accordingly, black-toned silver images are formed in an exposed region.

Such photothermographic materials have been already known. However, in many recording materials, the image-forming layers are formed using an organic solvent such as toluene, methyl ethyl ketone, or methanol as a solvent. It is not advantageous to use an organic solvent as a solvent since the organic solvent may cause harmful effects on human during production process of the recording materials, and since it is costly to collect the solvent and to conduct other related processes.

In order to solve such problems, a method has been proposed in which water-based coating liquid is used for forming an image-forming layer (hereinafter sometimes referred to as "water-based photosensitive layer." For example, techniques of using gelatin as a binder are disclosed in Japanese Patent Application Laid-Open (JP-A) Nos. 49-52626 and 53-116144, the disclosures of which are incorporated herein by reference. Further, a technique of using polyvinyl alcohol as a binder is disclosed in JP-A No. 50-151138, the disclosure of which is incorporated herein by reference.

However, these techniques are not practically satisfactory since the fogging is significant and the tone of the formed image is not good. On the other hand, techniques of using polymer latex binder and water-based medium for forming an image-forming layer are disclosed in JP-A Nos. 10-10669 and 10-62899, the disclosures of which are incorporated herein by reference.

It has been shown, for example in JP-A No. 2002-303953 (the disclosure of which is incorporated herein by reference), that processing fragility and image stability in storage in the dark (fogging at storage) can be improved by using a polymer latex with a specific physical properties as a binder. Further, JP-A No. 11-84573 (the disclosure of which is incorporated herein by reference) discloses that a low Dmin and a high Dmax are realized by using a specific polymer latex as the binder for the image-forming layer and the protective layer.

However, the performance of the photothermographic material is still unsatisfactory even when such polymer latexes are used. In particular, the image storage stability is a problem unique to photothermographic materials, and improvement thereof has been requested.

SUMMARY OF THE INVENTION

The present invention has been made in consideration of the above problems of conventional techniques. The present invention provides a photothermographic material with high sensitivity and improved image storage stability which realizes a high image density.

The present invention provides a photothermographic material comprising a support and an image-forming layer, a non-photosensitive intermediate layer A, and an outermost layer provided on at least one side of the support. The image-forming layer comprises a photosensitive silver halide, a non-photosensitive organic silver salt, a reducing agent, and a binder. The outermost layer is disposed on the side of the image-forming layer further from the support. The non-photosensitive intermediate layer A is disposed between the image-forming layer and the outermost layer. At least 50 mass % of the binder in the non-photosensitive intermediate layer A is a polymer latex having a film water absorption of 5% or lower.

The present invention also provides a photothermographic material comprising a support and an image-forming layer, a non-photosensitive intermediate layer A, and an outermost layer provided on at least one side of the support. The image-forming layer comprises a photosensitive silver halide, a non-photosensitive organic silver salt, a reducing agent, and a binder. The outermost layer is disposed on the side of the image-forming layer further from the support.

The non-photosensitive intermediate layer A is disposed between the image-forming layer and the outermost layer. At least 50 mass % of the binder in the non-photosensitive intermediate layer A is a polymer latex having a film moisture absorption of 3% or lower.

The present invention also provides a photothermographic material comprising a support and an image-forming layer, a non-photosensitive intermediate layer A, and an outermost layer provided on at least one side of the support. The image-forming layer comprises a photosensitive silver halide, a non-photosensitive organic silver salt, a reducing agent, and a binder. The outermost layer is disposed on the side of the image-forming layer further from the support. The non-photosensitive intermediate layer A is disposed between the image-forming layer and the outermost layer. At least 50 mass % of the binder in the non-photosensitive intermediate layer A is a polymer latex having a film moisture absorption of 3% or lower and a film water absorption of 5% or lower.

In the above photothermographic materials, the non-photosensitive intermediate layer A may be disposed adjacent to the image-forming layer. Further, a non-photosensitive intermediate layer B may be disposed between the non-photosensitive intermediate layer A and the outermost layer, and the binder of the outermost layer or the non-photosensitive intermediate layer B or both may contain at least 50 mass % of a hydrophilic polymer derived from animal protein. For example, the constitution may be such a constitution that at least 50 mass % of the binder of the non-photosensitive intermediate layer B is a hydrophilic polymer derived from animal protein, and that at least 50 mass % of the binder of the outermost layer is a hydrophobic polymer.

The constitution of the photothermographic material may be such a constitution that the non-photosensitive intermediate layer B comprises at least two layers, and that the intermediate layer B nearer to the non-photosensitive intermediate layer A comprises at least 50 mass % of a hydrophilic polymer which is not derived from animal protein, and that the intermediate layer B nearer to the outermost layer comprises at least 50 mass % of a hydrophilic polymer derived from animal protein.

The binder of the non-photosensitive intermediate layer A may be such a binder that at least 50 mass % of the binder is a polymer comprising 10 mass % to 70 mass % of a monomer component represented by the following formula (M).

$$CH_2{=}CR^{01}{-}CR^{02}{=}CH_2 \qquad \text{Formula (M):}$$

In formula (M), $R^{01}$ and $R^{02}$ each independently represent a hydrogen atom, an alkyl group having 1 to 6 carbon atoms, a halogen atom, or a cyano group. The monomer component may be such a component in which $R^{01}$ and $R^{02}$ in formula (M) represent hydrogen atoms, or may be such a component in which one of $R^{01}$ and $R^{02}$ represent a hydrogen atom and the other represent a methyl group.

The binder of the outermost layer may comprise a hydrophobic polymer or a hydrophilic polymer derived from animal protein. For example, the binder of the outermost layer may comprise a hydrophilic polymer derived from animal protein and the hydrophilic polymer may be gelatin.

DESCRIPTION OF THE PRESENT INVENTION

The invention will be described below in detail.

The present invention provides a photothermographic material comprising a support and an image-forming layer, a non-photosensitive intermediate layer A, and an outermost layer provided on at least one side of the support. The image-forming layer comprises a photosensitive silver halide, a non-photosensitive organic silver salt, a reducing agent, and a binder. The outermost layer is disposed on the side of the image-forming layer further from the support. The non-photosensitive intermediate layer A is disposed between the image-forming layer and the outermost layer. In an embodiment, at least 50 mass % of the binder in the non-photosensitive intermediate layer A is a polymer latex having a film water absorption of 5% or lower. In another embodiment, at least 50 mass % of the binder in the non-photosensitive intermediate layer A is a polymer latex having a film moisture absorption of 3% or lower. In still another embodiment, at least 50 mass % of the binder in the non-photosensitive intermediate layer A is a polymer latex having a film water absorption of 5% or lower and a film moisture absorption of 3% or lower.

The non-photosensitive intermediate layer A is provided preferably adjacent to the image-forming layer. In a preferable embodiment, a non-photosensitive intermediate layer B is provided between the non-photosensitive intermediate layer A and the outermost layer, and the binder of at least one layer of the outermost layer and the non-photosensitive intermediate layer B contains at least 50 mass % of a hydrophilic polymer derived from animal protein.

In a preferable embodiment, at least 50 mass % of the binder of the non-photosensitive intermediate layer A is a polymer including 10 mass % to 70 mass % of a monomer component represented by the following formula (M).

$$CH_2{=}CR^{01}{-}CR^{2}{=}CH_2 \qquad \text{Formula (M)}$$

In the formula (M), $R^{01}$ and $R^{02}$ each independently represents a group selected from a hydrogen atom, an alkyl group having 1 to 6 carbon atoms, a halogen atom, and a cyano group. More preferably, $R^{01}$ and $R^{02}$ both represent hydrogen atoms, or one of them represents a hydrogen atom while the other represents a methyl group.

The non-photosensitive intermediate layer B preferably comprises two or more layers. In an embodiment, the non-photosensitive intermediate layer B on the side near the non-photosensitive intermediate layer A contains at least 50 mass % of a hydrophilic polymer which is not derived from animal protein, and the non-photosensitive intermediate layer B on the side near the outermost layer contains at least 50 mass % of a hydrophilic polymer derived from animal protein.

In a preferable embodiment, at least 50 mass % of the binder of the outermost layer is a hydrophobic polymer or a hydrophilic polymer derived from animal protein.

The hydrophilic polymer derived from animal protein is preferably gelatin.

Non-Photosensitive Intermediate Layer A

The non-photosensitive intermediate layer A is provided between the image-forming layer and the outermost layer and is a layer containing a film-forming binder. Besides the binder, the non-photosensitive intermediate layer A may contain after-mentioned additives such as development accelerators or development inhibitors, dyes, pigments, plasticizers, lubricating agents, crosslinking agents, and surfactants.

(Binder of Non-Photosensitive Intermediate Layer A)

The binder liquid of the non-photosensitive intermediate layer A used in the invention contains at least one of: such a polymer latex liquid that the film formed from the polymer latex liquid under the atmosphere of 40° C. and 60% RH over 48 hours has a film water absorption of not more than 5%; and such a polymer latex liquid that the film formed from the polymer latex liquid under the atmosphere of 40° C. and 60% RH over 48 hours has a film moisture absorption of not more than 3%. The film water absorption is preferably not more than 4%, more preferably not more than 3%. The film moisture absorption is preferably not more than 2.5%, more preferably not more than 2%.

In an embodiment, the film water absorption is not more than 5% and the film moisture absorption is not more than 3%. In a preferable embodiment, the film water absorption is not more than 4% and the film moisture absorption is not more than 2.5%. In a more preferable embodiment, the film water absorption is not more than 3% and the film moisture absorption is not more than 2%.

Film Water Absorption

<Definition>

In this specification, the film water absorption is defined as follows: The latex liquid is left in a condition of 40° C. and 60% RH for 48 hours, so that a film is formed, and the mass of the film is measured. Thereafter, the film is immersed in water having a temperature of 25° C., and the mass of the film is measured when the film has been immersed for three hours. The rate of mass increase is defined as the film water absorption.

<Measurement Method>

The mass of a substrate is measured, and the latex liquid is coated thereon in a uniform thickness. The coating amount is adjusted such that the dry film thickness is 0.7 mm. Thereafter, drying is carried out in an atmosphere of 40° C. and 60% RH for 48 hours to form a film. The total mass of the latex film and the substrate is measured and then the substrate having the latex film provided thereon is immersed in water at 25° C. Three hours after the start of the immersion, the substrate with the latex film is taken out of the water. Water is rapidly wiped from the substrate and the latex film, and the total mass of the substrate and the latex film is measured. The rate (%) of mass increase during the immersion is defined as the film water absorption.

Film Moisture Absorption

<Definition>

In this specification, the film moisture absorption is defined as follows: The latex liquid is left in a condition of 40° C. and 60% RH for 48 hours, so that a film is formed, and the mass of the film is measured. Thereafter, the film is left in an atmosphere of 25° C. and 80% RH for 12 hours, and the mass of the film is measured when the film has been left in the atmosphere for 12 hours. The rate of mass increase is defined as the film moisture absorption.

<Measurement Method>

The mass of a substrate is measured, and the latex liquid is coated thereon in a uniform thickness. The coating amount is adjusted such that the dry film thickness is 0.7 mm. Thereafter, drying is carried out in an atmosphere of 40° C. and 60% RH for 48 hours to form a film. The total mass of the latex film and the substrate is measured and then the substrate having the latex film provided thereon is left in a condition of 25° C. and 80% RH for 12 hours. When the substrate with the latex film has been left in the condition for 12 hours, the total mass of the substrate and the latex film is measured. The rate (%) of mass increase during the storage in the condition of 25° C. and 80% RH is defined as the film moisture absorption.

The binder of the non-photosensitive intermediate layer A used in the invention is preferably a polymer latex liquid. The surfactant or high molecular compound such as polyvinyl alcohol and gelatin present in the polymer latex liquid has a function of improving the storage stability of the polymer latex liquid and largely changes the film water absorption and the film moisture absorption described above. For that reason, the type and amount of the surfactant or high molecular compound should be selected such that the polymer latex liquid of the invention is obtained. In that case, for the purpose of improving the stability of the polymer latex liquid, it is important to use an optimum acid species in an optimum amount at synthesis of the polymer latex.

The preferred binder of the non-photosensitive intermediate layer A is a polymer solution containing 10 mass % to 70 mass % of a monomer component represented by the following formula (M).

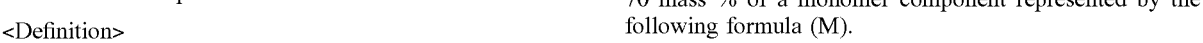

$$CH_2{=}CR^{01}{-}CR^{02}{=}CH_2 \qquad \text{Formula (M)}$$

In the formula (M), $R^{01}$ and $R^{02}$ each independently represent a hydrogen atom, an alkyl group having 1 to 6 carbon atoms, a halogen atom, or a cyano group. In a preferable embodiment, $R^{01}$ and $R^{02}$ both represent hydrogen atoms. In another preferable embodiment, one of $R^{01}$ and $R^{02}$ represents a hydrogen atom while the other represents a methyl group.

When $R^{01}$ or $R^{02}$ represents an alkyl group, the alkyl group preferably has 1 to 4 carbon atoms, more preferably has 1 to 2 carbon atoms. When $R^{01}$ or $R^{02}$ represents a halogen atom, the halogen atom is preferably a fluorine atom, a chlorine atom, or a bromine atom, more preferably a chlorine atom.

In a preferable embodiment, $R^{01}$ and $R^{02}$ both represent hydrogen atoms. In another preferable embodiment, one of $R^{01}$ and $R^{02}$ represents a hydrogen atom and the remainder represents a methyl group.

Specific examples of the monomers represented by the formula (M) include 2-ethyl-1,3-butadiene, 2-n-propyl-1,3-butadiene, 2,3-dimethyl-1,3-butadiene, 2-methyl-1,3-butadiene, 2-chloro-1,3-butadiene, 1-bromo-1,3-butadiene, 2-fluoro-1,3-butadiene, 2,3-dichloro-1,3-butadiene, and 2-cyano-1,3-butadiene.

The binder of the invention is a polymer comprising a monomer represented by the formula (M) as a copolymerization component. The copolymerization ratio of the monomer represented by the formula (M) in the polymer is 10 mass % to 70 mass %, preferably 15 mass % to 65 mass %, more preferably 20 mass % to 60 mass %. When the copolymerization ratio of the monomer represented by the formula (M) is less than 10 mass %, the amount of fusible component in the binder is reduced, whereby processing fragility becomes worse.

On the other hand, when the copolymerization ratio of the monomer represented by the formula (M) exceeds 70 mass %, the amount of fusible component in the binder increases, and the mobility of the binder increases. Therefore, image storability becomes worse.

The binder of the invention may further comprise a monomer having an acid group, in addition to the monomer of the formula (M). As the acid group, a carboxylic acid, sulfonic acid, and phosphoric acid are preferable, and a carboxylic acid is especially preferable. The copolymerization ratio of the acid group is preferably 1 to 20 mass %, and more preferably 1 to 10 mass %. Specific examples of the monomer containing an acid group include acrylic acid, methacrylic acid, itaconic acid, sodium p-styrenesulfonate, isoprenesulfonic acid, and phosphorylethyl methacrylate. Of these, acrylic acid and methacrylic acid are preferable, and acrylic acid is especially preferable.

The glass transition temperature (Tg) of the binder of the invention is preferably in the range of −30° C. to 70° C., more preferably −10° C. to 50° C., still more preferably 0° C. to 40° C. in view of film forming properties and image storability. A blend of two or more types of polymers can be used as the binder. When two or more polymers are used, the average Tg obtained by summing up the Tg of each polymer weighted by its proportion is preferably within the foregoing range. Also, when phase separation occurs or when a core-shell structure is adopted, the weighted average Tg is preferably within the foregoing range.

In the invention, Tg of a copolymer can be calculated using the following equation:

$$1/Tg=\Sigma(Xi/Tgi).$$

Assuming the copolymer is comprised of n monomers which are designated by "monomer i" (i=1 to n), Xi is the weight fraction of the monomer i (ΣXi=1), and Tgi is the glass-transition temperature (absolute temperature) of the homopolymer of the monomer i. Σ(Xi/Tgi) is the sum of Xi/Tgi for i=1 to n. In the invention, the glass-transition temperature Tgi of the homopolymer of each monomer is based on a value described in J. Brandrup and E. H. Immergut, *Polymer Handbook, 3rd Edition* (Wiley-Interscience, 1989), the disclosure of which is incorporated by reference herein.

The polymer used for the binder of the invention can be easily obtained by a solution polymerization method, a suspension polymerization method, an emulsion polymerization method, a dispersion polymerization method, an anionic polymerization method, a cationic polymerization method, or the like. Above all, an emulsion polymerization method in which the polymer is obtained as a latex is the most preferable. For example, an emulsion polymerization method comprises conducting polymerization under stirring at about 30° C. to about 100° C. (preferably 60° C. to 90° C.) for 3 to 24 hours by using water or a mixed solvent of water and a water-miscible organic solvent (such as methanol, ethanol, or acetone) as a dispersion medium, a monomer mixture in an amount of 5 mass % to 150 mass % based on the amount of the dispersion medium, an emulsifier and a polymerization initiator. Various conditions such as the dispersion medium, the monomer concentration, the amount of initiator, the amount of emulsifier, the amount of dispersant, the reaction temperature, and the method for adding monomer are suitably determined considering the type of the monomers to be used. Furthermore, it is preferable to use a dispersant as necessary.

Generally, the emulsion polymerization method can be conducted according to the disclosures of the following documents: *Gosei Jushi Emarujon* (Synthetic Resin Emulsions) (edited by Taira Okuda and Hiroshi Inagaki and published by Kobunshi Kankokai (1978)); *Gosei Ratekkusu no Oyo* (Applications of Synthetic Latexs) (edited by Takaaki Sugimura, Yasuo Kataoka, Soichi Suzuki and Keiji Kasahara and published by Kobunshi Kankokai (1993)); and *Gosei Ratekkusu no Kagaku* (Chemistry of Synthetic Latexes) (edited by Soichi Muroi and published by Kobunshi Kankokai (1970)), the disclosures of which are incorporated herein by reference. The emulsion polymerization method for synthesizing the polymer latex of the invention may be a batch polymerization method, a monomer (continuous or divided) addition method, an emulsion addition method, a seed polymerization method, or the like. Of these, a batch polymerization method, a monomer (continuous or divided) addition method, and an emulsion addition method are preferable in view of the productivity of latex.

The polymerization initiator may be any polymerization initiator having radical generating ability. The polymerization initiator may be selected from inorganic peroxides such as persulfates and hydrogen peroxide, peroxides as described in the organic peroxide catalogue of NOF Corporation, and azo compounds as described in the azo polymerization initiator catalogue of Wako Pure Chemical Industries, Ltd. Of these, water-soluble peroxides such as persulfates and water-soluble azo compounds as described in the azo polymerization initiator catalogue of Wako Pure Chemical Industries, Ltd., are preferable; ammonium persulfate, sodium persulfate, potassium persulfate, azobis(2-methylpropionamidine) hydrochloride, azobis(2-meth-yl-N-(2-hydroxyethyl)propionamide), and azobiscyanovaleric acid are more preferable; and peroxides such as ammonium persulfate, sodium persulfate, and potassium persulfate are especially preferable from the viewpoints of image storability, solubility and cost.

The amount of the polymerization initiator to be added is, based on the total amount of monomers, preferably 0.3 mass % to 2.0 mass %, more preferably 0.4 mass % to 1.75 mass %, and especially preferably 0.5 mass % to 1.5 mass %. When the amount of the polymerization initiator is less than 0.3 mass %, the image storability is lowered; and when it exceeds 2.0 mass %, the latex is likely to aggregate, thereby lowering the coating properties.

The polymerization emulsifier may be selected from anionic surfactants, nonionic surfactants, cationic surfactants, and ampholytic surfactants. Of these, anionic surfactants are preferable from the viewpoints of dispersibility and image storability. Sulfonic acid type anionic surfactants are more preferable because polymerization stability can be ensured even with a small addition amount and they have resistance to hydrolysis. Long chain alkyldiphenyl ether disulfonic acid salts (whose typical example is PELEX SS-H manufactured by Kao Corporation) are still more preferable, and low electrolyte types such as PIONIN A-43-S (manufactured by Takemoto Oil & Fat Co., Ltd.) are especially preferable.

The amount of a sulfonic acid type anionic surfactant as the polymerization emulsifier is preferably 0.1 mass % to 10.0 mass %, more preferably 0.2 mass % to 7.5 mass %, and especially preferably 0.3 mass % to 5.0 mass %, based on the total amount of monomers. When the amount of the polymerization emulsifier is less than 0.1 mass %, the stability at the time of emulsion polymerization cannot be ensured. When it exceeds 10.0 mass %, the image storability is lowered.

It is preferable to use a chelating agent in synthesizing the polymer latex to be used in the invention. The chelating agent is a compound capable of coordinating (chelating) a polyvalent ion such as a metal ion (for example, an iron ion) or an alkaline earth metal ion (for example, a calcium ion). The chelating agent may be selected from compounds described in Japanese Patent Publication (JP-B) No. 6-8956, U.S. Pat. No. 5,053,322, and JP-A Nos. 4-73645, 4-127145, 4-247073, 4-305572, 6-11805, 5-173312, 5-66527, 5-158195, 6-118580, 6-110168, 6-161054, 6-175299 6-214352, 7-114161, 7-114154, 7-120894, 7-199433, 7-306504, 9-43792, 8-314090, 10-182571, 10-182570 and 11-190892, the disclosures of which are incorporated herein by reference.

The chelating agent is preferably selected from inorganic chelate compounds (such as sodium tripolyphosphate, sodium hexametaphosphate, and sodium tetrapolyphosphate), aminopolycarboxylic-acid-based chelate compounds (such as nitrilotriacetic acid and ethylenediaminetetraacetic acid), organic-phosphonic-acid-based chelate compounds (such as compounds described in *Research Disclosure,* No. 18,170, JP-A Nos. 52-102726, 53-42730, 56-97347, 54-121127, 55-4024, 55-4025, 55-29883, 55-126241, 55-65955, 55-65956, 57-179843 and 54-61125, and West German Patent No. 1,045,373, the disclosures of which are incorporated herein by reference), polyphenol-based chelating agents, and polyamine-based chelate compounds. Aminopolycarboxylic acid derivatives are especially preferable.

Preferred examples of aminopolycarboxylic acid derivatives include compounds in the appended table of EDTA (-Konpurekisan no Kagaku-) (EDTA (-Chemistry of Complexons-) (published by Nankodo Co., Ltd., 1977), the disclosure of which is incorporated herein by reference. Some of the carboxyl groups of these compounds may be in the form of a salt of an alkali metal (such as sodium or potassium) or an ammonium salt. The aminocarboxvlic acid derivative may be selected from iminodiacetic acid, N-methyliminodiacetic acid, N-(2-amino-ethyl)iminodiacetic acid, N-(carbamoylmethyl)iminodiacetic acid, nitriletriacetic acid, ethylenediamine-N,N'-diacetic acid, ethylenediamine-N,N'-di-α-propionic acid, ethylenediamine-N,N'-di-β-propionic acid, N,N'-ethylene-bis-(α-o-hydroxyphenyl) glycine, N,N'-di(2-hydroxybenzyl)ethylenedi-amine-N,N'-diacetic acid, ethylenediamine-N,N'-diacetic acid-N,N'-diacetohydroxamic acid, N-hydroxyethylethylenediamine-N,N',N'-triacetic acid, ethylenediamine-N,N,N',N'-tetraacetic acid, 1,2-propylenedi-arnine-N,N,N',N'-tetraacetic acid, d,l-2,3-diaminobutane-N,N,N',N'-tetraacetic acid, meso-2,3-diaminobutane-N,N,N',N'-tetraacetic acid, 1-phenylethylenedi-amine-N,N,N',N'-tetraacetic acid, d,l-1,2-diphenylethylene-diamine-N,N,N',N'-tetraacetic acid, 1,4-diaminobutane-N,N,N',N'-tetraacetic acid, trans-cyclobutane-1,2-diamine-N,N,N',N'-tetraacetic acid, trans-cyclopentane-1,2-di-amine-N,N,N',N'-tetraacetic acid, trans-cyclo-hexane-1,2-diamine-N,N,N',N'-tetraacetic acid, cis-cyclo-hexane-1,2-diamine-N,N,N',N'-tetraacetic acid, cyclo-hexane-1,3-diamine-N,N,N',N'-tetraacetic acid, cyclo-hexane-1,4-diamine-N,N,N',N'-tetraacetic acid, o-phenyl-enediamine-N,N,N',N'-tetraacetic acid, cis-1,4-diaminobutene-N,N,N',N'-tetraacetic acid, trans-1,4-diaminobutene-N,N,N',N'-tetraacetic acid, α,α'-diamino-o-xylene-N,N,N',N'-tetraacetic acid, 2-hydroxy-1,3-propanediamine-N,N,N',N'-tetraacetic acid, 2,2'-oxy-bis (ethyliminodiacetic acid), 2,2'-ethylenedioxy-bis (ethyliminodiacetic acid), ethylenediamine-N,N'-diacetic acid-N,N'-di-α-propionic acid, ethylenediamine-N,N'-diacetic acid-N,N'-di-β-propionic acid, ethylenedi-amine-N,N,N',N'-tetrapropionic acid, diethylenetriamine-N,N,N',N'',N''-pentaacetic acid, triethylenetetramine-N,N,N',N'',N'''-hexaacetic acid, and 1,2,3-tri-aminopropane-N,N,N',N'',N''',N'''-hexaacetic acid. Also, ones in which a part of carboxyl groups of these compounds is substituted with a salt of alkali metal (for example, sodium and potassium) or an ammonium salt can be enumerated.

The amount of the chelating agent to be added is preferably 0.01 mass % to 0.4 mass %, more preferably 0.02 mass % to 0.3 mass %, and especially preferably 0.03 mass % to 0.15 mass %, based on the total amount of monomers. When the addition amount of the chelating agent is less than 0.01 mass %, metal ions entering during the preparation of the polymer latex are not sufficiently trapped, and the stability of the latex against aggregation is lowered, whereby the coating properties become worse. When it exceeds 0.4 mass %, the viscosity of the latex increases, whereby the coating properties are lowered.

In the preparation of the polymer latex to be used in the invention, it is preferable to use a chain transfer agent. By controlling addition amount of the chain transfer agent, it is possible to control the gelling rate. The chain transfer agent may be selected from ones described in *Polymer Handbook* (3rd Edition) (Wiley-Interscience, 1989), the disclosure of which is incorporated herein by reference. Sulfur compounds are more preferable because they have high chain transfer ability and because the required amount is small. Especially, hydrophobic mercaptane-based chain transfer agents such as tert-dodecylmercaptane and n-dodecylmercaptane are preferable.

The amount of the chain transfer agent to be added is preferably 0.2 mass % to 2.0 mass %, more preferably 0.3 mass % to 1.8 mass %, especially preferably 0.4 mass % to 1.6 mass %, based on the total amount of monomers.

Besides the foregoing compounds, in the emulsion polymerization, additives may be used such as electrolytes, stabilizers, thickeners, defoaming agents, antioxidants, vulcanizers, antifreezing agents, gelling agents, and vulcanization accelerators. The additives may be selected from the additives described in *Synthetic Rubber Handbook.*

SPECIFIC EXAMPLES OF POLYMER

Specific examples (Exemplary Compounds (P-1) to (P-9)) of the polymer usable in the invention are shown in Table 1. However, the examples should not be construed as limiting the invention.

TABLE 1

| | Styrene | Isoprene | Acid group monomer | | Water | Moisture | |
|---|---|---|---|---|---|---|---|
| Compound No. | Copolymerization ratio (mass %) | Copolymerization ratio (mass %) | Kind | Copolymerization ratio (mass %) | absorption (%) | absorption (%) | Tg (° C.) |
| P-1 | 60.4 | 36.6 | Acrylic acid | 3 | 3.2 | 1.6 | 15.5 |
| P-2 | 60.4 | 36.6 | Acrylic acid | 3 | 4.8 | 2.5 | 15.5 |
| P-3 | 60.4 | 36.6 | Acrylic acid | 3 | 6.2 | 3.2 | 15.5 |
| P-4 | 45 | 52 | Acrylic acid | 3 | 3.2 | 1.6 | −6.6 |
| P-5 | 45 | 52 | Acrylic acid | 3 | 4.8 | 2.5 | −6.6 |
| P-6 | 45 | 52 | Acrylic acid | 3 | 6.2 | 3.2 | −6.6 |
| P-7 | 37 | 56 | Methacrylic acid | 7 | 2.9 | 1.4 | −12.4 |
| P-8 | 37 | 56 | Methacrylic acid | 7 | 4.5 | 1.9 | −12.4 |
| P-9 | 37 | 56 | Methacrylic acid | 7 | 5.8 | 3 | −12.4 |

A synthesis example of the compound P-1 will be described as a synthesis example of the polymer to be used in the invention.

The synthesis method is not limited to the synthesis example described below. Other exemplary compounds can be synthesized by a similar synthesis method. The latex polymer solution of the invention can be prepared by adjusting the water absorption and the moisture absorption to values within the ranges of the invention by changing the amount of the surfactant at the start of the synthesis, by further adding a surfactant after completion of the synthesis, or by changing the type or amount of the acid group monomer.

Synthesis Example 1

Synthesis of Exemplary Compound P-1

1,500 g of distilled water was put in a polymerization kettle of a gas monomer reactor TAS-2J manufactured by Taiatsu Techno Corporation, and heated to 90° C. and maintained at 90° C. for 3 hours to form passive films on a stainless-steel surface of the polymerization kettle and on members of a stainless-steel stirring device. To thus treated polymerization kettle were added 582.28 g of distilled water which had been subjected to nitrogen-gas bubbling for 1 hour, 7.21 g of a surfactant PIONINE A-43-S available from Takemoto Oil & Fat Co., Ltd., 19.56 g of 1 mol/l NaOH solution, 0.20 g of tetrasodium ethylenediaminetetraacetate, 314.99 g of styrene, 190.87 g of isoprene, 10.43 g of acrylic acid, and 2.09 g of tert-dodecylmercaptan. The gas monomer reactor was then closed, the contents were stirred at the stirring rate of 225 rpm, and the inner temperature of the reactor was raised to 65° C. A solution prepared by dissolving 2.61 g of ammonium persulfate in 40 ml of water was added thereto and stirred for 2 hours. The inner temperature of the reactor was then raised to 65° C., and stirring was conducted for another 4 hours. The polymerization conversion ratio of the monomers, obtained by solid content measurement, was 90% at this moment. Then, a solution prepared by dissolving 5.22 g of acrylic acid in 46.98 g of water was added to the resultant mixture, 10 g of water was added thereto, and further a solution prepared by dissolving 1.30 g of ammonium persulfate in 50.7 ml of water was added. Then, the inner temperature of the reactor was raised to 90° C. and the mixture was stirred for 3 hours. After the reaction, the inner temperature was lowered to room temperature, and to the mixture were added 1 mol/l solutions of NaOH and $NH_4OH$ such that the mole ratio of $Na^+$ ions to $NH_4^+$ ions became 1/5.3, whereby the pH value of the mixture was adjusted to 8.4. The resultant mixture was filtrated by a polypropylene filter having a pore diameter of 1.0 μm to remove extraneous substances such as wastes, and then stored. As a result, 1,248 g of isoprene latex P-1 was obtained. The halogen ion of the isoprene latex was measured by ion chromatography. As a result, the chloride ion concentration was found to be 3 ppm. The concentration of the chelating agent was measured by high performance liquid chromatography and found to be 142 ppm. The subject isoprene latex had a mean particle size of 120 nm, a Tg of 15° C., a concentration of solids of 41.3 mass %, a rate of gelation of 50.0 mass %, a water absorption of 3.2%, a moisture absorption of 1.6%, and an ionic conductivity of 5.23 mS/cm (the ionic conductivity was measured at 25° C. by using a conductivity analyzer CM-30S, manufactured by DKK-TOA Corporation).

In the coating liquid containing the polymer latex to be used in the invention, an aqueous solvent can be used as the solvent, and a water-miscible organic solvent can be used additionally. Examples of usable water-miscible organic solvents include alcohols (for example, methyl alcohol, ethyl alcohol, and propyl alcohol), cellosolves (for example, methyl cellosolve, ethyl cellosolve, and butyl cellosolve), ethyl acetate, and dimethylformamide. The amount of the organic solvent to be added is preferably not more than 50% of the entire solvent, and more preferably not more than 30% of the entire solvent.

Furthermore, in the polymer latex to be used in the invention, the polymer concentration is, based on the amount of the latex liquid, preferably 10 mass % to 70 mass %, more preferably 20 mass % to 60 mass %, and especially preferably 30 mass % to 55 mass %.

In a preferable embodiment, the polymer latex in the invention has an equilibrium water content of not more than 2 mass % at 25° C. and 60% RH. The equilibrium water content is more preferably 0.01 mass % to 1.5 mass %, and further preferably 0.02 mass % to 1.0 mass %.

The equilibrium water content at 25° C. 60% RH can be represented by the following equation:

$$\text{Equilibrium water content at 25° C. 60\% } RH=\{(W1-W0)/W0\}\times 100 \text{ (mass \%)},$$

in which W1 is a weight of a polymer having an equilibrium water content in an atmosphere of 25° C. 60% RH, and WO is a weight of the polymer in the bone-dry state at 25° C.

Definition and measuring methods of the water content is described in *Kobunshi Kogaku Koza* 14, *Kobunshi Zairyo Shikenho,* edited by The Society of Polymer Science, Japan, Chijin Shokan Co., Ltd., the disclosure of which is incorporated herein by reference.

The latex particle in the invention may have a mean particle size in the range of 1 nm to 50,000 nm, preferably 5 nm to 1,000 nm, more preferably 10 nm to 500 nm, further preferably 50 nm to 200 nm. The particle size distribution of the dispersed particles is not particularly restricted, and may be a wide or monodisperse distribution. It is preferable to use two or more kinds of particles each having a monodisperse distribution so as to adjust the physical properties of the coating liquid.

In the invention, the non-photosensitive intermediate layer A may further include hydrophilic polymers such as gelatin, polyvinyl alcohol, methyl cellulose, hydroxypropyl cellulose, and carboxymethyl cellulose as necessary. The amount of such a hydrophilic polymer to be added is preferably not more than 50 mass %, and more preferably not more than 20 mass %, based on the total amount of binder in the non-photosensitive intermediate layer A.

The coating amount of the entire binder in the non-photosensitive intermediate layer A is preferably in the range of 0.5 g/m$^2$ to 10 g/m$^2$, more preferably 1.0 g/m$^2$ to 4 g/m$^2$.

(Organic Silver Salt)

1) Composition

The non-photosensitive organic silver salt used in the invention is an organic silver salt which is relatively stable to light and which supplies a silver ion when heated to 80° C. or higher under the presence of the exposed photosensitive silver halide and the reducing agent, to form a silver image. The organic silver salt may be any organic substance that can be reduced by the reducing agent to provide a silver ion. Such non-photosensitive organic silver salts are described, for example, in JP-A No. 10-62899, Paragraph 0048 to 0049, EP-A No. 0803764A1, Page 18, Line 24 to Page 19, Line 37, EP-A No. 0962812A1, JP-A Nos. 11-349591, 2000-7683, and 2000-72711, the disclosures of which are incorporated herein by reference. The organic silver salt is preferably a silver salt of an organic acid, more preferably a silver salt of a long-chain aliphatic carboxylic acid having 10 to 30 carbon atoms, still more preferably a silver salt of a long-chain aliphatic carboxylic acid having 15 to 28 carbon atoms. Examples of the fatty acid silver salts include silver lignocerate, silver behenate, silver arachidate, silver stearate, silver oleate, silver laurate, silver caproate, silver myristate, silver palmitate, silver erucate, and mixtures thereof. In the invention, the proportion of the amount of silver behenate to the total amount of the organic silver salt is preferably 50 to 100 mol %, more preferably 85 to 100 mol %, still more preferably 95 to 100 mol %. Further, the ratio of the amount of silver erucate to the total amount of the organic silver salts is preferably 2 mol % or less, more preferably 1 mol % or less, further preferably 0.1 mol % or less.

Further, the ratio of the amount of silver stearate to the total amount of the organic silver salts is preferably 1 mol % or lower so as to obtain a photothermographic material with a low Dmin, high sensitivity, and excellent image storability. The ratio of the amount of silver stearate to the total amount of the organic silver salts is more preferably 0.5 mol % or lower. In a preferable embodiment, the organic silver salts include substantially no silver stearate.

When the organic silver salts include silver arachidate, the ratio of the amount of silver arachidate to the total amount of the organic silver salts is preferably 6 mol % or lower from the viewpoint of achieving a low Dmin and excellent image storability. The ratio of the amount of silver arachidate to the total amount of the organic silver salts is more preferably 3 mol % or lower.

2) Shape

The shape of the grains of the organic silver salt is not particularly restricted. The organic silver salt grains may be in a needle shape, a rod shape, a tabular shape, or a flaky shape.

In the invention, the organic silver salt grains are preferably in a flaky shape. It is also preferable to use organic silver salt grains in a short needle-shape, a rectangular shape, a cubic shape, or a potato-like shape, wherein each shape has a ratio of the longer axis to the shorter axis of lower than 5. Such organic silver salt grains cause less fogging which develops on the resultant photothermographic material in the heat development than long needle-shaped grains having a length ratio of the longer axis to the shorter axis of 5 or higher. The ratio of the longer axis to the shorter axis is more preferably 3 or lower, since the mechanical stability of the coating film is improved when organic silver salt grains having such a shape are used. In the invention, organic silver salt grains in a flaky shape are defined as follows. Organic silver salt grains are observed by an electron microscope, and the shape of each grain is approximated by a rectangular parallelepiped shape. The lengths of the three sides of the rectangular parallelepiped shape are respectively represented by a, b, and c in the ascending order (wherein c and b may be the same values), and a value x is calculated from the smaller values a and b using the following equation: $x=b/a$. The values x of approximately 200 grains are calculated in the above-described manner to obtain an average x (the average of the values x). The organic silver salt grains in a flaky shape are defined as grains with an average x of 1.5 or larger. The average x is preferably 1.5 to 30, more preferably 1.5 to 15. In contrast, the organic silver salt grains in a needle-shape are defined as grains with an average x of 1 or larger but smaller than 1.5.

In the flaky grains (grains in a flaky shape), the length a may be considered as the thickness of a tabular grain having a main plane defined by the sides with the lengths b and c. The average of the lengths a of the grains is preferably 0.01 μm to 0.3 μm, more preferably 0.1 μm to 0.23 μm. The average of values c/b of the grains is preferably 1 to 9, more preferably 1 to 6, furthermore preferably 1 to 4, most preferably 1 to 3.

When the equivalent sphere diameter is 0.05 μm to 1 μm, aggregation hardly occurs in the photosensitive material and the image storability is improved. In the invention, the equivalent sphere diameter is measured by: directly photographing a sample using an electron microscope, and then image-processing the negative.

The aspect ratio of the flaky grain is defined as the value of the equivalent sphere diameter/a. The aspect ratio of the flaky grain is preferably 1.1 to 30, more preferably 1.1 to 15, so as to prevent the aggregation of the grains in the photosensitive material, thereby improving the image storability.

The grain size distribution of the organic silver salt grains is preferably monodisperse distribution. In the monodisperse distribution, the percentage obtained by dividing the standard deviation of the length of the longer axis by the length of the longer axis and the percentage obtained by dividing the standard deviation of the length of the shorter axis by the length of the shorter axis are preferably 100% or lower, more preferably 80% or less, further preferably 50% or less. In order to observe the shape of the organic silver salt grain, a transmission electron microscope may be used to give a micrograph of the organic silver salt dispersion. Alternatively, the monodisperse distribution may be evaluated based on the standard deviation of the volume-weighted average diameter of the organic silver salt grains, and the percentage (the variation coefficient) obtained by dividing the standard deviation by the volume-weighted average diameter is preferably 100% or lower, more preferably 80% or lower, further preferably 50% or lower. For example, the grain size (the volume-weighted average diameter) may be measured by: dispersing the organic silver salt grains in a liquid, and exposing the dispersion to a laser light and obtaining the autocorrelation function of fluctuation of the scattering light to time.

3) Preparation

The organic silver salt grains may be prepared and dispersed by known methods described, for example, in JP-A No. 10-62899, EP-A Nos. 0803763A1 and 0962812A1, JP-A Nos. 11-349591, 2000-7683, 2000-72711, 2001-163889, 2001-163890, 2001-163827, 2001-33907, 2001-188313, 2001-83652, 2002-6442, 2002-49117, 2002-31870, and 2002-107868, the disclosures of which are incorporated herein by reference.

When the organic silver salt grains are dispersed in the presence of a photosensitive silver salt, the fogging is intensified and the sensitivity is remarkably reduced. Thus, in a preferable embodiment, substantially no photosensitive silver salts are present when the organic silver salt grains are dispersed. In the invention, the amount of photosensitive silver salts in the aqueous dispersion liquid of the organic silver salt is preferably 1 mol % or less, more preferably 0.1 mol % or less, per 1 mol of the organic silver salt. It is more preferable not to add photosensitive silver salts to the dispersion liquid actively.

In an embodiment, the photosensitive material is prepared by processes comprising mixing an aqueous organic silver salt dispersion liquid with an aqueous photosensitive silver salt dispersion liquid. The mixing ratio between the organic silver salt and the photosensitive silver salt may be selected depending on the use of the photosensitive material. The mole ratio of photosensitive silver salt to organic silver salt is preferably 1 mol % to 30 mol %, more preferably 2 to 20 mol %, particularly preferably 3 to 15 mol %. It is preferable to mix two or more aqueous organic silver salt dispersion liquids and two or more aqueous photosensitive silver salt dispersion liquids so as to adjust the photographic properties.

4) Amount

The amount of the organic silver salt may be selected without particular restrictions, and the total amount of the applied silver (including the photosensitive silver halide) is preferably 0.1 g/m$^2$ to 5.0 g/m$^2$, more preferably 0.3 g/m$^2$ to 3.0 g/m$^2$, furthermore preferably 0.5 g/m$^2$ to 2.0 g/m$^2$. In order to improve the image storability, the total amount of the applied silver is preferably 1.8 g/m$^2$ or less, more preferably 1.6 g/m$^2$ or less. In the invention, when a reducing agent preferred in the invention is used, sufficient image density can be achieved even with such a small amount of silver.

Reducing Agent

The photothermographic material of the invention preferably includes a heat developing agent which is a reducing agent for the organic silver salt. The reducing agent for the organic silver salt may be any substance which reduces a silver ion to metallic silver, and the reducing agent is preferably an organic substance. Examples of such a reducing agent are disclosed in JP-A No. 11-65021, paragraphs 0043 to 0045, and EP-A No. 0803764A1, p. 7, line 34 to p. 18, line 12, the disclosures of which are incorporated herein by reference. The reducing agent is preferably a so-called hindered phenol reducing agent having a substituent at an ortho position relative to the phenolic hydroxyl group, or a bisphenol reducing agent, particularly preferably a compound represented by the following formula (R).

Formula (R)

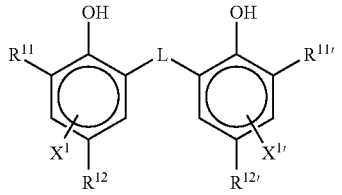

In the formula (R), $R^{11}$ and $R^{11}$ each independently represent an alkyl group; $R^{12}$ and $R^{12}$ each independently represent a hydrogen atom or a substituent which can be bonded to the benzene ring; L represents an —S— group or a —CHR$^{13}$— group, and $R^{13}$ represents a hydrogen atom or an alkyl group having 1 to 20 carbon atoms; $X^1$ and $X^{1'}$ each independently represent a hydrogen atom or a substituent which can be bonded to the benzene ring.

The formula (R) is described in detail below. In the following, the scope of the term "an alkyl group" encompasses "a cycloalkyl group" unless mentioned otherwise.

1) $R^{11}$ and $R^{11'}$ $R^{11}$ and $R^{11'}$ each independently represent a substituted or unsubstituted alkyl group having 1 to 20 carbon atoms. There are no particular restrictions on the substituents on the alkyl group. Examples of preferred substituents on the alkyl group include aryl groups, a hydroxy group, alkoxy groups, aryloxy groups, alkylthio groups, arylthio groups, acylamino groups, sulfonamide groups, sulfonyl groups, phosphoryl groups, acyl groups, carbamoyl groups, ester groups, ureido groups, urethane groups, and halogen atoms.

2) $R^{12}$ and $R^{12'}$ and $X^1$ and $X^{1'}$ $R^{12}$ and $R^{12'}$ each independently represent a hydrogen atom or a substituent which can be bonded to the benzene ring. Also $X^1$ and $X^{1'}$ each independently represent a hydrogen atom or a substituent which can be bonded to the benzene ring. Examples of preferable substituents which can be bonded to the benzene ring include alkyl groups, aryl groups, halogen atoms, alkoxy groups, and acylamino groups.

3) L

L represents an —S— group or a —CHR$^{13}$— group. $R^{13}$ represents a hydrogen atom or an alkyl group having 1 to 20 carbon atoms, and the alkyl group may have a substituent. When $R^{13}$ represents an unsubstituted alkyl group, examples thereof include a methyl group, an ethyl group, a propyl group, a butyl group, a heptyl group, an undecyl group, an isopropyl group, a 1-ethylpentyl group, a 2,4,4-trimethylpentyl group, a cyclohexyl group, a 2,4-dimethyl-3-cyclohexenyl group, and a 3,5-dimethyl-3-cyclohexenyl group. Examples of the substituent on the alkyl group represented by $R^{13}$ include the substituents described above as examples of the substituents on $R^{11}$ or $R^{11'}$. The substituent on the alkyl group may be a halogen atom, an alkoxy group, an alkylthio group, an aryloxy group, an arylthio group, an acylamino group, a sulfonamide group, a sulfonyl group, a phosphoryl group, an oxycarbonyl group, a carbamoyl group, or a sulfamoyl group.

4) Preferred Substituents $R^{11}$ and $R^{11'}$ are each preferably a primary, secondary or tertiary alkyl group having 1 to 15 carbon atom. Specific examples of such an alkyl group include a methyl group, an isopropyl group, a t-butyl group, a t-octyl group, a cyclohexyl group, a cyclopentyl group, a 1-methyl cyclohexyl group, and a 1-methylcyclopropyl group. $R^{11}$ and $R^{11'}$ each are more preferably an alkyl group having 1 to 4 carbon atoms, still more preferably a methyl group, a t-butyl group, a t-amyl group, or a 1-methylcyclohexyl group, most preferably a methyl group or a t-butyl group.

$R^{12}$ and $R^{12'}$ are each preferably an alkyl group having 1 to 20 carbon atoms, and specific examples thereof include a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group, and a methoxyethyl group. $R^{12}$ and $R^{12'}$ are each more preferably a methyl group, an ethyl group, a propyl group, an isopropyl group, or a t-butyl group, particularly preferably a methyl group or an ethyl group.

$X^1$ and $X^1$ are each preferably a hydrogen atom, a halogen atom, or an alkyl group, more preferably a hydrogen atom.

L is preferably a —CHR$^{13}$— group.

$R^{13}$ is preferably a hydrogen atom or an alkyl group having 1 to 15 carbon atoms. The alkyl group may be a linear alkyl group or a cyclic alkyl group, and may have a C=C bond. The alkyl group is preferably a methyl group, an ethyl group, a propyl group, an isopropyl group, a 2,4,4-trimethylpentyl group, a cyclohexyl group, a 2,4-dimethyl-3-cyclohexenyl group, or a 3,5-dimethyl-3-cyclohexenyl group. $R^{13}$ is particularly preferably a hydrogen atom, a methyl group, an ethyl group, a propyl group, an isopropyl group, or a 2,4-dimethyl-3-cyclohexenyl group.

When $R^{11}$ and $R^{11'}$ are tertiary alkyl groups and $R^{12}$ and $R^{12'}$ are methyl groups, $R^{13}$ is preferably a primary or secondary alkyl group having 1 to 8 carbon atoms such as a methyl group, an ethyl group, a propyl group, an isopropyl group, or a 2,4-dimethyl-3-cyclohexenyl group.

When $R^{11}$ and $R^{11'}$ are tertiary alkyl groups and $R^{12}$ and $R^{12'}$ are alkyl groups other than methyl, $R^{13}$ is preferably a hydrogen atom.

When none of $R^{11}$ and $R^{11'}$ is a tertiary alkyl group, $R^{13}$ is preferably a hydrogen atom or a secondary alkyl group, particularly preferably a secondary alkyl group. The secondary alkyl group is preferably an isopropyl group or a 2,4-dimethyl-3-cyclohexenyl group.

The combination of $R^{11}$, $R^{11'}$, $R^{12}$, $R^{12'}$ and $R^{13}$ affects the heat developability of the resultant photothermographic material, the tone of the developed silver, and the like. It is preferable to use a combination of two or more reducing agents depending on the purpose since such properties can be adjusted by the combination of the reducing agents.

Examples of the reducing agent used in the invention, such as the compound represented by formula (R), are shown below. However, reducing agents usable in the invention are not limited to the examples.

R-1

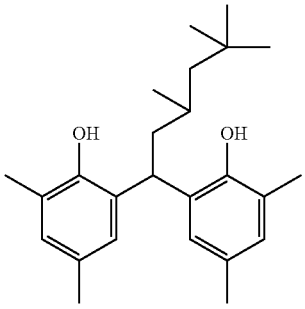

R-2

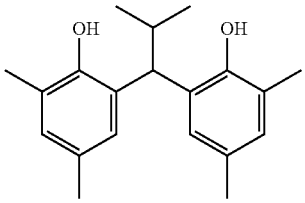

R-3

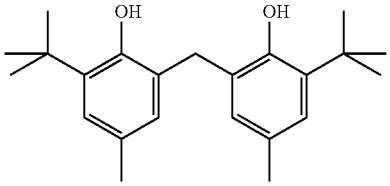

R-4

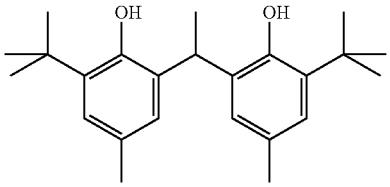

-continued

R-5

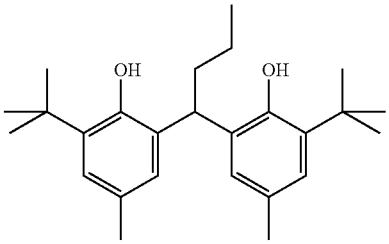

R-6

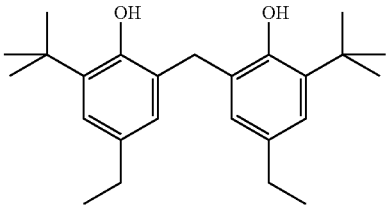

R-7

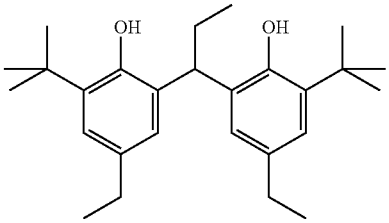

R-8

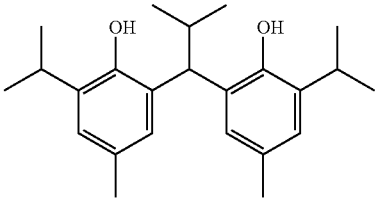

R-9

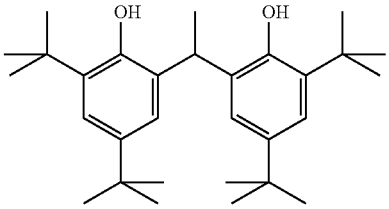

R-10

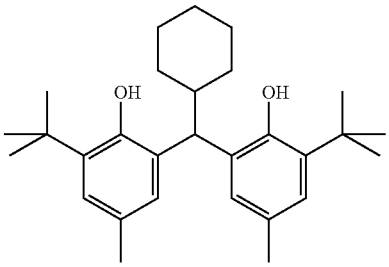

R-11

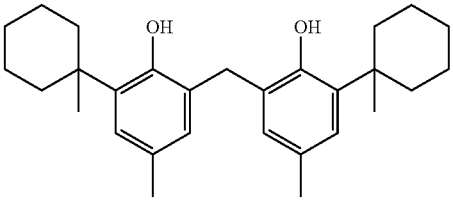

-continued

R-12

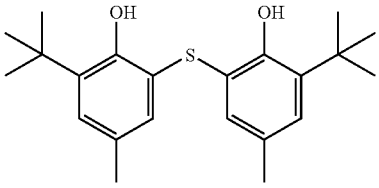

R-13

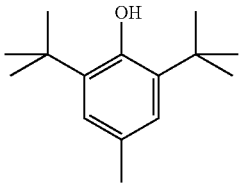

R-14

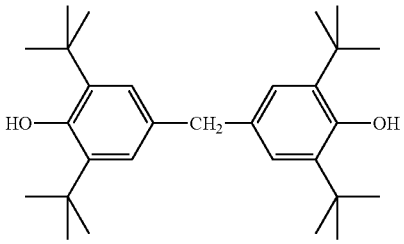

R-15

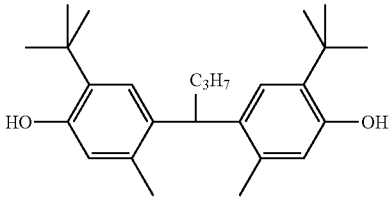

R-16

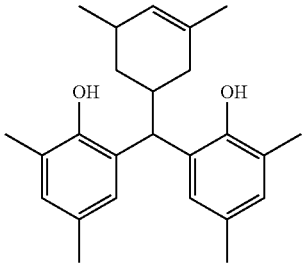

R-17

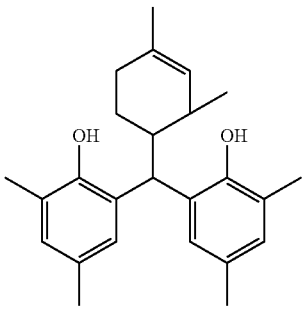

-continued

R-18

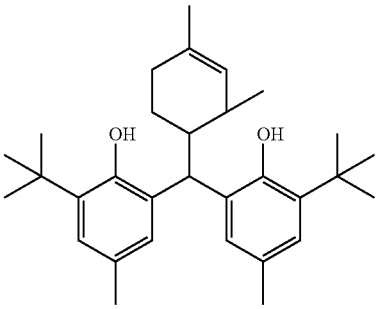

In addition, preferable reducing agents are also disclosed in JP-A Nos. 2001-188314, 2001-209145, 2001-350235, and 2002-156727, and EP-A No. 1278101A2, the disclosures of which are incorporated herein by reference. The amount of the reducing agent in the photothermographic material is preferably 0.1 to 3.0 g/m$^2$, more preferably 0.2 to 2.0 g/m$^2$, furthermore preferably 0.3 to 1.0 g/m$^2$. Further, the mole ratio of reducing agent to silver on the image-forming layer side is preferably 5 to 50 mol %, more preferably 8 to 30 mol %, further preferably 10 to 20 mol %. The reducing agent is preferably added to the image-forming layer.

The state of the reducing agent in the coating liquid may be any state such as a solution, an emulsion, a solid particle dispersion.

A well known example of the emulsification method comprises: dissolving the reducing agent in an oil such as dibutyl phthalate, tricresyl phosphate, dioctyl sebacate, or tri(2-ethylhexyl)phosphate, optionally using a cosolvent such as ethyl acetate or cyclohexanone; and then mechanically emulsifying the reducing agent in the presence of a surfactant such as sodium dodecylbenzene sulfonate, sodium oleoyl-N-methyltaurinate, or sodium di(2-ethylhexyl)sulfosuccinate. In this method, it is preferable to add a polymer such as cc-methylstyrene oligomer or poly(t-butylacrylamide) to the emulsion in order to control the viscosity and the refractive index of the oil droplets.

In an embodiment, the solid particle dispersion is prepared by a method comprising dispersing powder of the reducing agent in an appropriate solvent such as water using a ball mill, a colloid mill, a vibration ball mill, a sand mill, a jet mill, a roll mill, or ultrasonic wave. A protective colloid (e.g. a polyvinyl alcohol) and/or a surfactant such as an anionic surfactant (e.g. a mixture of sodium triisopropylnaphthalenesulfonates each having a different combination of the substitution positions of the three isopropyl groups) may be used in the preparation. Beads of zirconia, etc. are commonly used as a dispersing medium in the above mills, and in some cases Zr, etc. is eluted from the beads and mixed with the dispersion. The amount of the eluted and mixed component depends on the dispersion conditions, and is generally within the range of 1 to 1,000 ppm. The eluted zirconia does not cause practical problems as long as the amount of Zr in the photothermographic material is 0.5 mg or smaller per 1 g of silver.

In a preferable embodiment, the aqueous dispersion includes an antiseptic agent such as a benzoisothiazolinone sodium salt.

The reducing agent is particularly preferably used in the state of a solid particle dispersion. The reducing agent is preferably added in the form of fine particles having an average particle diameter of 0.01 to 10 μm, more preferably 0.05 to 5 μm, further preferably 0.1 to 2 μm. In the invention, the particle diameters of particles in other solid dispersions are preferably in the above range.

(Development Accelerator)

The photothermographic material of the invention preferably includes a development accelerator, and preferred examples thereof include sulfonamidephenol compounds such as sulfonamidephenol compounds represented by the formula (A) described in JP-A Nos. 2000-267222 and 2000-330234; hindered phenol compounds such as hindered phenol compounds represented by the formula (II) described in JP-A No. 2001-92075; hydrazine compounds such as hydrazine compounds represented by the formula (I) described in JP-A Nos. 10-62895 and 11-15116; hydrazine compounds represented by the formula (D) described in JP-A No. 2002-156727; hydrazine compounds represented by the formula (1) described in JP-A No. 2002-278017; phenol compounds and naphthol compounds such as phenol compounds and naphthol compounds represented by the formula (2) described in JP-A No. 2001-264929; phenol compounds described in JP-A Nos. 2002-311533 and 2002-341484; and naphthol compounds described in JP-A No. 2003-66558. The disclosures of the above patent documents are incorporated herein by reference. Naphthol compounds described in JP-A No. 2003-66558 are preferable.

The mol ratio of development accelerator to reducing agent may be 0.1 to 20 mol %, preferably 0.5 to 10 mol %, more preferably 1 to 5 mol %. The development accelerator may be added to the photothermographic material in any of the manners described above as examples of the method of adding the reducing agent. The development accelerator is particularly preferably added in the form of a solid dispersion or an emulsion. The emulsion of the development accelerator is preferably a dispersion prepared by emulsifying the development accelerator in a mixture of a high-boiling-point solvent that is solid at ordinary temperature and a low-boiling-point cosolvent, or a so-called oilless emulsion which includes no high-boiling-point solvents.

In the invention, the hydrazine compounds described in JP-A Nos. 2002-156727 and 2002-278017, and the naphthol compounds described in JP-A No. 2003-66558 are more preferable development accelerators.

In the invention, the development accelerator is particularly preferably a compound represented by the following formula (A-1) or (A-2).

Q1-NHNH-Q2 Formula (A-1);

In the formula (A-1), Q1 represents an aromatic group or a heterocyclic group each of which has a carbon atom bonded to the —NHNH-Q2 group. Q2 represents a carbamoyl group, an acyl group, an alkoxycarbonyl group, an aryloxycarbonyl group, a sulfonyl group, or a sulfamoyl group.

In the formula (A-1), the aromatic group or the heterocyclic group represented by Q1 preferably has a 5- to 7-membered unsaturated ring. Examples of the 5- to 7-membered unsaturated ring include a benzene ring, a pyridine ring, a pyrazine ring, a pyrimidine ring, a pyridazine ring, a 1,2,4-triazine ring, a 1,3,5-triazine ring, a pyrrole ring, an imidazole ring, a pyrazole ring, a 1,2,3-triazole ring, a 1,2,4-triazole ring, a tetrazole ring, a 1,3,4-thiadiazole ring, a 1,2,4-thiadiazole ring, a 1,2,5-thiadiazole ring, a 1,3,4-oxadiazole ring, a 1,2,4-oxadiazole ring, a 1,2,5-oxadiazole ring, a thiazole ring, an oxazole ring, an isothiazole ring, an isoxazole ring, a thiophene ring, and condensed rings thereof.

The ring may have a substituent. When the ring has two or more substituents, they may be the same as each other or different from each other. Examples of the substituents include halogen atoms, alkyl groups, aryl groups, carbonamide groups, alkylsulfonamide groups, arylsulfonamide groups, alkoxy groups, aryloxy groups, alkylthio groups, arylthio groups, carbamoyl groups, sulfamoyl groups, a cyano group, alkylsulfonyl groups, arylsulfonyl groups, alkoxycarbonyl groups, aryloxycarbonyl groups, and acyl groups. These substituents may further have substituents, and preferred examples thereof include halogen atoms, alkyl groups, aryl groups, carbonamide groups, alkylsulfonamide groups, arylsulfonamide groups, alkoxy groups, aryloxy groups, alkylthio groups, arylthio groups, acyl groups, alkoxycarbonyl groups, aryloxycarbonyl groups, carbamoyl groups, a cyano group, sulfamoyl groups, alkylsulfonyl groups, arylsulfonyl groups, and acyloxy groups.

When Q2 represents a carbamoyl group, the carbamoyl group preferably has 1 to 50 carbon atoms, and more preferably has 6 to 40 carbon atoms. Examples of the carbamoyl group include unsubstituted carbamoyl, methylcarbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl)carbamoyl, N-octadecylcarbamoyl, N-{3-(2,4-tert-pentylphenoxy)propyl}carbamoyl, N-(2-hexyldecyl)carbamoyl, N-phenylcarbamoyl, N-(4-dodecyloxyphenyl)carbamoyl, N-(2-chloro-5-dodecyloxycarbonylphenyl)carbamoyl, N-naphtylcarbamoyl, N-3-pyridylcarbamoyl, and N-benzylcarbamoyl.

When Q2 represents an acyl group, the acyl group preferably has 1 to 50 carbon atoms, and more preferably has 6 to 40 carbon atoms. Examples of the acyl group include formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl, and 2-hydroxymethylbenzoyl. When Q2 represents an alkoxycarbonyl group, the alkoxycarbonyl group preferably has 2 to 50 carbon atoms, and more preferably has 6 to 40 carbon atoms. Examples of the alkoxycarbonyl group include methoxycarbonyl, ethoxycarbonyl, isobutyloxycarbonyl, cyclohexyloxycarbonyl, dodecyloxycarbonyl, and benzyloxycarbonyl.

When Q2 represents an aryloxycarbonyl group, the aryloxycarbonyl group preferably has 7 to 50 carbon atoms, and more preferably has 7 to 40 carbon atoms. Examples of the aryloxycarbonyl group include phenoxycarbonyl, 4-octyloxyphenoxycarbonyl, 2-hydroxymethylphenoxycarbonyl, and 4-dodecyloxyphenoxycarbonyl. When Q2 represents a sulfonyl group, the sulfonyl group preferably has 1 to 50 carbon atoms, and more preferably has 6 to 40 carbon atoms. Examples of the sulfonyl groups include methylsulfonyl, butylsulfonyl, octylsulfonyl, 2-hexadecylsulfonyl, 3-dodecyloxypropylsulfonyl, 2-octyloxy-5-tert-octylphenylsulfonyl, and 4-dodecyloxyphenylsulfonyl.

When Q2 represents a sulfamoyl group, the sulfamoyl group preferably has 0 to 50 carbon atoms, and more preferably has 6 to 40 carbon atoms. Examples of the sulfamoyl group include unsubstituted sulfamoyl, N-ethylsulfamoyl, N-(2-ethylhexyl)sulfamoyl, N-decylsulfamoyl, N-hexadecylsulfamoyl, N-{3-(2-ethylhexyloxy)propyl}sulfamoyl, N-(2-chloro-5-dodecyloxycarbonylphenyl)sulfamoyl, and N-(2-tetradecyloxyphenyl)sulfamoyl.

The group represented by Q2 may have a substituent selected from the groups described above as examples of the substituent on the 5- to 7-membered unsaturated ring of Q1.

When the group represented by Q2 has two or more substituents, the substituents may be the same as each other or different from each other.

Next, preferable range of the compound represented by formula (A-1) is described. The group represented by Q1 preferably has a 5- or 6-membered unsaturated ring, and more preferably has a benzene ring, a pyrimidine ring, a 1,2,3-triazole ring, a 1,2,4-triazole ring, a tetrazole ring, a 1,3,4-thiadiazole ring, a 1,2,4-thiadiazole ring, a 1,3,4-oxadiazole ring, a 1,2,4-oxadiazole ring, a thiazole ring, an oxazole ring, an isothiazole ring, an isoxazole ring, or a condensed ring in which any of the above rings is fused with a benzene ring or with an unsaturated heterocycle. Q2 represents preferably a carbamoyl group, particularly preferably a carbamoyl group having a hydrogen atom on the nitrogen atom.

Formula (A-2)

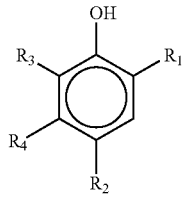

In the formula (A-2), $R_1$ represents an alkyl group, an acyl group, an acylamino group, a sulfonamide group, an alkoxycarbonyl group, or a carbamoyl group. $R_2$ represents a hydrogen atom, a halogen atom, an alkyl group, an alkoxy group, an aryloxy group, an alkylthio group, an arylthio group, an acyloxy group, or a carbonic acid ester group. $R_3$ and $R_4$ each independently represent a substituent which can be bonded to the benzene ring, which may be selected from the substituents described above in the explanation on the formula (A-1). $R_3$ and $R_4$ may combine to form a condensed ring.

$R_1$ represents preferably: an alkyl group having 1 to 20 carbon atoms such as a methyl group, an ethyl group, an isopropyl group, a butyl group, a tert-octyl group, or a cyclohexyl group; an acylamino group such as an acetylamino group, a benzoylamino group, a methylureido group, or a 4-cyanophenylureido group; or a carbamoyl group such as an n-butylcarbamoyl group, an N,N-diethylcarbamoyl group, a phenylcarbamoyl group, a 2-chlorophenylcarbamoyl group, or a 2,4-dichlorophenylcarbamoyl group. $R_1$ represents more preferably an acylamino group, which may be an ureido group or a urethane group. $R_2$ represents preferably: a halogen atom (more preferably a chlorine atom or a bromine atom); an alkoxy group such as a methoxy group, a butoxy group, an n-hexyloxy group, an n-decyloxy group, a cyclohexyloxy group, or a benzyloxy group; or an aryloxy group such as a phenoxy group or a naphthoxy group.

$R_3$ represents preferably a hydrogen atom, a halogen atom, or an alkyl group having 1 to 20 carbon atoms, most preferably a halogen atom. $R_4$ represents preferably a hydrogen atom, an alkyl group, or an acylamino group, more preferably an alkyl group or an acylamino group. Preferred examples of the group represented by $R_3$ or $R_4$ are equal to the above-described examples of the group represented by $R_1$. When $R_4$ represents an acylamino group, $R_4$ and $R_3$ may be bound to each other to form a carbostyryl ring.

When $R_3$ and $R_4$ combine with each other to form a condensed ring in the formula (A-2), the condensed ring is particularly preferably a naphthalene ring. The naphthalene ring may have a substituent selected from the above-described examples of the substituents on the ring of Q1 in the formula (A-1). When the compound represented by the formula (A-2) is a naphthol-based compound, $R_1$ represents preferably a carbamoyl group, particularly preferably a benzoyl group. $R_2$ represents preferably an alkoxy group or an aryloxy group, particularly preferably an alkoxy group.

Preferable examples of the development accelerator are illustrated below without intention of restricting the scope of the present invention.

A-1

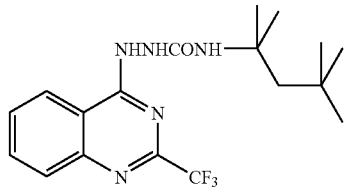

A-2

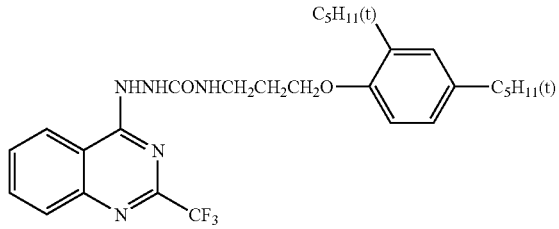

A-3

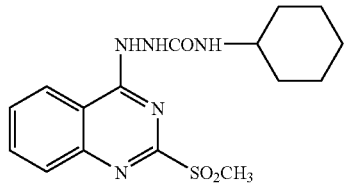

A-4

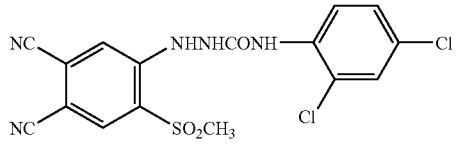

A-5

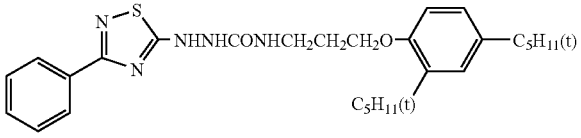

A-6

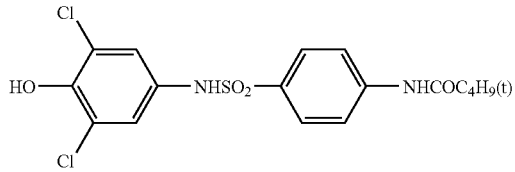

A-7

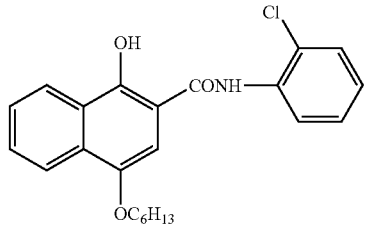

-continued

A-8

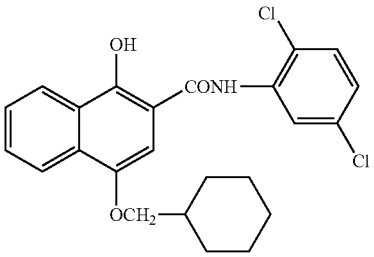

A-9

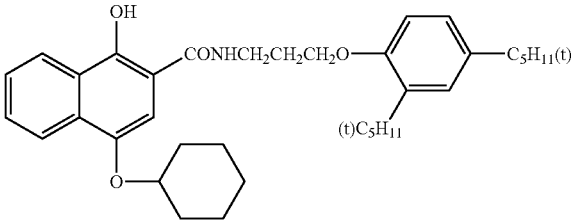

A-10

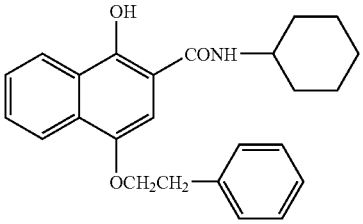

A-11

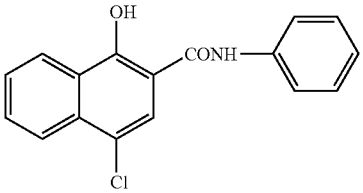

A-12

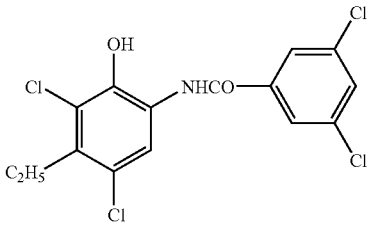

(Hydrogen-Bonding Compound)

When the reducing agent has an aromatic hydroxyl group (—OH) or amino group (—NHR, in which R represents a hydrogen atom or an alkyl group), particularly when the reducing agent is the above-mentioned bisphenol compound, it is preferable to use a non-reducing, hydrogen-bonding compound having a group capable of forming a hydrogen bond with the hydroxyl or amino group.

Examples of the group capable of forming a hydrogen bond with the hydroxyl or amino group include phosphoryl groups, sulfoxide groups, sulfonyl groups, carbonyl groups, amide groups, ester groups, urethane groups, ureido groups, tertiary amino groups, and nitrogen-including aromatic groups. The group capable of forming a hydrogen bond with the hydroxyl or amino group is preferably a phosphoryl group; a sulfoxide group; an amide group having no >N—H groups, but the nitrogen atom being blocked as >N—Ra (in which Ra represents a substituent other than H); an urethane group having no >N—H groups, the nitrogen atom being blocked as >N—Ra (in which Ra represents a substituent other than H); and an ureido group having no >N—H group, but the nitrogen atom being blocked as >N—Ra (in which Ra represents a substituent other than H).

The hydrogen-bonding compound used in the invention is particularly preferably a compound represented by the following formula (D):

Formula (D)

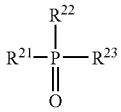

In the formula (D), $R^{21}$ to $R^{23}$ each independently represent an alkyl group, an aryl group, an alkoxy group, an aryloxy group, an amino group, or a heterocyclic group. These groups each may be unsubstituted or substituted.

When any of $R^{21}$ to $R^{23}$ has a substituent, examples of the substituent include halogen atoms, alkyl groups, aryl groups, alkoxy groups, amino groups, acyl groups, acylamino groups, alkylthio groups, arylthio groups, sulfonamide groups, acyloxy groups, oxycarbonyl groups, carbamoyl groups, sulfamoyl groups, sulfonyl groups, and phosphoryl groups. Preferred substituents are alkyl groups and aryl groups, and specific examples thereof include a methyl group, an ethyl group, an isopropyl group, a t-butyl group, a t-octyl group, a phenyl group, 4-alkoxyphenyl groups, and 4-acyloxyphenyl groups.

When any of $R^{21}$ to $R^{23}$ represents an alkyl group, examples thereof include a methyl group, an ethyl group, a butyl group, an octyl group, a dodecyl group, an isopropyl group, a t-butyl group, a t-amyl group, a t-octyl group, a cyclohexyl group, a 1-methylcyclohexyl group, a benzyl group, a phenethyl group, and a 2-phenoxypropyl group.

When any of $R^{21}$ to $R^{23}$ represents an aryl group, examples thereof include a phenyl group, a cresyl group, a xylyl group, a naphtyl group, a 4-t-butylphenyl group, a 4-t-octylphenyl group, a 4-anisidyl group, and a 3,5-dichlorophenyl group.

When any of $R^{21}$ to $R^{23}$ represents an alkoxy group, examples thereof include a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group, and a benzyloxy group.

When any of $R^{21}$ to $R^{23}$ represents an aryloxy group, examples thereof include a phenoxy group, a cresyloxy group, an isopropylphenoxy group, a 4-t-butylphenoxy group, a naphthoxy group, and a biphenyloxy group.

When any of $R^{21}$ to $R^{23}$ represents an amino group, examples thereof include a dimethylamino group, a diethylamino group, a dibutylamino group, a dioctylamino group, an N-methyl-N-hexylamino group, a dicyclohexylamino group, a diphenylamino group, and an N-methyl-N-phenylamino group.

$R^{21}$ to $R^{23}$ are each preferably an alkyl group, an aryl group, an alkoxy group, or an aryloxy group. In order to obtain the effects of the invention, in a preferable embodiment, at least one of $R^{21}$ to $R^{23}$ represents an alkyl group or an aryl group. In a more preferable embodiment, two or more of $R^{21}$ to $R^{23}$ represent groups selected from alkyl groups and aryl groups. Further, it is preferable to use a compound represented by the formula (D) in which $R^{21}$ to $R^{23}$ represent the same groups, from the viewpoint of reducing the cost.
Specific examples of the hydrogen-bonding compound (such as a compound represented by the formula (D)) are illustrated below without intention of restricting the scope of the present invention.
D-1
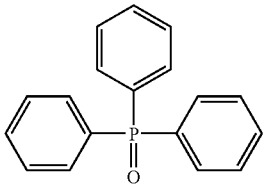
D-2
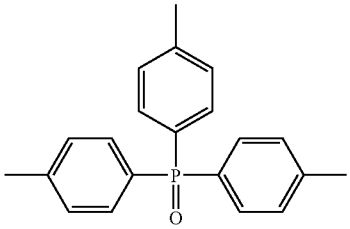
D-3
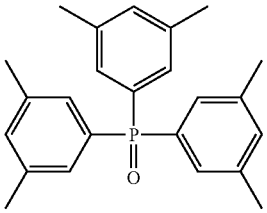
D-4
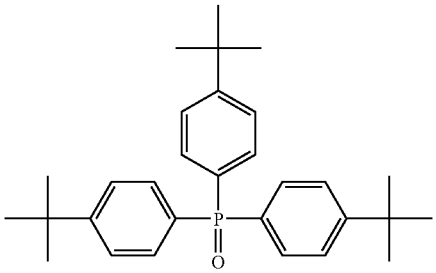
D-5
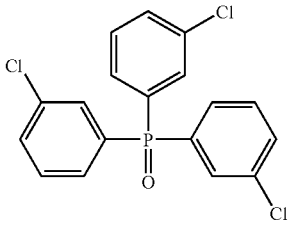
D-6
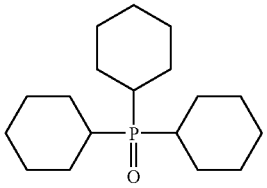
-continued
D-7
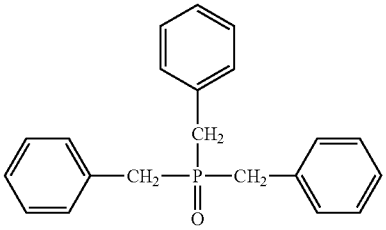
D-8
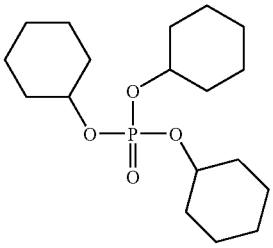
D-9
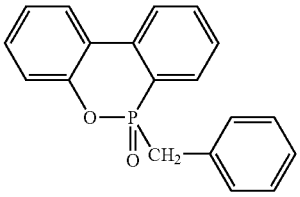
D-10
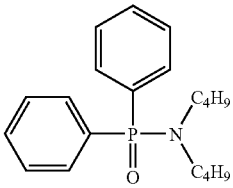
D-11
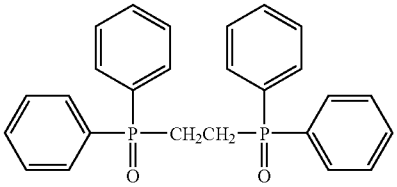
D-12
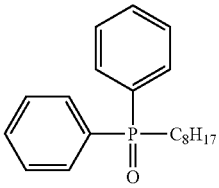
D-13
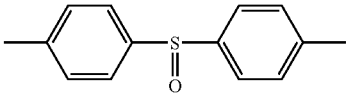
D-14
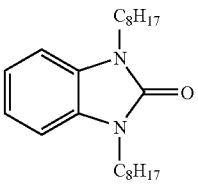

-continued

D-15

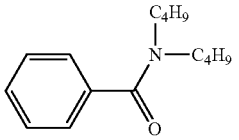

Specific examples of the hydrogen-bonding compound further include compounds disclosed in EP Patent No. 1096310, and JP-A Nos. 2002-156727 and 2002-318431, the disclosures of which are incorporated by reference herein.

The compound of the formula (D) may be added to the coating liquid and used in the photothermographic material in the form of a solution, an emulsion, or a solid particle dispersion. The specific manner of producing the solution, emulsion, or solid particle dispersion may be the same as in the case of the reducing agent. The compound is preferably used in the form of a solid dispersion. The hydrogen-bonding compound forms a hydrogen-bond complex with the reducing agent having a phenolic hydroxyl group or an amino group in the solution. The complex can be isolated as a crystal depending on the combination of the reducing agent and the compound of the formula (D).

It is particularly preferable to use the powder of the isolated crystal to form a solid particle dispersion, from the viewpoint of achieving stable performances. In a preferable embodiment, powder of the reducing agent and powder of the compound of the formula (D) are mixed, and then the mixture is dispersed in the presence of a dispersing agent by a sand grinder mill, etc., thereby forming the complex in the dispersing process.

The mole ratio of compound represented by the formula (D) to reducing agent is preferably 1 to 200 mol %, more preferably 10 to 150 mol %, further preferably 20 to 100 mol %.

Binder of Image-Forming Layer

The binder of the image-forming layer may be any polymer. The polymer is preferably transparent or translucent, and generally colorless. The polymer may be a natural resin, polymer or copolymer, a synthetic resin, polymer or copolymer, or another film-forming medium. Specific examples thereof include gelatins, gums, polyvinyl alcohols, hydroxyethylcelluloses, cellulose acetates, cellulose acetate butyrates, polyvinylpyrrolidones, caseins, starches, polyacrylic acids, polymethylmethacrylic acids, polyvinyl chlorides, polymethacrylic acids, styrene-maleic anhydride copolymers, styrene-acrylonitrile copolymers, styrene-butadiene copolymers, polyvinyl acetals (e.g. polyvinyl formals, polyvinyl butyrals, etc.), polyesters, polyurethanes, phenoxy resins, polyvinylidene chlorides, polyepoxides, polycarbonates, polyvinyl acetates, polyolefins, cellulose esters, and polyamides. In the coating liquid, the binder may be dissolved or dispersed in an aqueous solvent or an organic solvent, or may be in the form of an emulsion.

The glass-transition temperature of the binder polymer used in the image-forming layer is preferably 0 to 80° C. Polymer having such high glass-transition temperatures are hereinafter referred to as "high Tg binders" occasionally. The glass-transition temperature of the binder is more preferably 10 to 70° C., further preferably 15 to 60° C.

Two or more binders may be used as necessary. In an embodiment, a binder having a glass transition temperature of 20° C. or higher and a binder having a glass transition point of lower than 20° C. are used simultaneously. When a blend of polymers having different Tg's are used, the mass-average Tg is preferably in the above-described range.

In a preferable embodiment, a coating liquid is prepared which includes a solvent comprising water in an amount of 30 mass % or more based on the amount of the solvent, then the coating liquid is applied and dried to form the image-forming layer. In this embodiment, the binder of the image-forming layer is preferably soluble or dispersible in a water-based solvent (water solvent). The binder is preferably a polymer latex having an equilibrium moisture content of 2 mass % or lower at 25° C. 60% RH. The latex preferably has an ionic conductivity of 2.5 mS/cm or lower, and such a latex can be prepared by purifying a synthesized polymer using a separation membrane.

The above water-based solvent is water or a mixed solvent of water and a water-miscible organic solvent, the proportion of the water-miscible organic solvent to the mixed solvent being 70 mass % or lower. Examples of the water-miscible organic solvent include alcohol solvents such as methyl alcohol, ethyl alcohol, and propyl alcohol; cellosolve solvents such as methyl cellosolve, ethyl cellosolve, and butyl cellosolve; ethyl acetate; and dimethylformamide.

The equilibrium moisture content at 25° C. 60% RH of the binder polymer is preferably 2 mass % or lower, more preferably 0.01 to 1.5 mass %, furthermore preferably 0.02 to 1 mass %.

The binder polymer is preferably dispersible in an aqueous solvent. The dispersion state of the polymer in the coating liquid may be a latex in which fine particles of a water-insoluble hydrophobic polymer are dispersed, or a dispersion (or emulsion) liquid in which polymer molecules are dispersed in the molecular or micell state. The latex dispersion is more preferable. The average particle diameter of the dispersed particles is 1 to 50,000 nm, preferably 5 to 1,000 nm, more preferably 10 to 500 nm, and furthermore preferably 50 to 200 nm. The particle size distribution of the dispersed particles is not particularly restricted, and may be a wide or monodisperse distribution. It is preferable to use two or more kinds of particles each having a monodisperse distribution so as to adjust the physical properties of the coating liquid.

Preferred examples of the polymers dispersible in the aqueous solvents include hydrophobic polymers such as acrylic polymers, polyesters, rubbers (e.g. SBR resins), polyurethanes, polyvinyl chlorides, polyvinyl acetates, polyvinylidene chlorides, and polyolefins. The polymer may be linear, branched, or cross-linked, and may be a homopolymer derived form one monomer or a copolymer derived form two or more monomers. The copolymer may be a random copolymer or a block copolymer. The number-average molecular weight of the polymer is preferably 5,000 to 1,000,000, more preferably 10,000 to 200,000. When the number-average molecular weight is too small, the resultant image-forming layer tends to have insufficient strength. On the other hand, when the number-average molecular weight is too large, the polymer is poor in the film-forming properties. Further, cross-linkable polymer latexes are particularly preferable.

Specific examples of usable polymer latexes are described below. In the examples, the polymers are represented by the starting monomers, the numerals in parentheses represent the mass ratios (mass %) of the monomers, and the molecular weights are number-average molecular weights. The polymers using multifunctional monomers have cross-linked structures and the concept of the molecular weight cannot be implemented because of the cross-linked structures, whereby such polymers are referred to as cross-linked polymers and explanation of the molecular weight is omitted. Tg represent the glass-transition temperature.

P-1; Latex of -MMA(70)-EA(27)-MAA(3)- (Molecular weight 37,000, Tg 61° C.)

P-2; Latex of -MMA(70)-2EHA(20)-St(5)-AA(5)- (Molecular weight 40,000, Tg 59° C.)

P-3; Latex of -St(50)-Bu(47)-MAA(3)- (Cross-linked polymer, Tg-17° C.)

P-4; Latex of -St(68)-Bu(29)-AA(3)- (Cross-linked polymer, Tg 17° C.)

P-5; Latex of -St(71)-Bu(26)-AA(3)- (Cross-linked polymer, Tg 24° C.)

P-6; Latex of -St(70)-Bu(27)-IA(3)- (Cross-linked polymer)

P-7; Latex of -St(75)-Bu(24)-AA(1)- (Cross-linked polymer, Tg 29° C.)

P-8; Latex of -St(60)-Bu(35)-DVB(3)-MAA(2)- (Cross-linked polymer)

P-9; Latex of -St(70)-Bu(25)-DVB(2)-AA(3)- (Cross-linked polymer)

P-10; Latex of -VC(50)-MMA(20)-EA(20)-AN(5)-AA(5)- (Molecular weight 80,000)

P-11; Latex of -VDC(85)-MMA(5)-EA(5)-MAA(5)- (molecular weight 67,000)

P-12; Latex of -Et(90)-MAA(10)- (Molecular weight 12,000)

P-13; Latex of -St(70)-2EHA(27)-AA(3)- (Molecular weight 130,000, Tg 43° C.)

P-14; Latex of -MMA(63)-EA(35)-AA(2)- (Molecular weight 33,000, Tg 47° C.)

P-15; Latex of -St(70.5)-Bu(26.5)-AA(3)- (Cross-linked polymer, Tg 23° C.)

P-16; Latex of -St(69.5)-Bu(27.5)-AA(3)- (Cross-linked polymer, Tg 20.5° C.)

The abbreviations in the above examples represent the following monomers.

MMA; Methyl methacrylate
EA; Ethyl acrylate
MAA; Methacrylic acid
2EHA; 2-Ethylhexyl acrylate
St; Styrene
Bu; Butadiene
AA; Acrylic acid
DVB; Divinylbenzene
VC; Vinyl chloride
AN; Acrylonitrile
VDC; Vinylidene chloride
Et; Ethylene
IA; Itaconic acid Commercially-available polymer latexes may be used in the invention, and examples thereof include acrylic polymers such as CEBIAN A-4635, 4718, and 4601 (available from Daicel Chemical Industries, Ltd.) and NIPOL LX811, 814, 821, 820, and 857 (available from Nippon Zeon Co., Ltd.); polyesters such as FINETEX ES650, 611, 675, and 850 (available from Dainippon Ink and Chemicals, Inc.) and WD-size and WMS (available from Eastman Chemical Co.); polyurethanes such as HYDRAN AP 10, 20, 30, and 40 (available from Dainippon Ink and Chemicals, Inc.); rubbers such as LACSTAR 7310K, 3307B, 4700H, and 7132C (available from Dainippon Ink and Chemicals, Inc.) and NIPOL LX416, 410, 438C, and 2507 (available from Nippon Zeon Co., Ltd.); polyvinyl chlorides such as G351 and G576 (available from Nippon Zeon Co., Ltd.); polyvinylidene chlorides such as L502 and L513 (available from Asahi Kasei Kogyo K. K.); and polyolefins such as CHEMIPEARL S120 and SA100 (available from Mitsui Chemicals, Inc.).

Only a single polymer latex may be used or a mixture of two or more polymer latexes may be used in accordance with the necessity.

The polymer latex to be used in the invention is preferably a latex of styrene-butadiene copolymer. The ratio between the mass of styrene monomer units and the mass of butadiene monomer units in the styrene-butadiene copolymer is preferably in the range of 40:60 to 95:5. The proportion of the total mass of styrene monomer units and the butadiene monomer units to the mass of the copolymer is preferably 60 mass % to 99 mass %. Further, the polymer latex may contain acrylic acid and/or methacrylic acid in an amount of preferably 1 mass % to 6 mass %, more preferably 2 mass % to 5 mass %, based on the total mass of the styrene monomer units and butadiene monomer units. The polymer latex preferably contains acrylic acid. A preferred range of the molecular weight is the same as described above.

The latex of the styrene-butadiene copolymer preferably used in the invention may be, for example, any of P-3 to P-8 and P-15 described above, or a commercially available product such as LACSTAR-3307B or 7132C, or NIPOL LX416.

The organic silver salt containing layer (that is, image-forming layer) preferably includes a polymer latex. In the image-forming layer, the mass ratio of binder to organic silver salt is preferably in the range of 1/10 to 10/1, more preferably in the range of 1/3 to 5/1, furthermore preferably in the range of 1/1 to 3/1.

The layer containing the organic silver salt is generally the photosensitive layer (the image-forming layer) containing the photosensitive silver halide (the photosensitive silver salt). In this case, the mass ratio of binder to silver halide is preferably in the range of 400 to 5, more preferably in the range of 200 to 10.

In the invention, the total amount of the binder in the image-forming layer is preferably 0.2 to 30 g/m$^2$, more preferably 1 to 15 g/m$^2$, further preferably 2 to 10 g/m$^2$. In the image-forming layer of the invention, a crosslinker for closslinking and a surfactant for improvement of coatability may also be added.

Solvent for Preferred Coating Liquid

In the invention, the solvent of the coating liquid for the image-forming layer is preferably an aqueous solvent including 30 mass % or more of water. The term "solvent" used herein means a solvent or a dispersion medium. The aqueous solvent may include any water-miscible organic solvent such as methyl alcohol, ethyl alcohol, isopropyl alcohol, methyl cellosolve, ethyl cellosolve, dimethylformamide, and ethyl acetate. The water content of the solvent for the coating liquid is preferably 50 mass % or higher, more preferably 70 mass % or higher. Examples of preferred solvents include water, 90/10 mixture of water/methyl alcohol, 70/30 mixture of water/methyl alcohol, 80/15/5 mixture of water/methyl alcohol/dimethylformamide, 85/10/5 mixture of water/methyl alcohol/ethyl cellosolve, and 85/10/5 mixture of water/methyl alcohol/isopropyl alcohol, the numerals representing the mass ratios (mass %).

A hydrophilic polymer such as gelatin, polyvinyl alcohol, methylcellulose, hydroxypropylcellulose, and carboxymethylcellulose may be added to the image-forming layer of the photosensitive material of the invention if necessary. The amount of hydrophilic polymer is preferably 30 mass % or less, more preferably 20 mass % or less, based on the total amount of binder in the image-forming layer.

(Silver Halide)

1) Halogen Composition

The halogen composition of the photosensitive silver halide used in the invention is not particularly restricted, and may be silver chloride, silver chlorobromide, silver bromide, silver iodobromide, silver iodochlorobromide, or silver iodide. Among them, silver bromide, silver iodobromide, and silver iodide are preferable. In a grain of the photosensitive silver halide, the halogen composition may be uniform in the entire grain, or may vary stepwise or steplessly. In an embodiment, the photosensitive silver halide grain has a core-shell structure. The core-shell structure is preferably a 2- to 5-layered structure, more preferably a 2- to 4-layered structure. It is also preferable to employ techniques for localizing silver bromide or silver iodide on the surface of the grain of silver chloride, silver bromide, or silver chlorobromide.

2) Method of Forming Photosensitive Silver Halide Grain

Methods of forming the photosensitive silver halide grain are well known in the field. For example, the methods described in *Research Disclosure,* No. 17029, June 1978 (the disclosure of which is incorporated by reference) and U.S. Pat. No. 3,700,458 (the disclosure of which is incorporated by reference) may be used in the invention. In an embodiment, the photosensitive silver halide grains are prepared by: adding a silver source and a halogen source to a solution of gelatin or another polymer to form a photosensitive silver halide; and then mixing the silver halide with an organic silver salt. The methods disclosed in the following documents are also preferable: JP-A No. 11-119374, Paragraph 0217 to 0224, and JP-A Nos. 11-352627 and 2000-347335, the disclosures of which are incorporated by reference herein.

3) Grain Size

The grain size of the photosensitive silver halide grain is preferably small so as to suppress the clouding after image formation. Specifically, the grain size is preferably 0.20 μm or smaller, more preferably 0.01 μm to 0.15 μm, further preferably 0.02 μm to 0.12 μm. The grain size of the photosensitive silver halide grain is the average diameter of the circle having the same area as the projected area of the grain; in the case of tabular grain, the projected area refers to the projected area of the principal plane.

4) Shape of Photosensitive Silver Halide Grain

The photosensitive silver halide grain may be a cuboidal grain, an octahedral grain, a tabular grain, a spherical grain, a rod-shaped grain, a potato-like grain, etc. In the invention, the cuboidal grain is preferable. Silver halide grains with roundish corners are also preferable. The face index (Miller index) of the outer surface plane of the photosensitive silver halide grain is not particularly limited. In a preferable embodiment, the silver halide grains have a high proportion of {100} faces; a spectrally sensitizing dye adsorbed to the {100} faces exhibits a higher spectral sensitization efficiency. The proportion of the {100} faces is preferably 50% or higher, more preferably 65% or higher, further preferably 80% or higher. The proportion of the {100} faces according to the Miller indices can be determined by a method described in T. Tani, *J. Imaging Sci.,* 29, 165 (1985) (the disclosure of which is incorporated herein by reference) using adsorption dependency between {111} faces and {100} faces upon adsorption of a sensitizing dye.

5) Heavy Metal

The photosensitive silver halide grain used in the invention may include a metal selected from the metals of Groups 8 to 13 of the Periodic Table of Elements (having Groups 1 to 18) or a complex thereof. The metal is more preferably selected from metals of Groups 8 to 10 of the Periodic Table of Elements. When the photosensitive silver halide grain includes a metal selected from the metals of Groups 8 to 10 of the Periodic Table of Elements or a metal complex containing a metal selected from the metals of Groups 8 to 10 as the central metal, the metal or the central metal is preferably rhodium, ruthenium, iridium, or iron. The metal complex may be used singly or in combination with another complex containing the same or different metal. The amount of the metal or the metal complex is preferably $1\times10^{-9}$ mol to $1\times10^{-3}$ mol per 1 mol of silver. The heavy metals, the metal complexes, and methods of adding them are described, for example, in JP-A No. 7-225449, JP-A No. 11-65021, Paragraph 0018 to 0024, and JP-A No. 11-119374, Paragraph 0227 to 0240, the disclosures of which are incorporated by reference herein.

In the invention, the silver halide grain is preferably a silver halide grain having a hexacyano metal complex on its outer surface. Examples of the hexacyano metal complex include $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. The hexacyano metal complex is preferably a hexacyano Fe complex.

The counter cation of the hexacyano metal complex is not important because the hexacyano metal complex exists as an ion in an aqueous solution. The counter cation is preferably a cation which is highly miscible with water and suitable for an operation to precipitate the silver halide emulsion; examples thereof include: alkaline metal ions such as a sodium ion, a potassium ion, a rubidium ion, a cesium ion, and a lithium ion; and ammonium and alkylammonium ions such as a tetramethylammonium ion, a tetraethylammonium ion, a tetrapropylammonium ion, and a tetra-(n-butyl)-ammonium ion.

The hexacyano metal complex may be added in the form of a solution in water, or in a mixed solvent of water and a water-miscible organic solvent (e.g. an alcohol, an ether, a glycol, a ketone, an ester, an amide, etc.), or in a gelatin.

The amount of the hexacyano metal complex to be added is preferably $1\times10^{-5}$ mol to $1\times10^{-2}$ mol per 1 mol of silver, more preferably $1\times10^{-4}$ mol to $1\times10^{-3}$ mol per 1 mol of silver.

In order to allow the hexacyano metal complex to exist on the outer surface of the silver halide grains, the hexacyano metal complex may be added to the silver halide grains after the completion of the addition of an aqueous silver nitrate solution for grain formation but before the chemical sensitization (which may be chalcogen sensitization such as sulfur sensitization, selenium sensitization, or tellurium sensitization or may be noble metal sensitization such as gold sensitization). Specifically, the hexacyano metal complex may be directly added to the silver halide grains before the completion of the preparation step, in the water-washing step, in the dispersion step, or before the chemical sensitization step. It is preferable to add the hexacyano metal complex immediately after grain formation but before the comhpletion of the preparation step so as to prevent excess growth of the silver halide grains.

In an embodiment, the addition of the hexacyano metal complex is started after 96 mass % of the total amount of silver nitrate for the grain formation is added. In a preferable embodiment, the addition is started after 98 mass % of the total amount of silver nitrate is added. In a more preferable embodiment, the addition is started after 99 mass % of the total amount of silver nitrate is added.

When the hexacyano metal complex is added after the addition of the aqueous silver nitrate solution but immediately before the completion of the grain formation, the hexacyano metal complex is adsorbed onto the outer surface of the silver halide grain, and most of the adsorbed hexacyano metal complex forms a hardly-soluble salt with silver ion on the surface. The silver salt of hexacyano iron (II) is less soluble than AgI and thus preventing redissolution of the fine grains, whereby the silver halide grains with a smaller grain size can be produced.

The metal atoms and metal complexes such as $[Fe(CN)_6]^{4-}$ which may be added to the silver halide grains, and the desalination methods and the chemical sensitization methods for the silver halide emulsion are described in JP-A No. 11-84574, Paragraph 0046 to 0050, JP-A No. 11-65021, Paragraph 0025 to 0031, and JP-A No. 11-1 19374, Paragraph 0242 to 0250, the disclosures of which are incorporated herein by reference.

6) Gelatin

In the invention, the gelatin contained in the photosensitive silver halide emulsion may be selected from various gelatins. The gelatin has a molecular weight of preferably 10,000 to 1,000,000 so as to maintain excellent dispersion state of the photosensitive silver halide emulsion in the coating liquid including the organic silver salt. Substituents on the gelatin are preferably phthalated. The gelatin may be added during the grain formation or during the dispersing process after the desalting treatment, and is preferably added during the grain formation.

7) Sensitizing Dye

The sensitizing dye used in the invention is a sensitizing dye which can spectrally sensitize the silver halide grains when adsorbed by the grains, so that the sensitivity of the silver halide is heightened in the desired wavelength range. The sensitizing dye may be selected from sensitizing dyes having spectral sensitivities which are suitable for spectral characteristics of the exposure light source. The sensitizing dyes and methods of adding them are described, for example, in JP-A No. 11-65021, Paragraph 0103 to 0109; JP-A No. 10-186572 (the compounds represented by the formula (II)); JP-A No. 11-119374 (the dyes represented by the formula (I) and Paragraph 0106); U.S. Pat. No. 5,510, 236; U.S. Pat. No. 3,871,887 (the dyes described in Example 5); JP-A No. 2-96131; JP-A No. 59-48753 (the dyes disclosed therein); EP-A No. 0803764A1, Page 19, Line 38 to Page 20, Line 35; JP-A Nos. 2001-272747, 2001-290238, and 2002-23306, the disclosures of which are incorporated herein by reference. Only a single sensitizing dye may be used or two or more sensitizing dyes may be used. In an embodiment, the sensitizing dye is added to the silver halide emulsion after the desalination but before the coating. In a preferable embodiment, the sensitizing dye is added to the silver halide emulsion after the desalination but before the completion of the chemical ripening.

The amount of the sensitizing dye to be added may be selected in accordance with the sensitivity and the fogging properties, and is preferably $10^{-6}$ mol to 1 mol per 1 mol of the silver halide in the image-forming layer, more preferably $10^{-4}$ mol to $10^{-1}$ mol per 1 mol of the silver halide in the image-forming layer.

In the invention, a super-sensitizer may be used in order to increase the spectral sensitization efficiency. Examples of the super-sensitizer include compounds described in EP-A No. 587,338, U.S. Pat. Nos. 3,877,943 and 4,873,184, JP-A Nos. 5-341432, 11-109547, and 10-111543, the disclosures of which are incorporated herein by reference.

8) Chemical Sensitization

In a preferable embodiment, the photosensitive silver halide grains are chemically sensitized by methods selected from the sulfur sensitization method, the selenium sensitization method, and the tellurium sensitization method. Known compounds such as the compounds described in JP-A No. 7-128768 (the disclosure of which is incorporated herein by reference) may be used in the sulfur sensitization method, the selenium sensitization method, and the tellurium sensitization method. In the invention, the tellurium sensitization is preferred, and it is preferable to use a compound or compounds selected from the compounds described in JP-A No. 11-65021, Paragraph 0030 and compounds represented by the formula (II), (III), or (IV) described in JP-A No. 5-313284, the disclosures of which are incorporated by reference herein.

In a preferable embodiment, the photosensitive silver halide grains are chemically sensitized by the gold sensitization method, which may be conducted alone or in combination with the chalcogen sensitization. The gold sensitization method preferably uses a gold sensitizer having a gold atom with the valence of +1 or +3. The gold sensitizer is preferably a common gold compound. Typical examples of the gold sensitizer include chloroauric acid, bromoauric acid, potassium chloroaurate, potassium bromoaurate, auric trichloride, potassium auricthiocyanate, potassium iodoaurate, tetracyanoauric acid, ammonium aurothiocyanate, and pyridyltrichloro gold. Further, the gold sensitizers described in U.S. Pat. No. 5,858,637 and JP-A No. 2002-278016 (the disclosures of which are incorporated herein by reference) are also preferable in the invention.

In the invention, the chemical sensitization may be carried out at any time between grain formation and coating. The chemical sensitization may be carried out after desalination, for example, (1) before spectral sensitization, (2) during spectral sensitization, (3) after spectral sensitization, or (4) immediately before coating.

The amount of the sulfur, selenium, or tellurium sensitizer may be changed in accordance with the kind of the silver halide grains, the chemical ripening condition, and the like, and is generally $10^{-8}$ mol to $10^{-2}$ mol per 1 mol of silver halide, preferably $10^{-7}$ mol to $10^{-3}$ mol per 1 mol of silver halide.

The amount of the gold sensitizer to be added may be selected in accordance with the conditions, and is preferably $10^{-7}$ mol to $10^{-3}$ mol per 1 mol of silver halide, more preferably $10^{-6}$ mol to $5\times10^{-4}$ mol per 1 mol of silver halide.

The conditions for the chemical sensitization are not particularly restricted and are generally conditions in which pH is 5 to 8, pAg is 6 to 11, and temperature is 40 to 95° C.

A thiosulfonic acid compound may be added to the silver halide emulsion by a method described in EP-A No. 293, 917, the disclosure of which is incorporated by reference herein.

In the invention, the photosensitive silver halide grains may be subjected to reduction sensitization using a reduction sensitizer. The reduction sensitizer is preferably selected from ascorbic acid, aminoiminomethanesulfinic acid, stannous chloride, hydrazine derivatives, borane compounds, silane compounds, and polyamine compounds. The reduction sensitizer may be added at any time between crystal growth and coating in the preparation of the photosensitive emulsion. It is also preferable to ripen the emulsion while maintaining the pH value of the emulsion at 7 or higher and/or maintaining the pAg value at 8.3 or lower, so as to reduction-sensitize the photosensitive emulsion. Further, it is also preferable to conduct reduction sensitization by introducing a single addition part of a silver ion during grain formation.

9) Compound Whose One-Electron Oxidized Form Formed by One-Electron Oxidation can Release One or More Electron(s)

The photothermographic material of the invention preferably comprises a compound whose one-electron oxidized form formed by one-electron oxidation can release one or more electron(s). The compound may be used alone or in combination with the above-mentioned chemical sensitizers, thereby heightening the sensitivity of the silver halide.

The compound whose one-electron oxidized form formed by one-electron oxidation can release one or more electron(s) is the following compound of Type 1 or 2.

(Type 1) a compound whose one-electron oxidized form formed by one-electron oxidation can release one or more electron(s) through a subsequent bond cleavage reaction.

(Type 2) a compound whose one-electron oxidized form formed by one-electron oxidation can release one or more electron(s) after a subsequent bond formation.

The compound of Type 1 is described first.

Specific examples of the compound of Type 1 include compounds described as a one-photon two-electron sensitizer or a deprotonating electron donating sensitizer described in JP-A No. 9-211769 (Compounds PMT-1 to S-37 described in Tables E and F on Pages 28 to 32); JP-A No. 9-211774; JP-A No. 11-95355 (Compounds INV 1 to 36); Japanese Patent Application National Publication Laid-Open No. 2001-500996 (Compounds 1 to 74, 80 to 87, and 92 to 122); U.S. Pat. Nos. 5,747,235, and 5,747,236; EP Patent No. 786692A1 (Compounds INV 1 to 35); EP Patent No. 893732A1; U.S. Pat. Nos. 6,054,260, and 5,994,051; the disclosures of which are incorporated by reference herein. Preferred embodiments of the compounds are also described in the patent documents.

Further, examples of the compounds of Type 1 include compounds represented by the following formula (1) (equivalent to the formula (1) described in JP-A No. 2003-114487); compounds represented by the following formula (2) (equivalent to the formula (2) described in JP-A No. 2003-114487); compounds represented by the following formula (3) (equivalent to the formula (1) described in JP-A No. 2003-114488); compounds represented by the following formula (4) (equivalent to the formula (2) described in JP-A No. 2003-114488); compounds represented by the following formula (5) (equivalent to the formula (3) described in JP-A No. 2003-114488); compounds represented by the following formula (6) (equivalent to the formula (1) described in JP-A No. 2003-75950); compounds represented by the following formula (7) (equivalent to the formula (2) described in JP-A No. 2003-75950); compounds represented by the following formula (8) (equivalent to the formula (1) described in JP-A No. 2004-239943); and compounds represented by the following formula (9) (equivalent to the formula (3) described in JP-A No. 2004-245929) which can undergo a reaction represented by the following chemical reaction formula (1) (equivalent to the chemical reaction formula (1) described in JP-A No. 2004-245929). The disclosures of the above patent documents are incorporated by reference herein. Preferred embodiments of the compounds are described in the patent documents.

In the formulae (1) and (2), $RED_1$ and $RED_2$ each independently represent a reducing group. $R_1$ represents a non-metallic atomic group which, together with the carbon atom C and $RED_1$, forms a ring structure corresponding to a tetrahydro- or octahydro-derivative of a 5- or 6-membered aromatic ring (such as an aromatic heterocycle). $R_2$, $R_3$, and $R_4$ each independently represent a hydrogen atom or a substituent. $Lv_1$ and $Lv_2$ each independently represent a leaving group. ED represents an electron-donating group.

Formula (1)

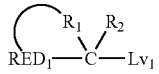

Formula (2)

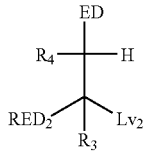

Formula (3)

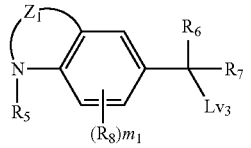

Formula (4)

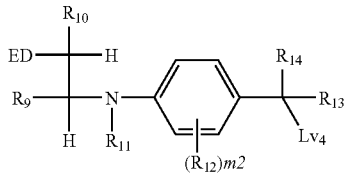

Formula (5)

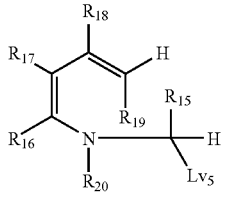

In formulae (3) to (5), $Z_1$ represents an atomic group which, together with the nitrogen atom and two carbon atoms in the benzene ring, can form a 6-membered ring. $R_5$ to $R_7$, $R_9$ to $R_{11}$, and $R_{13}$ to $R_{19}$ each independently represent a hydrogen atom or a substituent. $R_{20}$ represents a hydrogen atom or a substituent. When $R_{20}$ represents a group other than an aryl group, $R_{16}$ and $R_{17}$ are bonded to each other to form an aromatic ring or an aromatic heterocycle. $R_8$ and $R_{12}$ each independently represent a substituent which can be bonded to the benzene ring, m1 represents an integer of 0 to 3, m2 represents an integer of 0 to 4. $Lv_3$, $Lv_4$, and $LV_5$ each independently represent a leaving group.

Formula (6)

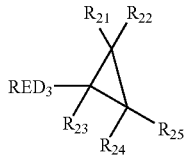

-continued

Formula (7)

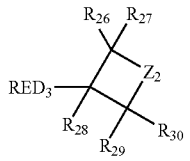

In the formulae (6) and (7), $RED_3$ and $RED_4$ each indepenently represent a reducing group. $R_{21}$ to $R_{30}$ each independently represent a hydrogen atom or a substituent. $Z_2$ represents —$CR_{111}R_{112}$—, —$NR_{113}$—, or —O—. $R_{111}$ and $R_{112}$ each independently represent a hydrogen atom or a substituent. $R_{113}$ represents a hydrogen atom, an alkyl group, an aryl group, or a heterocyclic group.

Formula (8)

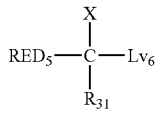

In formula (8), RED5 represents a reducing group which is selected from an arylamino group or a heterocyclylamino group. $R_{31}$ represents a hydrogen atom or a substituent. X represents an alkoxy group, an aryloxy group, a heterocyclyloxy group, an alkylthio group, an arylthio group, a heterocyclylthio group, an alkylamino group, an arylamino group, or a heterocyclylamino group. $Lv_6$ represents a leaving group which is selected from a carboxyl group or a salt of a carboxyl group, or a hydrogen atom.

Chemical Reaction Formula (1)

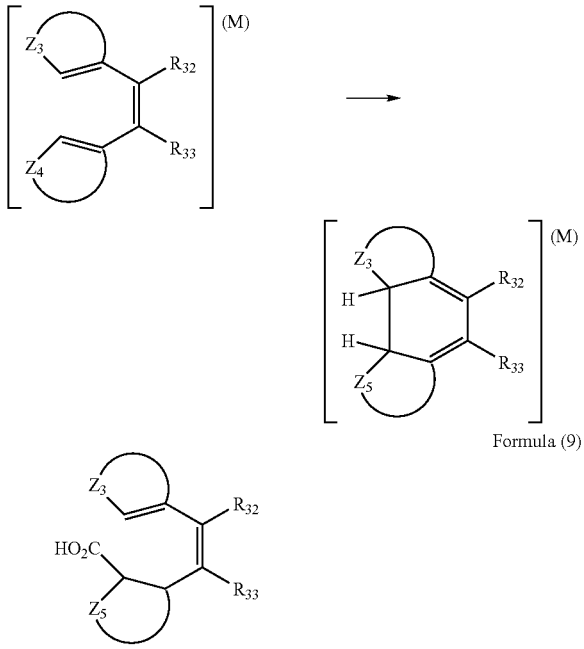

Formula (9)

The compound represented by formula (9) is a compound which undergoes the bond-formation reaction represented by the chemical reaction formula (1) when oxidized after two-electron oxidation accompanied by decarboxylation. In the chemical formula (1), $R_{32}$ and $R_{33}$ each independently represent a hydrogen atom or a substituent. $Z_3$ represents a group which, together with the C═C group, forms a 5-membered or 6-membered heterocycle. $Z_4$ represents a group which, together with the C═C group, forms a 5- or 6-membered, aryl or heterocyclic group. M represents a radical, a radical cation, or a cation. In formula (9), the definitions of $R_{32}$, $R_{33}$, and $Z_3$ are the same as the definitions of $R_{32}$, $R_{33}$, and $Z_3$ in the chemical formula (1). $Z_5$ represents a group which, together with the C—C group, forms a 5-membered or 6-membered cyclic aliphatic hydrocarbon group or heterocyclic group.

The compound of Type 2 is described next.

Examples of the compounds of Type 2 include compounds represented by the following formula (10) (equivalent to the formula (1) described in JP-A No. 2003-140287), and compounds represented by the following formula (11) (equivalent to the formula (2) described in JP-A No. 2004-245929) which can undergo a reaction represented by the following chemical reaction formula (1) (equivalent to the chemical reaction formula (1) described in JP-A No. 2004-245929). Preferred embodiments of the compounds are described in the patent documents.

$RED_6$-Q-Y Formula (10)

In the formulae (10), $RED_6$ represents a reducing group that can be one-electron-oxidized. Y represents a reactive group which includes a carbon-carbon double bond, a carbon-carbon triple bond, an aromatic group, or a benzo-condensed, nonaromatic heterocyclic group, and which can react with the one-electron-oxidized group derived from X to form a new bond. Q represents a linking group that connects $RED_6$ and Y.

Chemical Reaction Formula (1)

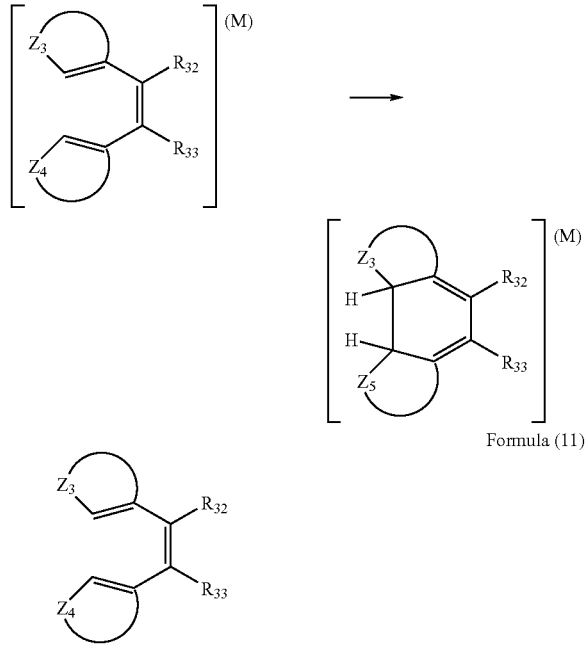

Formula (11)

The compound represented by formula ( 11) is a compound which undergoes a bond-formation reaction represented by chemical reaction formula (1) when oxidized. In the chemical reaction formula (1), $R_{32}$ and $R_{33}$ each independently represent a hydrogen atom or a substituent. $Z_3$ represents a group which, together with the C═C group, forms a 5- or 6-membered heterocycle. $Z_4$ represents a group which, together with the C═C group, forms a 5- or 6-membered, aryl or heterocyclic group. $Z_5$ represents a group which, together with the C—C group, forms a 5- or 6-membered cyclic aliphatic hydrocarbon group or heterocyclic group. M represents a radical, a radical cation, or a cation. In formula (11), the definitions of $R_{32}$, $R_{33}$, $Z_3$, and $Z_4$ are the same as in chemical reaction formula (1).

The compound of Type 1 or 2 preferably has a group which can adsorb silver halide, or a spectrally sensitizing dye moiety. Typical examples of the group which can adsorb silver halide include groups described in JP-A No. 2003-156823, Page 16, Right column, Line 1 to Page 17, Right column, Line 12, disclosure of which is incorporated by reference herein. The spectrally sensitizing dye moiety has a structure described in JP-A No. 2003-156823, Page 17, Right column, Line 34 to Page 18, Left column, Line 6, disclosure of which is incorporated by reference herein.

The compound of Type 1 or 2 is more preferably a compound having a group which can adsorb silver halide, and furthermore preferably has a compound having two or more groups which can adsorb silver halide. When the compound has two or more groups which can adsorb silver halide, the groups may be the same as each other or different from each other.

Preferable examples of the group which can adsorb silver halide include mercapto-substituted, nitrogen-including, heterocyclic groups (e.g., a 2-mercaptothiadiazole group, a 3-mercapto-1,2,4-triazole group, a 5-mercaptotetrazole group, a 2-mercapto-1,3,4-oxadiazole group, a 2-mercaptobenzoxazole group, a 2-mercaptobenzthiazole group, a 1,5-dimethyl-1,2,4-triazolium-3-thiolate group, etc.), and nitrogen-including heterocyclic groups each having an —NH— group capable of forming a silver imide (>NAg) as a moiety of the heterocycle (e.g., a benzotriazole group, a benzimidazole group, an indazole group, etc.) Particularly preferred among them are a 5-mercaptotetrazole group, a 3-mercapto-1,2,4-triazole group, and a benzotriazole group, and most preferred are a 3-mercapto-1,2,4-triazole group and a 5-mercaptotetrazole group.

In a preferable embodiment, the compound of Type 1 or 2 is a compound having a group which can adsorb silver halide, the group having two or more mercapto groups. Each mercapto group (—SH) may be converted to a thione group when it can be tautomerized. The group which can adsorb silver halide and has two or more mercapto groups may be a dimercapto-substituted, nitrogen-including, heterocyclic group, etc., and preferred examples thereof include a 2,4-dimercaptopyrimidine group, a 2,4-dimercaptotriazine group, and a 3,5-dimercapto-1,2,4-triazole group.

The group which can adsorb silver may be a quaternary salt group of nitrogen or phosphorus. Specifically, the quaternary nitrogen salt group may comprise: an ammonio group such as a trialkylammonio group, a dialkyl-aryl (or heteroaryl)-ammonio group or an alkyl-diaryl (or diheteroaryl)-ammonio group; or a heterocyclic group containing a quaternary nitrogen. The quaternary phosphorus salt group may comprise a phosphonio group such as a trialkylphosphonio group, a dialkyl-aryl (or heteroaryl)-phosphonio group, an alkyl-diaryl (or diheteroaryl)-phosphonio group, or a triaryl (or triheteroaryl)-phosphonio group. The quaternary salt group is more preferably a quaternary nitrogen salt group, further preferably an aromatic, quaternary-nitrogen-containing, heterocyclic group having a 5- or 6-membered ring structure, particularly preferably a pyridinio group, a quinolinio group, or a isoquinolinio group. The quaternary-nitrogen-containing heterocyclic groups may have a substituent.

Examples of the counter anion of the quaternary salt group include halogen ions, a carboxylate ion, a sulfonate ion, a sulfate ion, a perchlorate ion, a carbonate ion, a nitrate ion, $BF_4^-$, $PF_6^-$, and $Ph4B^-$. When the compound has a group with a negative charge such as a carboxylate group, the quaternary salt may be formed within the molecule. Examples of preferred counter anions other than the internal anions include a chlorine ion, a bromine ion, and a methanesulfonate ion.

When the compound of Type 1 or 2 has a quaternary nitrogen or phosphorus salt group as the group which can adsorb silver halide, the compound is preferably a compound represented by the following formula (X):

$$(P\text{-}Q1\text{-})_i\text{-}R(\text{-}Q2\text{-}S)_j. \qquad \text{Formula (X)}$$

In the formula (X), P and R each independently represent a quaternary nitrogen or phosphorus salt group which is not the sensitizing dye moiety. Q1 and Q2 each independently represent a linking group which may be selected from a single bond, an alkylene group, an arylene group, a heterocyclic group, —O—, —S—, —NRN—, —C(═O)—, —$SO_2$—, —SO—, —P(═O)—, or a combination of groups selected from the above groups. $R_N$ represents a hydrogen atom, an alkyl group, an aryl group, or a heterocyclic group. S represents a residue obtained by removing an atom from a compound of Type 1 or 2. i and j each independently represent an integer of 1 or larger, the sum of i and j being 2 to 6. In an embodiment, i represents 1 to 3 and j represents 1 to 2. In a preferable embodiment, i represents 1 or 2 and j represents 1. In a more preferable embodiment, i represents 1 and j represents 1. The compound represented by the formula (X) preferably has 10 to 100 carbon atoms. The carbon number of the compound is more preferably 10 to 70, further preferably 11 to 60, particularly preferably 12 to 50.

The compound of Type 1 or 2 may be added at any time in the preparation of the photothermographic material, for example, in the preparation of the photosensitive silver halide emulsion. For example, the compound may be added during the formation of the photosensitive silver halide grains, during the desalination, during the chemical sensitization, or before coating. The compound may be added two or more times. The compound may be added, preferably after the completion of the photosensitive silver halide grain formation but before desalination; or during the chemical sensitization Oust before the chemical sensitization to immediately after the chemical sensitization); or before coating. The compound may be added, more preferably during the period from the chemical sensitization to just before the mixing of the silver halide with the non-photosensitive organic silver salt.

The compound of Type 1 or 2 may be added preferably after dissolved in water, a water-soluble solvent such as methanol or ethanol, or a mixed solvent thereof. When the compound whose solubitity in water varies depending on pH is dissolved in water, the pH value of the solution may be appropriately adjusted so as to dissolve the compound well, before added to the silver halide.

It is preferable to incorporate the compound of Type 1 or 2 into the image-forming layer comprising the photosensitive silver halide and the non-photosensitive organic silver salt. It is also preferable to incorporate the compound of Type 1 or 2 into a protective layer, an intermediate layer, etc. as well as the image-forming layer, so that the compound diffluses during the coating. The compound may be added after or before or simultaneously with the addition of the sensitizing dye. In the silver halide emulsion layer (the image-forming layer), the amount of the compound is preferably $1\times10^{-9}$ mol to $5\times10^{-1}$ mol per 1 mol of silver halide, more preferably $1\times10^{-8}$ mol to $5\times10^{-2}$ mol, per 1 mol of silver halide.

10) Adsorbent Redox Compound having Adsorbent Group and Reducing Group

The photothermographic material of the invention preferably includes an adsorbent redox compound having a reducing group and an adsorbent group which can adsorb silver halide. The adsorbent redox compound is preferably a compound represented by the following formula (I):

A-(W)n-B. Formula (I)

In the formula (I), A represents a group which can adsorb silver halide (hereinafter referred to as an adsorbent group), W represents a divalent linking group, n represents 0 or 1, B represents a reducing group.

In the formula (I), the adsorbent group represented by A is a group which can directly adsorb silver halide, or a group which fascilitates the adsorption of silver halide. Specifically, the adsorbent groups may be a mercapto group or a salt thereof; a thione group comprising —C(═S)—; a heterocyclic group including at least one atom selected from the group consisting of nitrogen atoms, sulfur atoms, selenium atoms, and tellurium atoms; a sulfide group; a disulfide group; a cationic group; or an ethynyl group.

The mercapto groups (or a salt thereof) used as the adsorbent group may be a mercapto group itself (or a salt thereof), and is more preferably a heterocyclic group, an aryl group, or an alkyl group, each of which has at least one mercapto group (or salt thereof). The heterocyclic group may be a 5- to 7-membered, aromatic or nonaromatic, heterocyclic group having a monocyclic or condensed ring structure, and examples thereof include imidazole ring groups, thiazole ring groups, oxazole ring groups, benzoimidazole ring groups, benzothiazole ring groups, benzoxazole ring groups, triazole ring groups, thiadiazole ring groups, oxadiazole ring groups, tetrazole ring groups, purine ring groups, pyridine ring groups, quinoline ring groups, isoquinoline ring groups, pyrimidine ring groups, and triazine ring groups. The heterocyclic group may include a quaternary nitrogen atom, and in this case, the mercapto group as the substituent may be dissociated to form a meso-ion. When the mercapto group forms a salt, the counter ion thereof may be: a cation of an alkaline metal, an alkaline earth metal, a heavy metal, etc. such as $Li^+$, $Na^+$, $K^+$, $Mg^{2+}$, $Ag^+$and $Zn^{2+}$; an ammonium ion; a heterocyclic group including a quaternary nitrogen atom; or a phosphonium ion.

The mercapto group as the adsorbent group may be tautomerized into a thione group.

The thione group as the adsorbent group may be, for example, a linear or cyclic, thioamide or thioureide or thiourethane or dithiocarbamic acid ester group.

The heterocyclic group including at least one atom selected from the group consisting of nitrogen atoms, sulfur atoms, selenium atoms, and tellurium atoms, used as the adsorbent group, is a nitrogen-containing heterocyclic group having —NH— capable of forming a silver imide (>NAg) as a moiety of the heterocycle, or a heterocyclic group having, as a moiety of the heterocycle, —S—, —Se—, —Te—, or ═N— capable of forming a coordinate bond with a silver ion. Examples of the former include benzotriazole groups, triazole groups, indazole groups, pyrazole groups, tetrazole groups, benzoimidazole groups, imidazole groups, and purine groups. Examples of the latter include thiophene groups, thiazole groups, oxazole groups, benzothiophene groups, benzothiazole groups, benzoxazole groups, thiadiazole groups, oxadiazole groups, triazine groups, selenazole groups, benzoselenazole groups, tellurazole groups, and benzotellurazole groups.

The sulfide group and the disulfide group used as the adsorbent group may be any group having an —S— or —S—S— moiety.

The cationic group used as the adsorbent group is a group including a quaternary nitrogen atom, and may be a group having a nitrogen-including heterocyclic group containing an ammonio group or a quaternary nitrogen atom. Examples of the quatemary-nitrogen-containing heterocyclic group include pyridinio groups, quinolinio groups, isoquinolinio groups, and imidazoho groups.

The ethynyl group used as the adsorbent group is a —C≡CH group, in which the hydrogen atom may be replaced by a substituent.

The above-described adsorbent groups may have any substituents.

Specific examples of the adsorbent group further include those described in JP-A No. 11-95355, Page 4 to 7, the disclosure of which is incorporated herein by reference.

In the formula (I), the adsorbent group represented by A is preferably a mercapto-substituted heterocyclic group (e.g. a 2-mercaptothiadiazole group, a 2-mercapto-5-aminothiadiazole group, a 3-mercapto-1 ,2,4-triazole group, a 5-mercaptotetrazole group, a 2-mercapto-1,3,4-oxadiazole group, a 2-mercaptobenzimidazole group, a 1,5-dimethyl-1,2,4-triazolium-3-thiolate group, a 2,4-dimercaptopyrimidine group, a 2,4-dimercaptotriazine group, a 3,5-dimercapto-1,2,4-triazole group, 2,5-dimercapto-1,3-thiazole group, etc.) or a nitrogen-including heterocyclic group having —NH— capable of forming a silver imide (>NAg) in the heterocycle (e.g. a benzotriazole group, a benzimidazole group, an indazole group, etc.), more preferably a 2-mercaptobenzimidazole group or a 3,5-dimercapto-1,2,4-triazole group.

In the formula (I), W represents a divalent linking group. The linking group is not particularly limited as long as the linking group causes no adverse effects on the photographic properties. For example, the divalent linking group may be composed of an atom or atoms selected from carbon atoms, hydrogen atoms, oxygen atoms, nitrogen atoms, and sulfur atoms. Specific examples of the divalent linking group include: alkylene groups each having 1 to 20 carbon atoms such as a methylene group, an ethylene group, a trimethylene group, a tetramethylene group, and a hexamethylene group; alkenylene groups each having 2 to 20 carbon atoms; alkynylene groups each having 2 to 20 carbon atoms; arylene groups each having 6 to 20 carbon atoms such as a phenylene group and a naphthylene group; —CO—; —$SO_2$—; —O—; —S—; —NR1-; and combinations thereof. R1 represents a hydrogen atom, an alkyl group, a heterocyclic group, or an aryl group.

The linking group represented by W may have any substituent(s).

In the formula (I), the reducing group represented by B is a group capable of reducing a silver ion, and examples thereof include a formyl group, an amino group, triple bond groups such as an acetylene group and a propargyl group, a mercapto group, and residues obtained by removing one hydrogen atom from each of the following compounds: hydroxylamine compounds, hydroxamic acid compounds, hydroxyurea compounds, hydroxyurethane compounds, hydroxysemicarbazide compounds, reductone compounds (including reductone derivatives), aniline compounds, phenol compounds (including chroman-6-ol compounds, 2,3-dihydrobenzofuran-5-ol compounds, aminophenol compounds, sulfonamidephenol compounds, and polyphenol compounds such as hydroquinone compounds, catechol compounds, resorcinol compounds, benzenetriol compounds, and bisphenol compounds), acylhydrazine compounds, carbamoylhydrazine compounds, and 3-pyrazolidone compounds. The above reducing groups may have any substituent(s).

The oxidation potential of the reducing group represented by B in the formula (I) can be measured by a method described in Akira Fujishima, *Denki Kagaku Sokutei-ho,* Page 150–208, Gihodo Shuppan Co., Ltd., or The Chemical Society of Japan, *Jikken Kagaku Koza, 4th edition,* Vol. 9, Page 282–344, Maruzen, the disclosures of which are incorporated by reference herein. For example, the oxidation potential may be determined by a rotating disk voltammetry technique; specifically, in the technique, a sample is dissolved in a 10/90 (volume %) solvent of methanol/pH 6.5 Britton-Robinson buffer, and then the solution is subjected to bubbling with nitrogen gas for 10 minutes, and then the electric potential of the solution is measured at 25° C. at 1,000 round/minute at the sweep rate of 20 mV/second using a glassy carbon rotating disk electrode (RDE) as a working electrode, a platinum wire as a counter electrode, and a saturated calomel electrode as a reference electrode, thereby obtaining a voltammogram. The half wave potential (E½) can be obtained from the voltammogram.

The reducing group represented by B has an oxidation potential of preferably about −0.3 to about 1.0 V when measured by the above method. The oxidation potential is more preferably about −0.1 to about 0.8 V, particularly preferably about 0 to about 0.7 V.

The reducing group represented by B is preferably a residue provided by removing one hydrogen atom from a hydroxylamine compound, a hydroxamic acid compound, a hydroxyurea compound, a hydroxysemicarbazide compound, a reductone compound, a phenol compound, an acylhydrazine compound, a carbamoylhydrazine compound, or a 3-pyrazolidone compound.

The compound of the formula (I) may have a ballast group or a polymer chain each of which is commonly used in an immobile photographic additive such as a coupler. The polymer chain may be selected from the polymer chains described in JP-A No. 1-100530, the disclosure of which is incorporated by reference herein.

The compound of the formula (I) may be in the form of a dimer or a trimer. The molecular weight of the compound of the formula (I) is preferably 100 to 10,000, more preferably 120 to 1,000, particularly preferably 150 to 500.

Examples of the compound represented by the formula (I) are illustrated below without intention of restricting the scope of the invention.

(1)

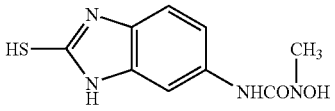

(2)

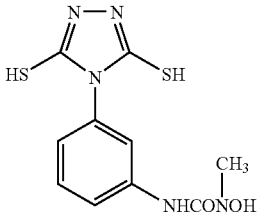

-continued (3)

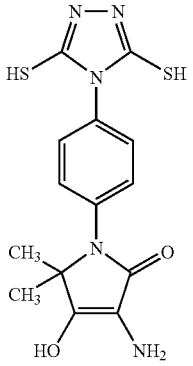

(4)

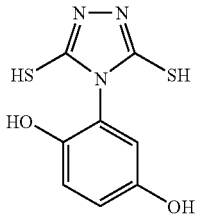

(5)

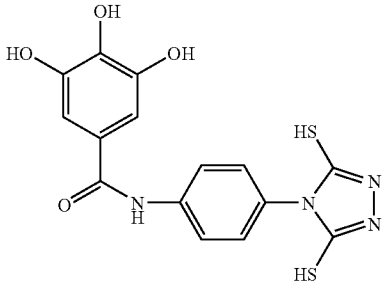

(6)

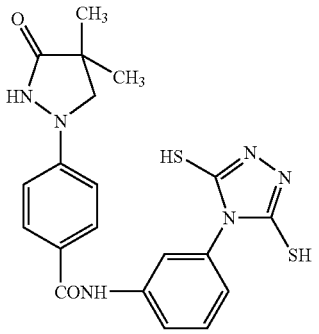

(7)

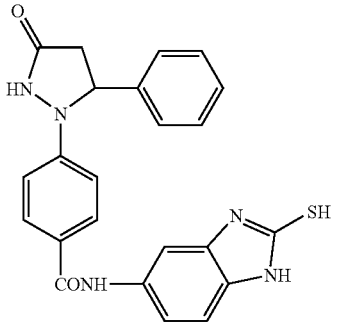

-continued (8)

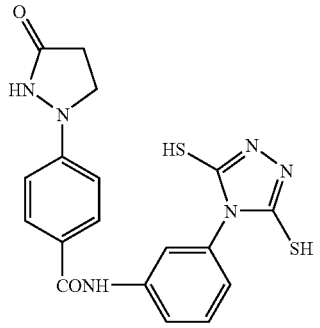

(9)

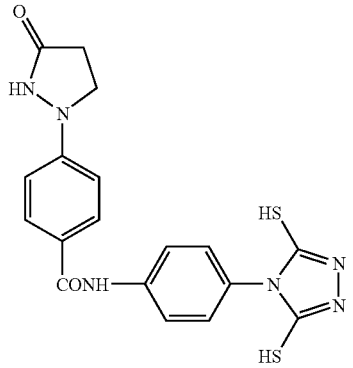

(10)

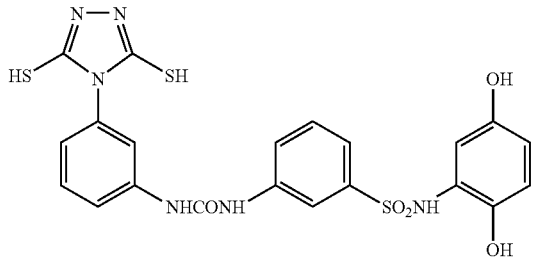

(11)

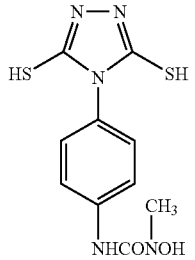

(12)

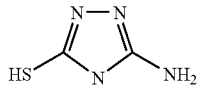

(13)

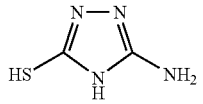

Further, Compounds 1 to 30 and 1"-1 to 1"-77 described in EP Patent No. 1308776A2, Page 73 to 87 (the disclosure of which is incorporated herein by reference) may be preferably used as the compound having the adsorbent group and the reducing group.

These compounds can be easily synthesized by a known method. Only a single kind of a compound of the formula (I) may be used, or two or more kinds of compounds of the formula (I) may be used in combination. When two or more compounds of the formula (I) are used, they may be included in the same layer or in respectively different layers, and may be added by respectively different methods.

The compound of the formula (I) is preferably included in the silver halide image-forming layer. It is preferable to add the compound of the formula (I) during the preparation of the silver halide emulsion. The compound may be added at any time in the preparation of the emulsion. For example, the compound may be added (i) during the silver halide grain formation, (ii) before the desalination, (iii) during the desalination, (iv) before the chemical ripening, (v) during the chemical ripening, (vi) before the finishing. The compound may be added two or more times. The compound may be used preferably in the image-forming layer. In an embodiment, the compound is added to a protective layer, an intermediate layer, etc. as well as the image-forming layer, so that the compound diffuses during coating.

The preferred amount of the compound to be added depends largely on the adding method and the type of the compound. The amount of the compound is generally $1\times10^{-6}$ mol to 1 mol per 1 mol of the photosensitive silver halide, preferably $1\times10^{-5}$ mol to $5\times10^{-1}$ per 1 mol of the photosensitive silver halide, more preferably $1\times10^{-4}$ mol to $1\times10^{-1}$ mol per 1 mol of the photosensitive silver halide.

The compound of the formula (I) may be added in the form of a solution in water, a water-soluble solvent such as methanol or ethanol, or a mixed solvent obtained by mixing some of the above solvents. The pH value of the solution may be appropriately adjusted by an acid or a base. A surfactant may be added to the solution. Further, the compound may be added in the form of an emulsion in an organic high boiling point solvent, or in the form of a solid dispersion.

11) Combination of Silver Halides

In an embodiment, only one kind of photosensitive silver halide emulsion is used in the photothermographic material of the invention. In another embodiment, two or more kinds of photosensitive silver halide emulsions are used in the photothermographic material; the photosensitive silver halide emulsions may be different from each other in characteristics such as average grain size, halogen composition, crystal habit, and chemical sensitization condition. The image gradation can be adjusted by using two or more kinds of photosensitive silver halide emulsions having different sensitivities. The related techniques are described, for example in JP-A Nos. 57-119341, 53-106125, 47-3929, 48-55730, 46-5187, 50-73627, and 57-150841, the disclosures of which are incorporated herein by reference. The difference in sensitivity between the emulsions is preferably 0.2 log E or larger.

12) Application Amount

The amount of the photosensitive silver halide to be applied is, in terms of the applied silver amount per 1 $m^2$ of photothermographic material, preferably 0.03 to 0.6 $g/m^2$, more preferably 0.05 to 0.4 $g/m^2$, still more preferably 0.07 to 0.3 $g/m^2$. Further, the amount of the photosensitive silver halide per 1 mol of the organic silver salt is preferably 0.01 to 0.5 mol, more preferably 0.02 to 0.3 mol, further preferably 0.03 to 0.2 mol.

13) Mixing of Photosensitive Silver Halide and Organic Silver Salt

The methods and conditions of mixing the photosensitive silver halide and the organic silver salt, which are separately prepared, are not particularly restricted as long as the advantageous effects of the invention can be sufficiently obtained. In an embodiment, the silver halide and the organic silver salt are separately prepared and then mixed by a high-speed stirrer, a ball mill, a sand mill, a colloid mill, a vibrating mill, a homogenizer, etc. In another embodiment, the prepared photosensitive silver halide is added to the organic silver salt during the preparation of the organic silver salt, and the preparation of the organic silver salt is then completed. It is preferable to mix two or more aqueous organic silver salt dispersion liquids and two or more aqueous photosensitive silver salt dispersion liquids so as to adjust the photographic properties.

14) Addition of Silver Halide to Coating Liquid

The silver halide is added to the coating liquid for the image-forming layer preferably between 180 minutes before coating and immediately before coating, more preferably between 60 minutes before coating and 10 seconds before coating. There are no particular restrictions on the methods and conditions of the coating as long as the advantageous effects of the invention can be sufficiently obtained. In an embodiment, the silver halide is mixed with the coating liquid in a tank while controlling the addition flow rate and the feeding amount to the coater, such that the average retention time calculated from the addition flow rate and the feeding amount to the coater is the desired time. In another embodiment, the silver halide is mixed with the coating liquid by a method using a static mixer described, for example, in N. Hamby, M. F. Edwards, and A. W. Nienow, translated by Koji Takahashi, *Ekitai Kongo Gijutsu,* Chapter 8 (Nikkan Kogyo Shimbun, Ltd., 1989), the disclosure of which is incorporated herein by reference.

(Antifoggant)

Examples of antifoggants, stabilizers, and stabilizer precursors usable in the invention include compounds disclosed in JP-A No. 10-62899, Paragraph 0070 and EP-A No. 0803764A1, Page 20, Line 57 to Page 21, Line 7; compounds described in JP-A Nos. 9-281637 and 9-329864; and compounds described in U.S. Pat. No. 6,083,681 and EP Patent No. 1048975. The disclosures of the above patent documents are incorporated herein by reference.

(1) Organic Polyhalogen Compound

Organic polyhalogen compounds, which can be preferably used as the antifoggant in the invention, are described in detail below. The antifoggant is preferably an organic polyhalogen compound represented by the following formula (H):

$$Q\text{-}(Y)_n\text{—}C(Z1)(Z2)X. \qquad \text{Formula (H)}$$

In the formula (H), Q represents an alkyl group, an aryl group, or a heterocyclic group, Y represents a divalent linking group, n represents 0 to 1, Z1 and Z2 each independently represent a halogen atom, and X represents a hydrogen atom or an electron-withdrawing group.

In the formula (H), Q represents preferably an alkyl group having 1 to 6 carbon atoms, an aryl group having 6 to 12 carbon atoms, or a heterocyclic group including at least one nitrogen atom such as a pyridyl group and a quinolyl group.

When Q represents an aryl group, the aryl group is preferably a phenyl group substituted by an electron-withdrawing group with a positive Hammett's substituent constant up. The Hammett's substituent constant is described, for example, in *Journal of Medicinal Chemistry,* 1973, Vol. 16, No. 11, 1207–1216, the disclosure of which is incorporated herein by reference. Examples of such an electron-withdrawing group include halogen atoms, alkyl groups having substituents of electron-withdrawing groups, aryl groups substituted by electron-withdrawing groups, heterocyclic groups, alkyl sulfonyl groups, aryl sulfonyl groups, acyl groups, alkoxycarbonyl groups, carbamoyl groups, and sulfamoyl groups. The electron-withdrawing group is preferably a halogen atom, a carbamoyl group, or an arylsulfonyl group, particularly preferably a carbamoyl group.

In a preferable embodiment, X represents an electron-withdrawing group. The electron-withdrawing group is preferably a halogen atom, an (aliphatic, aryl, or heterocyclyl) sulfonyl group, an (aliphatic, aryl, or heterocyclyl) acyl group, an (aliphatic, aryl, or heterocyclyl) oxycarbonyl group, a carbamoyl group, or a sulfamoyl group, more preferably a halogen atom or a carbamoyl group, particularly preferably a bromine atom.

Z1 and Z2 each independently represent preferably a bromine atom or an iodine atom, more preferably a bromine atom.

Y represent preferably —C(=O)—, —SO—, —$SO_2$—, —C(=O)N(R)—, or —$SO_2$N(R)—, more preferably —C(=O)—, —$SO_2$—, or —C(=O)N(R)—, particularly preferably —$SO_2$— or —C(=O)N(R)—, in which R represents a hydrogen atom, an aryl group, or an alkyl group, preferably a hydrogen atom or an alkyl group, particularly preferably a hydrogen atom.

In the formula (H), n represents 0 or 1, preferably 1.

In the formula (H), Y represents preferably —C(=O)N(R)— when Q represents an alkyl group, and Y represents preferably —$SO_2$— when Q represents an aryl group or a heterocyclic group.

In an embodiment, the antifoggant is a compound including two or more units represented by the formula (H), wherein each unit is bound to another unit, and a hydrogen atom in the formula (H) is substituted with the bond in each unit. Such a compound is referred to as a bis-, tris-, or tetrakis-type compound.

The compound represented by (H) is preferably substituted by a dissociative group (such as a COOH group, a salt of a COOH group, an $SO_3H$ group, a salt of an $SO_3H$ group, a $PO_3H$ group, or a salt of a $PO_3H$ group); a group containing a quaternary nitrogen cation, such as an ammonium group or a pyridinium group; a polyethyleneoxy group; a hydroxyl group; or the like.

Specific examples of the compounds represented by the formula (H) are shown below.

H-1

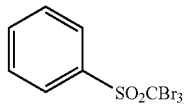

H-2

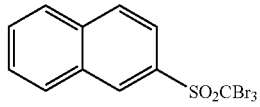

H-3

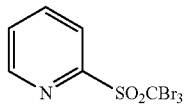

H-4

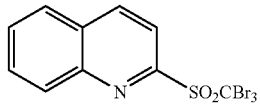

-continued

H-5

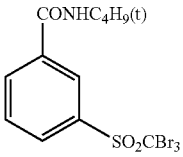

H-6

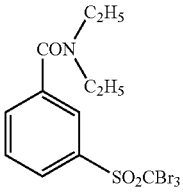

H-7

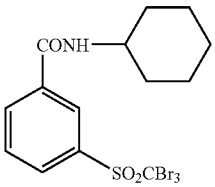

H-8

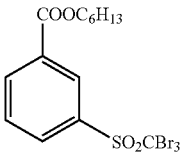

H-9

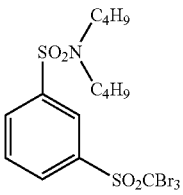

H-10

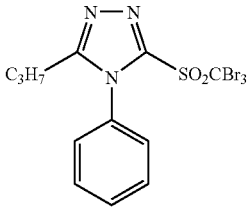

H-11

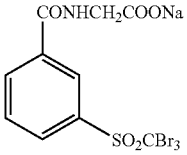

H-12

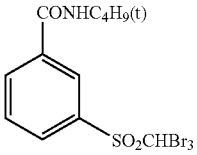

-continued

H-13

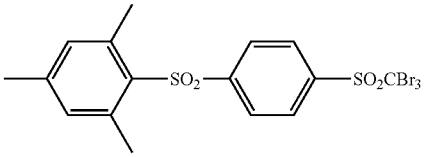

H-14

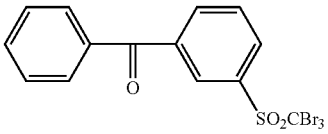

H-15

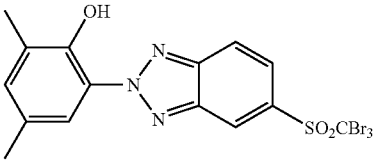

H-16

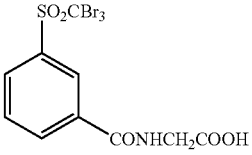

H-17

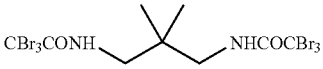

H-18

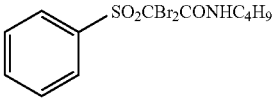

H-19

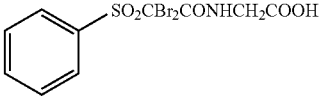

Examples of polyhalogen compounds usable in the invention include, in addition to the above compounds, compounds described in U.S. Pat. Nos. 3,874,946, 4,756,999, 5,340,712, 5,369,000, 5,464,737, and 6,506,548, and JP-A Nos. 50-137126, 50-89020, 50-119624, 59-57234, 7-2781, 7-5621, 9-160164, 9-244177, 9-244178, 9-160167, 9-319022, 9-258367, 9-265150, 9-319022, 10-197988, 10-197989, 11-242304, 2000-2963, 2000-112070, 2000-284410, 2000-284412, 2001-33911, 2001-31644, 2001-312027, and 2003-50441, the disclosures of which are incorporated herein by reference. The compounds described in JP-A Nos. 7-2781, 2001-33911, and 2001-312027 are particularly preferred.

The amount of the polyhalogen compound is preferably $10^{-4}$ mol to 1 mol, more preferably $10^{-3}$ mol to 0.5 mol, further preferably mol $10^{-2}$ to 0.2 mol, per 1 mol of the non-photosensitive silver salt.

The antifoggant may be added to the photosensitive material in any of the manners described above as examples of the method of adding the reducing agent. The organic polyhalogen compound is preferably added in the state of a solid particle dispersion.

(2) Other Antifoggants

Examples of other antifoggants usable in the invention include mercury (II) salts described in JP-A No. 11-65021, Paragraph 0113; benzoic acid compounds described in JP-A No. 11-65021, Paragraph 0114; salicylic acid derivatives described in JP-A No. 2000-206642; formalin scavenger compounds represented by the formula (S) described in JP-A No. 2000-221634; triazine compounds disclosed in claim 9 of JP-A No. 11-352624; compounds represented by the formula (III) described in JP-A No. 6-11791; and 4-hydroxy-6-methyl-1,3,3a,7-tetrazaindene. The disclosures of the above patent documents are incorporated herein by reference.

The photothermographic materials of the invention may further include an azolium salt for the purpose of preventing the fogging. Examples of the azolium salt include compounds represented by the formula (XI) described in JP-A No. 59-193447; compounds described in JP-B No. 55-12581; and compounds represented by the formula (II) described in JP-A No. 60-153039. The disclosures of the above patent documents are incorporated herein by reference. In an embodiment, the azolium salt is added to a layer on the same side as the image-forming layer. The layer to which the azolium salt may be added is preferably the image-forming layer. However, the azolium salt may be added to any portion of the material. The azolium salt may be added in any step in the preparation of the coating liquid. When the azolium salt is added to the image-forming layer, the azolium salt may be added in any step between the preparation of the organic silver salt and the preparation of the coating liquid. In an embodiment, the azolium salt is added during the period after the preparation of the organic silver salt but before the application of the coating liquid. The azolium salt may be added in the form of powder, a solution, a fine particle dispersion, etc. Further, the azolium salt may be added in the form of a solution which further contains other additives such as sensitizing dyes, reducing agents, and toning agents. The amount of the azolium salt to be added per 1 mol of silver is not particularly limited, and is preferably $1\times10^{-6}$ mol to 2 mol, more preferably $1\times10^{-3}$ mol to 0.5 mol.

(Other Additives)

1) Mercapto Compound, Disulfide Compound, and Thione Compound

Substances selected from mercapto compounds, disulfide compounds, and thione compounds may be used in the photothermographic material of the invention in order to control (inhibit or accelerate) the development, to heighten the spectral sensitization efficiency, or to improve the storability before or after the development, etc. Examples of the compounds are described in JP-A No. 10-62899, Paragraph 0067 to 0069; JP-A No. 10-186572, the compounds represented by the formula (I) and specific examples thereof described in Paragraph 0033 to 0052; EP-A No. 0803764A1, Page 20, Line 36–56; the disclosures of which are incorporated herein by reference. Mercapto-substituted heteroaromatic compounds described, for example, in JP-A Nos. 9-297367, 9-304875, 2001-100358, 2002-303954, and 2002-303951, (the disclosures of which are incorporated herein by reference) are particularly preferred in the invention.

2) Toning Agent

It is preferable to add a toning agent to the photothermographic material of the invention. Toning agents are described in JP-A No. 10-62899, paragraphs 0054 to 0055, EP-A No. 0803764AI, p. 21, lines 23 to 48, and JP-A Nos. 2000-356317 and 2000-187298. Specific examples of the toning agent include: phthalazinone, phthalazinone derivatives, and metal salts thereof, such as 4-(1-naphtyl)phthalazinone, 6-chlorophthalazinone, 5,7-dimethoxyphthalazinone, and 2,3-dihydro-1,4-phthalazinedione; combinations of phthalazinone with phthalic acids such as phthalic acid, 4-methylphthalic acid, 4-nitrophthalic acid, diammonium phthalate, sodium phthalate, potassium phthalate, and tetrachlorophthalic anhydride; phthalazines (phthalazine, phthalazine derivatives, and metal salts thereof) such as 4-(l-naphtyl)phthalazine, 6-chlorophthalazine, 5,7-dimethoxyphthalazine, 6-isobutylphthalazine, 6-tert-butylphthalazine, 5,7-dimethylphthalazine, and 2,3-dihydrophthalazine; and combinations of phthalazines with phthalic acids. Among them, the combination of 6-isopropylphthalazine and phthalic acid and the combination of 6-isopropylphthalazine and 4-methylphthalic acid are preferable.

3) Plasticizer and Lubricant

In the invention, known plasticizers and lubricants can be used for improving the physical property of films. Particularly, it is preferred to use a lubricant such as liquid paraffin, a long-chain fatty acid, a fatty acid amide, or a fatty acid ester, for the purpose of improving the handling property at production and the scratch resistance at heat development. The lubricant is preferably liquid paraffin from which low-boiling ingredients have been removed, or a fatty acid ester with a molecular weight of 1,000 or more having a branched structure.

The plasticizer and lubricant that can be used in the image-forming layer and the non-photosensitive layer are preferably selected from the compounds described in JP-A No. 11-65021, paragraph 0117, JP-A Nos. 2000-5137, 2004-219794, 2004-219802, and 2004-334077, the disclosures of which are incorporated herein by reference.

4) Dye and Pigment

In the invention, the image-forming layer may further comprise various dyes and pigments (for example, C. I. Pigment Blue 60, C. I. Pigment Blue 64, and C. I. Pigment Blue 15:6) from the viewpoint of improving the tone, preventing occurrence of interference fringe and irradiation upon laser exposure. The dyes and pigments are described, for example, in WO98/36322 and JP-A Nos. 10-268465 and 11-338098, the disclosures of which are incorporated herein by reference.

5) Nucleating Agent

It is preferable to incorporate a nucleating agent into the image-forming layer. Examples of the nucleating agents, examples of the methods for adding them, and examples of the amount thereof are described in JP-A No. 11-65021, Paragraph 0118; JP-A No. 11-223898, Paragraph 0136 to 0193; JP-A No. 2000-284399 (the compounds each represented by any one of the formulae (H), (1) to (3), (A), and (B)); JP-A No. 2000-347345 (the compounds represented by the formulae (III) to (V) and the example compounds of Chemical Formula 21 to 24); etc. Further, examples of nucleation promoting agents are described in JP-A No. 11-65021, Paragraph 0102, and JP-A No. 11-223898, Paragraphs 0194 and 0195.

Formic acid or a formate salt may be used as a strong fogging agent. The amount of the formic acid or the formate salt per 1 mol of silver is preferably 5 mmol or smaller, more preferably 1 mmol or smaller, on the the image-forming layer side.

In the photothermographic material of the invention, the nucleating agent is preferably used in combination with an acid generated by hydration of diphosphorus pentaoxide or a salt thereof. Examples of the acid and the salt include metaphosphoric acid, pyrophosphoric acid, orthophosphoric acid, triphosphoric acid, tetraphosphoric acid, hexametaphosphoric acid, and salts thereof. Particularly preferred are orthophosphoric acid, hexametaphosphoric acid, and salts thereof. Specific examples of the salts include sodium orthophosphate, sodium dihydrogen orthophospate, sodium hexametaphosphate, and ammonium hexametaphosphate.

The amount of the acid generated by the hydration of diphosphorus pentaoxide or the salt thereof may be selected depending on the sensitivity, the fogging properties, etc. The amount of the acid or the salt to be applied per 1 $m^2$ of the photosensitive material is preferably 0.1 to 500 $mg/m^2$, more preferably 0.5 to 100 $mg/m^2$.

(Preparation and Application of Coating Liquid)

The coating liquid for the image-forming layer is prepared preferably at a preparation temperature of 30 to 65° C., more preferably 35° C. or higher but lower than 60° C., furthermore preferably 35 to 55° C. The temperature of the coating liquid immediately after addition of polymer latex is preferably maintained at 30 to 65° C.

(Layer Structure and Components)

1. Layer Structure

The photothermographic material of the invention has a layer structure comprising essential layers of (1) the image-forming layer, (2) the non-photosensitive intermediate layer A, and (3) the outermost layer, which are disposed in this order from the support. The image-forming layer and the non-photosensitive intermediate layer A are preferably adjacent to each other. In an embodiment, a non-photosensitive intermediate layer B is provided between the non-photosensitive intermediate layer A and the outermost layer. There may be other layers, and each layer may be a single layer or may comprise two or more layers.

Generally, the function of the outermost layer is to improve conveyability and surface protection and to prevent adhesion of the photothermographic material to other surfaces or members and to prevent damages on the image. Thus, the outermost layer often includes an additive such as a matting agent, a slipping agent, and a surfactant in addition to the binder. One surface protective layer or a plurality of surface protective layers may be formed in addition to the outermost layer. Regarding the surface protective layers, JP-A No. 11-65021, Paragraph 0119 to 0120 and JP-A No. 2000-171936 may be referenced, the disclosures of which are incorporated herein by reference.

The intermediate layers are generally formed as a boundary layer between the image-forming layer and the outermost layer. Usually, the intermediate layers are mainly composed of binder, and may include various additives. In addition, the intermediate layers may include various additives. In an embodiment, at least one of the outermost layer and the non-photosensitive intermediate layer B include a hydrophilic polymer derived from animal protein, considering the coatability.

Preferable layer constitutions are shown below without intention of limiting the invention.

Hereinafter, the polymer prepared by copolymerizing monomers including the monomer represented by the formula (M) is referred to as "the polymer of the formula (M)", a hydrophobic polymer, which is not limited to the polymer of the formula (M), is referred to as "a hydrophobic polymer", the hydrophilic polymer derived from an animal protein such as gelatin is referred to as "the hydrophilic polymer 1", and a hydrophilic polymer (such as polyvinyl alcohol (PVA)) which is not derived from animal proteins, is referred to as "a hydrophilic polymer 2".

TABLE 2

| | Binder | | | | | |
|---|---|---|---|---|---|---|
| | Layer Structure Example 1 | Layer Structure Example 2 | Layer Structure Example 3 | Layer Structure Example 4 | Layer Structure Example 5 | Layer Structure Example 6 |
| Outermost layer | hydrophilic polymer 1 in an amount of 50 mass % or more | Hydrophobic polymer | hydrophilic polymer 1 in an amount of 50 mass % or more | hydrophilic polymer 1 in an amount of 50 mass % or more | Hydrophobic polymer | Hydrophobic polymer/ Hydrophilic polymer 1 |
| Non-photo-sensitive intermediate layer B | hydrophilic polymer 2 in an amount of 50 mass % or more | hydrophilic polymer 1 in an amount of 50 mass % or more | hydrophilic polymer 1 in an amount of 50 mass % or more | hydrophilic polymer 1 in an amount of 50 mass % or more hydrophilic polymer 2 in an amount of 50 mass % or more | hydrophilic polymer 1 in an amount of 50 mass % or more hydrophilic polymer 2 in an amount of 50 mass % or more | hydrophilic polymer 1 in an amount of 50 mass % or more hydrophilic polymer 2 in an amount of 50 mass % or more |
| Non-photo-sensitive intermediate layer A | Polymer of formula (M) in an amount of 50 mass % or more | Polymer of formula (M) in an amount of 50 mass % or more | Polymer of formula (M) in an amount of 50 mass % or more | Polymer of formula (M) in an amount of 50 mass % or more | Polymer of formula (M) in an amount of 50 mass % or more | Polymer of formula (M) in an amount of 50 mass % or more |
| Image-forming layer | | | | | | |

The binder of the outermost layer preferably include the hydrophilic polymer 1 (such as gelatin) in an amount of 50 mass % or more from the viewpoint of the coating property, and preferably include a hydrophobic polymer from the viewpoint of the image storability against tackiness and contamination by fingerprints.

In the outermost layer of Layer Structure Example 3, 4, or 6, the hydrophilic polymer 2 may be used instead of the hydrophilic polymer 1.

The binder of the non-photosensitive intermediate layer B preferably includes the hydrophilic polymer 1 in an amount of 50 mass % or more from the viewpoint of the coating property. In order to prevent the aggregation caused by the contact of the gelatin-containing layer with the hydrophobic-polymer-containing layer, the non-photosensitive intermediate layer B is preferably comprised of two layers which are a layer including the hydrophilic polymer 2 such as PVA in an amount of 50 mass % or more and a layer including the hydrophilic polymer 1 in an amount of 50 mass % or more.

(i) When the Content of the Hydrophilic Polymer 1 in the Binder of the Outermost Layer is Lower than 50 mass %

When the content of the hydrophilic polymer 1 in the binder of the outermost layer is lower than 50 mass %, the binder in the non-photosensitive intermediate layer B preferably includes the hydrophilic polymer 1 in an amount of 50 mass % or more. In this case, the binder in the outermost layer may be hydrophilic or hydrophobic. When the binder of the outermost layer includes a hydrophilic polymer, the hydrophilic polymer may be the hydrophilic polymer 1 and/or the hydrophilic polymer 2. In view of the setting property, the binder in the outermost layer preferably includes the hydrophilic polymer 1 in an amount of 50 mass % or more or preferably includes the hydrophilic polymer 2 mixed with a gelling agent. The outermost layer may include the hydrophobic polymer; the inclusion of the hydrophobic polymer is preferable from the viewpoint of suppression of contamination by fingerprints and tackiness. These hydrophilic polymers and the hydrophobic polymers may be used in combination without particular limitations.

(ii) When the Binder of the Outermost Layer Includes the Hydrophilic Polymer 1 in an Amount of 50 mass % or More When the binder of the outermost layer includes the hydrophilic polymer 1 in an amount of 50 mass % or more, the binder of the non-photosensitive intermediate layer B is not particularly restricted, and is preferably a binder including the hydrophilic polymer 1 in an amount of 50 mass % or more or a binder including the hydrophilic polymer 2 in an amount of 50 mass % or more. The outermost layer usually includes additives such as a matting agent and a surfactant in view of the conveyability and the scratch resistance, whereby the binder content is restricted. Thus, when the binder of the outermost layer includes the hydrophilic polymer 1 in an amount of 50 mass % or more, the binder of the non-photosensitive intermediate layer B may preferably include the hydrophilic polymer 1 in an amount of 50 mass % or more so as to improve the coating property. In an embodiment, the photothermographic material has at least one layer (which may be a non-photosensitive layer B) which has a proportion of the hydrophilic polymer 1 to the total binder of 50 mass % or higher. In a preferable embodiment, two or more non-photosensitive intermediate layers B are provided between the non-photosensitive intermediate layer A and the outermost layer, and the non-photosensitive intermediate layers B include a first non-photosensitive intermediate layer B whose binder includes the hydrophilic polymer 2 in an amount of 50 mass % or more, and a second intermediate layer B whose binder includes the hydrophilic polymer 1 in an amount of 50 mass % or more, wherein the second intermediate layer B is nearer to the outermost layer than the first intermediate layer B is. The aggregation caused by contact of the gelatin-containing layer with the hydrophobic layer can be inhibited by providing the non-photosensitive intermediate layer B whose binder includes the hydrophilic polymer 2 in an amount of 50 mass % or more.

The photothermographic material may comprise other non-photosensitive layers such as: an undercoat layer which may be provided between the image-forming layer and the support; a back layer which may be provided on the side of the support which side is opposite to the image-forming layer side; and a back protective layer which may be provided such that the back protective layer is farther from the support than the back layer is. These layers may each independently have a single- or multi-layered structure.

Further, a layer which functions as an optical filter may be provided to the photothermographic material, generally as the outermost layer or an intermediate layer. An antihalation layer may be provided to the photothermographic material, as the undercoat layer or as the back layer.

The photothermographic material of the invention may be a single-sided material having the image-forming layer on one side of the support, or a double-sided material having the image-forming layers on both sides of the support. In the double-sided material, as long as the layer structure of the invention is formed on one side, the layer structure of the other side is not particularly limited.

2) Film-Forming Aid

A film-forming aid may be added to the aqueous dispersion of the hydrophobic polymer so as to control its minimum film-forming temperature. The film-forming aid is also referred to as a primary plasticizer, and comprises an organic compound (usually an organic solvent) which lowers the minimum film-forming temperature of the polymer latex, and is described, for example, in Soichi Muroi, Gosei Ratekkusu no Kagaku (Kobunshi Kanko Kai, 1970), the disclosure of which is incorporated herein by reference. Preferred film-forming aids are shown below without intention of restricting the scope of the invention.

Z-1: Benzyl alcohol

Z-2: 2,2,2,4-tetramethylpentanediol-1,3-diisobutyrate

Z-3: 2-Dimethylaminoethanol

Z-4: Diethylene glycol

3) Crosslinking Agent

In a preferable embodiment, at least one layer on the image-forming layer side includes a crosslinking agent. In a more preferable embodiment, a crosslinking agent is included in a layer containing the hydrophilic polymer 1 such as the non-photosensitive intermediate layer B and/or in a layer containing the hydrophilic polymer 2. Addition of the crosslinking agent heightens the hydrophobicity and waterproofness of the non-photosensitive intermediate layer, thereby providing the photothermographic material with excellent properties.

The crosslinking agent is not particularly limited and may have a plurality of groups which can react with an amino group and/or a carboxyl group. Some examples of the crosslinking agents are described in T. H. James, *The Theory of the Photographic Process, Fourth Edition,* Page 77 to 87 (Macmillan Publishing Co., Inc., 1977), the disclosure of which is incorporated herein by reference. The crosslinking agent is preferably an inorganic crosslinking agent such as chromium alum or an organic crosslinking agent, more preferably an organic crosslinking agent.

A hydrophobic-polymer containing layer such as the non-photosensitive intermediate layer A may include a crosslinking agent. In this case, the crosslinking agent is not particularly limited and may have a plurality of groups capable of reacting with a carboxyl group.

Examples of organic crosslinking agents include carboxylic acid derivatives, carbamic acid derivatives, sulfonic ester compounds, sulfonyl compounds, epoxy compounds, aziridine compounds, isocyanate compounds, carbodiimide compounds, and oxazoline compounds. More preferred among them are epoxy compounds, isocyanate compounds, carbodiimide compounds, and oxazoline compounds. Only a single crosslinking agent may be used, or two or more crosslinking agents may be used.

Specific examples of the crosslinking agents are described below without intention of restricting the scope of the invention.

(Carbodiimide Compound)

The carbodiimide compounds which function as the crosslinking agents are preferably water-soluble or water-dispersible, and specific examples thereof include polycarbodiimides derived from isophorone diisocyanate described in JP-A No. 59-187029 and JP-B No. 5-27450, carbodiimide compounds derived from tetramethylxylylene diisocyanate described in JP-A No. 7-330849, multi-branched carbodiimide compounds described in JP-A No. 10-30024, and carbodiimide compounds derived from dicyclohexylmethane diisocyanate described in JP-A No. 2000-7642. The disclosures of the above patent documents are incorporated by reference herein.

(Oxazoline Compound)

The oxazoline compounds which function as the crosslinking agents are preferably water-soluble or water-dispersible, and specific examples thereof include oxazoline compounds described in JP-A No. 2001-215653, the disclosure of which is incorporated by reference herein.

(Isocyanate Compound)

Isocyanate compounds can react with water. Therefore, the isocyanate compounds which function as the crosslinking agents are preferably water-dispersible, particularly preferably self-emulsifiable, from the viewpoint of pot life. Specific examples thereof include water-dispersible isocyanate compounds described in JP-A Nos. 7-304841, 8-277315, 10-45866, 9-71720, 9-328654, 9-104814, 2000-194045, 2000-194237, and 2003-64149, the disclosures of which are incorporated herein by reference.

(Epoxy Compound)

The epoxy compounds which function as the crosslinking agents are preferably water-soluble or water-dispersible, and specific examples thereof include water-dispersible epoxy compounds described in JP-A Nos. 6-329877 and 7-309954, the disclosures of which are incorporated herein by reference.

More specific examples of the crosslinking agents usable in the invention are described below without intention of restricting the scope of the invention.

(Epoxy Compound)

Trade Name:

DIC FINE EM-60 (Dainippon Ink and Chemicals, Inc.)

(Isocyanate Compound)

Trade Names:

DURANATE WB40-100 (Asahi Kasei Corporation)
DURANATE WB40-80D (Asahi Kasei Corporation)
DURANATE WT20-100 (Asahi Kasei Corporation)
DURANATE WT30-100 (Asahi Kasei Corporation)
CR-60N (Dainippon Ink and Chemicals, Inc.)

(Carbodiimide Compound)

Trade Names:

CARBODILITE V-02 (Nisshinbo Industries, Inc.)
CARBODILITE V-02-L2 (Nisshinbo Industries, Inc.)
CARBODILITE V-04 (Nisshinbo Industries, Inc.)
CARBODILITE V-06 (Nisshinbo Industries, Inc.)
CARBODILITE E-01 (Nisshinbo Industries, Inc.)
CARBODILITE E-02 (Nisshinbo Industries, Inc.)

(Oxazoline Compound)

Trade Names:

EPOCROS K-1010E (Nippon Shokubai Co., Ltd.)
EPOCROS K-1020E (Nippon Shokubai Co., Ltd.)
EPOCROS K-1030E (Nippon Shokubai Co., Ltd.)
EPOCROS K-2010E (Nippon Shokubai Co., Ltd.)
EPOCROS K-2020E (Nippon Shokubai Co., Ltd.)
EPOCROS K-2030E (Nippon Shokubai Co., Ltd.)
EPOCROS WS-500 (Nippon Shokubai Co., Ltd.)
EPOCROS WS-700 (Nippon Shokubai Co., Ltd.)

The crosslinking agent used in the invention may be mixed with the binder solution before added to the coating liquid. As an alternative, the crosslinking agent may be added in the end of the preparation of the coating liquid, or immediately before the coating.

The amount of the crosslinking agent is preferably 0.5 to 200 parts by mass, more preferably 2 to 100 parts by mass, furthermore preferably 3 to 50 parts by mass, per 100 parts by mass of binder in the layer including the crosslinking agent.

4) Thickener

In a preferable embodiment, a thickener is added to the coating liquid for forming the non-photosensitive intermediate layer A. The addition of the thickener enables formation of a hydrophobic layer having a uniform thickness. Examples of the thickener include alkaline metal salts of polyvinyl alcohol, alkaline metal salts of hydroxyethylcellulose, and alkaline metal salts of carboxymethylcellulose. The thickener is preferably thixotropic in view of handling, and thus hydroxyethylcellulose, sodium hydroxymethylcarboxylate, and carboxymethyl-hydroxyethylcellulose are preferable.

The viscosity of the non-photosensitive intermediate layer A coating liquid including the thickener at 40° C. is preferably 1 to 200 mPa·s, more preferably 10 to 100 mPa·s, furthermore preferably 15 to 60 mPa·s.

(5) Hydrophilic-Polymer-1 Containing Layer

In the invention, the hydrophilic-polymer-1 containing layer is the layer including the hydrophilic polymer 1 in an amount of 50 mass % or more based on the total amount of the binder in the layer. The proportion of the hydrophilic polymer 1 to the entire binder in the layer is preferably 50 to 100 mass %, more preferably 60 to 100 mass %, regardless of whether the layer is provided as the outermost layer or as the non-photosensitive intermediate layer B. When the proportion is lower than 50 mass %, the coating liquid is poor in the setting property at the coating and drying, thereby often resulting in uneven coating surface.

In the invention, the hydrophilic polymer 1 (the hydrophilic polymer derived from an animal protein) is a natural or chemically modified, water-soluble polymer such as glue, casein, gelatin, or albumen.

The hydrophilic polymer 1 is preferably a gelatin. Gelatins may be classified to acid-processed gelatins and alkali-processed gelatins such as lime-treated gelatins according to the synthesis methods; gelatins of both classes are usable in the invention. The gelatin used as the hydrophilic polymer 1 preferably has a molecular weight of 10,000 to 1,000,000. The hydrophilic polymer 1 may be a modified gelatin such as a phthalated gelatin, which is prepared by modifying the amino or carboxyl group of a gelatin. Examples of the gelatins include inert gelatins such as Nitta Gelatin 750, and phthalated gelatins such as Nitta Gelatin 801.

An aqueous gelatin solution is converted to a sol when heated to a temperature of 30° C. or higher, and is converted to a gel and loses its fluidity when cooled to a temperature which is lower than 30° C. Since the sol-gel transformation occurs reversibly depending on the temperature, the aqueous gelatin solution of the coating liquid has a setting property, whereby it loses the fluidity when cooled to a temperature which is lower than 30° C.

The hydrophilic polymer 1 may be used in combination with the hydrophilic polymer 2 (which is not derived from an animal protein) and/or the hydrophobic polymer. When the hydrophilic-polymer-1 containing layer is the outermost layer, the binder preferably includes the hydrophobic polymer in addition. In this case, the ratio of the amount of the hydrophilic polymer 1 to the amount of the hydrophobic polymer is preferably in the range of 50/50 to 99/1, more preferably in the range of 50/50 to 80/20.

The content of the hydrophilic polymer 1 in the coating liquid for the hydrophilic-polymer-1 containing layer is 1 to 20 mass %, preferably 2 to 12 mass %, regardless of whether the layer is the outermost layer or the non-photosensitive intermediate layer B.

The hydrophilic-polymer-1 containing layer preferably includes a crosslinking agent. Preferable crosslinking agents are the same as in the above explanation on the non-photosensitive intermediate layer A.

The hydrophilic-polymer-1 containing layer may further include other additives such as a surfactant, a pH adjuster, a preservative, a fungicide, a dye, a pigment, and a color tone controlling agent.

6) Hydrophilic-Polymer-2 Containing Layer

In the invention, the hydrophilic-polymer-2 containing layer is the layer including the hydrophilic polymer 2 in an amount of 50 mass % or more based on the total amount of the binder in the layer. The proportion of the amount of the hydrophilic polymer 2 to the total amount of binder in the hydrophilic-polymer-2 containing layer is preferably 50 to 100 mass %, more preferably 60 to 100 mass %, regardless of whether the layer is provided as the outermost layer or as the non-photosensitive intermediate layer B. When the hydrophilic-polymer-2 containing layer is provided between the gelatin-containing layer and the non-photosensitive intermediate layer A and the proportion of the hydrophilic polymer 2, which is not from animal protein, is lower than 50 mass %, the binder is poor in the property of preventing the aggregation.

The hydrophilic polymer 2, which is not derived from animal protein, is a natural polymer other than animal protein (a polysaccharide, a microbial polymer, an animal polymer, etc.; for example a gelatin), a semisynthetic polymer (a cellulose-based polymer, a starch-based polymer, alginic-acid-based polymer, etc.), or a synthetic polymer (a vinyl-based polymer, etc.). Examples of the hydrophilic polymer 2 include synthetic polymers such as polyvinyl alcohols, and natural or semisynthetic polymers derived from plant cellulose, to be hereinafter described. The hydrophilic polymer 2 is preferably a polyvinyl alcohol or an acrylic acid-vinyl alcohol copolymer.

The hydrophilic polymer 2, which is not derived from an animal protein, does not have a setting property. However, when the hydrophilic polymer 2 is used in combination with a gelling agent, the setting property can be imparted and coatability is improved.

<Polyvinyl Alcohols>

The hydrophilic polymer 2 is preferably a polyvinyl alcohol (PVA). Specific examples of the polyvinyl alcohols include polyvinyl alcohols having various saponification degrees, polymerization degrees, and neutralization degrees, modified polyvinyl alcohols, and copolymers of polyvinyl alcohols with other monomers, which will be described below.

The specific examples of the polyvinyl alcohols include completely saponified polyvinyl alcohols such as PVA-105 [polyvinyl alcohol (PVA) content 94.0 mass % or higher, saponification degree 98.5±0.5 mol %, sodium acetate content 1.5 mass % or lower, volatile content 5.0 mass % or lower, viscosity (4 mass %, 20° C.) 5.6±0.4 CPS], PVA-110 [PVA content 94.0 mass %, saponification degree 98.5±0.5 mol %, sodium acetate content 1.5 mass %, volatile content 5.0 mass %, viscosity (4 mass %, 20° C.) 11.0±0.8 CPS], PVA-117 [PVA content 94.0 mass %, saponification degree 98.5±0.5 mol %, sodium acetate content 1.0 mass %, volatile content 5.0 mass %, viscosity (4 mass %, 20° C.) 28.0±3.0 CPS], PVA-117H [PVA content 93.5 mass %, saponification degree 99.6±0.3 mol %, sodium acetate content 1.85 mass %, volatile content 5.0 mass %, viscosity (4 mass %, 20° C.) 29.0±3.0 CPS], PVA-120 [PVA content 94.0 mass %, saponification degree 98.5±0.5 mol %, sodium acetate content 1.0 mass %, volatile content 5.0 mass %, viscosity (4 mass %, 20° C.) 39.5±4.5 CPS], PVA-124 [PVA content 94.0 mass %, saponification degree 98.5±0.5 mol %, sodium acetate content 1.0 mass %, volatile content 5.0 mass %, viscosity (4 mass %, 20° C.) 60.0±6.0 CPS], PVA-124H [PVA content 93.5 mass %, saponification degree 99.6±0.3 mol %, sodium acetate content 1.85 mass %, volatile content 5.0 mass %, viscosity (4 mass %, 20° C.) 61.0±6.0 CPS], PVA-CS [PVA content 94.0 mass %, saponification degree 97.5±0.5 mol %, sodium acetate content 1.0 mass %, volatile content 5.0 mass %, viscosity (4 mass %, 20° C.) 27.5±3.0 CPS], PVA-CST [PVA content 94.0 mass %, saponification degree 96.0±0.5 mol %, sodium acetate content 1.0 mass %, volatile content 5.0 mass %, viscosity (4 mass %, 20° C.) 27.0±3.0 CPS], and PVA-HC [PVA content 90.0 mass %, saponification degree 99.85 mol % or more, sodium acetate content 2.5 mass %, volatile content 8.5 mass %, viscosity (4 mass %, 20° C.) 25.0±3.5 CPS] (trade names, available from Kuraray Co., Ltd.).

The specific examples of the polyvinyl alcohols further include partially saponified polyvinyl alcohols such as PVA-203 [PVA content 94.0 mass %, saponification degree 88.0±1.5 mol %, sodium acetate content 1.0 mass %, volatile content 5.0 mass %, viscosity (4 mass %, 20° C.) 3.4±0.2 CPS], PVA-204 [PVA content 94.0 mass %, saponification degree 88.0±1.5 mol %, sodium acetate content 1.0 mass %, volatile content 5.0 mass %, viscosity (4 mass %, 20° C.) 3.9±0.3 CPS], PVA-205 [PVA content 94.0 mass %, saponification degree 88.0±1.5 mol %, sodium acetate content 1.0 mass %, volatile content 5.0 mass %, viscosity (4 mass %, 20° C.) 5.0±0.4 CPS], PVA-210 [PVA content 94.0 mass %, saponification degree 88.0±1.0 mol %, sodium acetate content 1.0 mass %, volatile content 5.0 mass %, viscosity (4 mass %, 20° C.) 9.0±1.0 CPS], PVA-217 [PVA content 94.0 mass %, saponification degree 88.0±1.0 mol %, sodium acetate content 1.0 mass %, volatile content 5.0 mass %, viscosity (4 mass %, 20° C.) 22.5±2.0 CPS], PVA-220 [PVA content 94.0 mass %, saponification degree 88.0±1.0 mol %, sodium acetate content 1.0 mass %, volatile content 5.0 mass %, viscosity (4 mass %, 20° C.) 30.0±3.0 CPS], PVA-224 [PVA content 94.0 mass %, saponification degree 88.0±1.5 mol %, sodium acetate content 1.0 mass %, volatile content 5.0 mass %, viscosity (4 mass %, 20° C.) 44.0±4.0 CPS], PVA-228 [PVA content 94.0 mass %, saponification degree 88.0±1.5 mol %, sodium acetate content 1.0 mass %, volatile content 5.0 mass %, viscosity (4 mass %, 20° C.) 65.0±5.0 CPS], PVA-235 [PVA content 94.0 mass %, saponification degree 88.0±1.5 mol %, sodium acetate content 1.0 mass %, volatile content 5.0 mass %, viscosity (4 mass %, 20° C.) 95.0±15.0 CPS], PVA-217EE [PVA content 94.0 mass %, saponification degree 88.0±1.0 mol %, sodium acetate content 1.0 mass %, volatile content 5.0 mass %, viscosity (4 mass %, 20° C.) 23.0±3.0 CPS], PVA-217E [PVA content 94.0 mass %, saponification degree 88.0±1.0 mol %, sodium acetate content 1.0 mass %, volatile content 5.0 mass %, viscosity (4 mass %, 20° C.) 23.0±3.0 CPS], PVA-220E [PVA content 94.0 mass %, saponification degree 88.0±1.0 mol %, sodium acetate content 1.0 mass %, volatile content 5.0 mass %, viscosity (4 mass %, 20° C.) 31.0±4.0 CPS], PVA-224E [PVA content 94.0 mass %, saponification degree 88.0±1.0 mol %, sodium acetate content 1.0 mass %, volatile content 5.0 mass %, viscosity (4 mass %, 20° C.) 45.0±5.0 CPS], PVA-403 [PVA content 94.0 mass %, saponification degree 80.0±1.5 mol %, sodium acetate content 1.0 mass %, volatile content 5.0 mass %, viscosity (4 mass %, 20° C.) 3.1±0.3 CPS], PVA-405 [PVA content 94.0 mass %, saponification degree 81.5±1.5 mol %, sodium acetate content 1.0 mass %, volatile content 5.0 mass %, viscosity (4 mass %, 20° C.) 4.8±0.4 CPS], PVA-420 [PVA content 94.0 mass %, saponification degree 79.5±1.5 mol %, sodium acetate content 1.0 mass %, volatile content 5.0 mass %], PVA-613 [PVA content 94.0 mass %, saponification degree 93.5±1.0 mol %, sodium acetate content 1.0 mass %, volatile content 5.0 mass %, viscosity (4 mass %, 20° C.) 16.5±2.0 CPS], and L-8 [PVA content 96.0 mass %, saponification degree 71.0±1.5 mol %, sodium acetate content 1.0 mass % (ash content), volatile content 3.0 mass %, viscosity (4 mass %, 20° C.) 5.4±0.4 CPS] (trade names, available from Kuraray Co., Ltd.).

The values in the above specific examples are measured according to JIS K-6726-1977, the disclosure of which is incorporated by reference herein.

The modified polyvinyl alcohol used as the hydrophilic polymer 2 may be a cation-modified, anion-modified, SH-compound-modified, alkylthio-.compound-modified, or silanol-modified polyvinyl alcohol. The modified polyvinyl alcohols described in Koichi Nagano, et al., *Poval,* Kobunshi Kanko Kai may be used in the invention, the disclosures of which is incorporated herein by reference.

Specific examples of the modified polyvinyl alcohols (modified PVAs) include C polymers such as C-118, C-318, C-318-2A, and C-506 (trade names, available from Kuraray Co., Ltd.), HL polymers such as HL-12E and HL-1203 (trade names, available from Kuraray Co., Ltd.), HM polymers such as HM-03 and HM-N-03 (trade names, available from Kuraray Co., Ltd.), K polymers such as KL-118, KL-318, KL-506, KM-118T, and KM-618 (trade names, available from Kuraray Co., Ltd.), M polymers such as M-115 (trade name, available from Kuraray Co., Ltd.), MP polymers such as MP-102, MP-202, and MP-203 (trade names, available from Kuraray Co., Ltd.), MPK polymers such as MPK-1, MPK-2, MPK-3, MPK-4, MPK-5, and MPK-6 (trade names, available from Kuraray Co., Ltd.), R polymers such as R-1130, R-2105, and R-2130 (trade names, available from Kuraray Co., Ltd.), V polymers such as V-2250 (trade name, available from Kuraray Co., Ltd.), etc.

The viscosity of the aqueous solution of the polyvinyl alcohol can be adjusted or stabilized by adding trace of a solvent or inorganic salt, which is described in detail in Koichi Nagano, et al., *Poval,* Kobunshi Kanko Kai, Page 144 to 154. The disclosure of this literature is incorporated by reference herein in its entirety. As a typical example, it is preferable to add boric acid to the polyvinyl alcohol so as to improve the coating surface state. The mass ratio of boric acid to polyvinyl alcohol is preferably 0.01 mass % to 40 mass %.

The crystallinity of the polyvinyl alcohol can be increased by a heat treatment, thereby improving the waterproofness, as described in the above reference *Poval.* The waterproofness of the polyvinyl alcohol can be improved by being heated at the coating and drying or after the drying, whereby the polyvinyl alcohol is particularly preferred in the invention among water-soluble polymers.

In order to further improve the waterproofness, a waterproofing agent such as those described in the above reference *Poval,* Page 256 to 261 is preferably added to the polyvinyl alcohol. Examples of the waterproofing agents include aldehydes; methylol compounds such as N-methylol urea and N-methylol melamine; activated vinyl compounds such as divinylsulfone and derivatives thereof; bis(β-hydroxyethylsulfone); epoxy compounds such as epichlorohydrin and derivatives thereof; polyvalent carboxylic acids such as dicarboxylic acids and polycarboxylic acids including polyacrylic acids, methyl vinyl ether-maleic acid copolymers, and isobutylene-maleic anhydride copolymers; diisocyanates; and inorganic crosslinking agents such as compounds of Cu, B, Al, Ti, Zr, Sn, V, Cr, etc.

In the invention, the waterproofing agent is preferably an inorganic crosslinking agent, more preferably boric acid or a derivative thereof, particularly preferably boric acid. Specific examples of the boric acid derivatives are shown below.

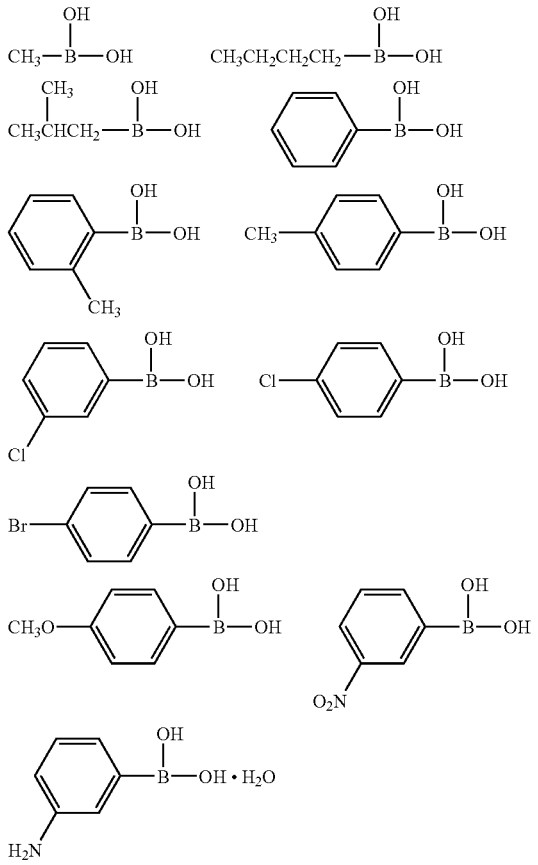

-continued

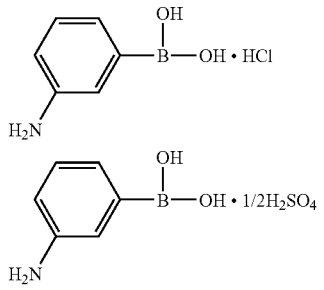

The mass ratio of waterproofing agent to polyvinyl alcohol is preferably adjusted within the range of 0.01 to 40 mass %.

<Hydrophilic Polymer 2 other than PVA>

Specific examples of the hydrophilic polymer 2 include, in addition to the polyvinyl alcohols, the following polymers: plant polysaccharides such as gum arabics, κ-carrageenans, ι-carrageenans, λ-carrageenans, guar gums (e.g. SUPERCOL manufactured by Squalon), locust bean gums, pectins, tragacanths, corn starches (e.g. PURITY-21 manufactured by National Starch & Chemical Co.), and phosphorylated starches (e.g. NATIONAL 78-1898 manufactured by National Starch & Chemical Co.); microbial polysaccharides such as xanthan gums (e.g. KELTROL T manufactured by Kelco) and dextrins (e.g. NADEX 360 manufactured by National Starch & Chemical Co.); animal polysaccharides such as sodium chondroitin sulfates (e.g. CROMOIST CS manufactured by Croda); cellulose-based polymers such as ethylcelluloses (e.g. CELLOFAS WLD manufactured by I.C.I.), carboxymethylcelluloses (e.g. CMC manufactured by Daicel), hydroxyethylcelluloses (e.g. HEC manufactured by Daicel), hydroxypropylcelluloses (e.g. KLUCEL manufactured by Aqualon), methylcelluloses (e.g. VISCONTRAN manufactured by Henkel), nitrocelluloses (e.g. Isopropyl Wet manufactured by Hercules), and cationated celluloses (e.g. CRODACEL QM manufactured by Croda); alginic acid-based compounds such as sodium alginates (e.g. KELTONE manufactured by Kelco) and propylene glycol alginates; and other polymers such as cationated guar gums (e.g. HI-CARE 1000 manufactured by Alcolac) and sodium hyaluronates (e.g. HYALURE manufactured by Lifecare Biomedial).

Specific examples of the hydrophilic polymer 2 further include agars, furcellerans, guar gums, karaya gums, larch gums, guar seed gums, psyllium seed gums, quince seed gums, tamarind gums, gellan gums, and tara gums. Among them, polymers which are highly water-soluble are preferable. The hydrophilic polymer 2 is preferably such a polymer that the aqueous solution thereof undergoes sol-gel transformation by temperature change between 5 to 95° C. within 24 hours.

Further, the hydrophilic polymer 2 may be a synthetic polymer, and specific examples thereof include acrylic polymers such as sodium polyacrylate, polyacrylic acid copolymers, polyacrylamide, and polyacrylamide copolymers; vinyl polymers such as polyvinylpyrrolidone and polyvinylpyrrolidone copolymers; and other synthetic polymers such as polyethylene glycol, polypropylene glycol, polyvinyl ether, polyethyleneimine, polystyrene sulfonate and copolymers thereof, polyvinyl sulfonate and copolymers thereof, polyacrylic acids and copolymers thereof, maleic acid copolymers, maleic monoester copolymers, and acryloylmethylpropanesulfonic acid polymers and copolymers thereof.

Further, polymers with high water absorption described in U.S. Pat. No. 4,960,681, JP-A No. 62-245260 (the disclosures of which are incorporated herein by reference), etc. may be used as the hydrophilic polymer 2. Examples of the polymers with high water absorption include homopolymers of vinyl monomers having a —COOM or —$SO_3M$ group (in which M is a hydrogen or alkaline metal atom) such as sodium methacrylate, ammonium methacrylate, and SUMIKA Gel L-5H available from Sumitomo Chemical Co., Ltd, and copolymers of such vinyl monomers with other vinyl monomers.

Preferred water-soluble polymer among them is SUMIKA GEL L-5H available from Sumitomo Chemical Co., Ltd.

The amount of the hydrophilic polymer 2 to be applied is preferably 0.1 to 10 g/$m^2$, more preferably 0.3 to 3 g/$m^2$, per 1 $m^2$ of the support.

The content of the hydrophilic polymer 2 in the coating liquid is not particularly limited and is preferably controlled such that a viscosity suitable for simultaneous multilayer coating can be obtained. The content is generally 5 to 20 mass %, more preferably 7 to 15 mass %, still more preferably 8 to 13 mass %.

<Polymer which can be Used Additionally>

The hydrophilic polymer 2 may be used in combination with a polymer dispersible in an aqueous solvent.

Preferred examples of the polymers dispersible in an aqueous solvent include synthetic resins, polymers, and copolymers, and other film-forming media, such as cellulose acetates, cellulose acetate butyrates, polymethylmethacrylic acids, polyvinyl chlorides, polymethacrylic acids, styrene-maleic anhydride copolymers, styrene-acrylonitrile copolymers, styrene-butadiene copolymers, polyvinyl acetals (e.g. polyvinyl formals, polyvinyl butyrals, etc.), polyesters, polyurethanes, phenoxy resins, polyvinylidene chlorides, polyepoxides, polycarbonates, polyvinyl acetates, polyolefins, cellulose esters, and polyamides.

The hydrophilic polymer 2 may be used in combination with a latex, and preferred examples thereof include the latexes usable in the non-photosensitive intermediate layer A, latexes of polyacrylates, latexes of polyurethanes, latexes of polymethacrylates, and latexes of copolymers thereof.

Specific examples of the latexes which can be used in combination with the hydrophilic polymer 2 include the following latexes.

LP-1; Latex of -MMA(70)-EA(27)-MAA(3)- (Molecular weight 37,000, Tg 61° C.)

LP-2; Latex of -MMA(70)-2EHA(20)-St(5)-AA(5)- (Molecular weight 40,000, Tg 59° C.)

LP-3; Latex of -VC(50)-MMA(20)-EA(20)-AN(5)-AA(5)- (Molecular weight 80,000)

LP-4; Latex of -VDC(85)-MMA(5)-EA(5)-MAA(5)- (Molecular weight 67,000)

LP-5; Latex of -Et(90)-MAA( 10)- (Molecular weight 12,000)

LP-6; Latex of -MMA(42)-BA(56)-AA(2)- (Molecular weight 540,000, Tg −4° C.)

LP-7; Latex of -MMA(63)-EA(35)-AA(2)- (Molecular weight 33,000, Tg 47° C.)

LP-8; Latex of -St(70.5)-Bu(26.5)-AA(3)- (Cross-linked polymer, Tg 23° C.)

LP-9; Latex of -St(69.5)-Bu(27.5)-AA(3)- (Cross-linked polymer, Tg 20.5° C.)

LP-10; Latex of -St(70)-2EHA(27)-AA(3)- (Molecular weight 130,000, Tg 43° C.)

The abbreviations in the above examples are as follows.

MMA; Methyl methacrylate
EA; Ethyl acrylate
MAA; Methacrylic acid
2EHA; 2-Ethylhexyl acrylate
St; Styrene
Bu; Butadiene
AA; Acrylic acid
DVB; Divinylbenzene
VC; Vinyl chloride
AN; Acrylonitrile
VDC; Vinylidene chloride
Et; Ethylene
IA; Itaconic acid Further, various commercially available aqueous resins can be preferably used in the invention as the water-soluble polymer or as the polymer latex. The commercially-available, aqueous resins are not particularly limited, and examples thereof include water-dispersible or water-soluble acrylic resins such as ACRYSET (trade name, available from Nippon Shokubai Co., Ltd.) and AROLON (trade name, available from Nippon Shokubai Co., Ltd.); aqueous polyurethanes such as HYDRAN (trade name, available from Dainippon Ink and Chemicals, Inc.), VONDIC (trade name, available from Dainippon Ink and Chemicals, Inc.), POIZE (trade name, available from Kao Corporation), SUPERFLEX (trade name, available from Dai-Ichi Kogyo Seiyaku Co., Ltd.), and NEOREZ (trade name, available from Zeneca Limited); aqueous polyesters such as VYLONAL (trade name, available from Toyobo Co., Ltd.) and FINETEX (trade name, available from Dainippon Ink and Chemicals, Inc.); water-dispersible, water-dilutable, or water-soluble alkyd resins such as FORCE (trade name, available from Kansai Paint Co., Ltd.); water-dispersible, water-dilutable, or water-soluble polyolefin resins such as ISOBAM (trade name, available from Kuraray Isoprene Chemical Co. Ltd.), PRIMACOR (trade name, available from The Dow Chemical Company), and HITEC (trade name, available from Toho Chemical Industry Co., Ltd.); water-dispersible epoxy resins such as EPICLON (trade name, available from Dainippon Ink and Chemicals, Inc.); vinyl chloride emulsions; and water-dispersible or water-soluble acrylic resins such as JURYMER, JUNLON, RHEOGIC, and ARONVIS (trade names, available from Nihon Junyaku Co., Ltd.).

Specific examples of the commercially-available aqueous resins include water-dispersible or water-soluble acrylic resins such as ACRYSET 19E, ACRYSET 210E, ACRYSET 260E, ACRYSET 288E, and AROLON 453 (Nippon Shokubai Co., Ltd.), CEBIAN A-4635, 4718, and 4601 (Daicel Chemical Industries, Ltd.), and Nipol LX811, 814, 821, 820, and 857 (Nippon Zeon Co., Ltd.); water-dispersible polyurethane resins such as SOFLANATE AE-10 and SOFLANATE AE-40 (Nippon Soflan Kako K. K.), HYDRANAP-10, 20, 30, and 40, HW-110, HYDRAN HW-131, HYDRAN HW-135, HYDRAN HW-320, ECOS-3000, and VONDIC 2250 and 72070 (Dainippon Ink and Chemicals, Inc.), POIZE 710 and POIZE 720 (available from Kao Corporation), and MELUSI 525, MELUSI 585, MELUSI 414, and MELUSI 455 (Toyo Polymer Co., Ltd.); water-dispersible polyester resins such as VYLONAL MD-1200, VYLONAL MD-1400, and VYLONAL MD-1930 (Toyobo Co., Ltd.), WD-size, WMS, WD3652, and WJL6342 (Eastman Chemical Co.), and FINETEX ES650, 611, 675, and 850 (Dainippon Ink and Chemicals, Inc.); water-soluble, water-dilutable, or water-dispersible polyolefin resins such as ISOBAM-10, ISOBAM-06, and ISOBAM-04 (Kuraray Isoprene Chemical Co. Ltd.), PRIMACOR 5981, PRIMACOR 5983, PRIMACOR 5990, and PRIMACOR 5991 (The Dow Chemical Company), and CHEMIPEARL S120 and SA100 (Mitsui Petrochemical Industries, Ltd.); water-dispersible or water-soluble acrylic resins such as JURYMER AC-103, 10S, AT-510, ET-410, SEK-301, FC-60, SP-50TF, SPO-602, and AC-70N (Nihon Junyaku Co., Ltd.); water-dispersible gums such as LAC-STAR 7310K, 3307B, 4700H, and 7132C (Dainippon Ink and Chemicals, Inc.) and NIPOL LX416, 410, 438C, and 2507 (Nippon Zeon Co., Ltd.); water-dispersible polyvinyl chlorides such as G351 and G576 (Nippon Zeon Co., Ltd.); and polyvinylidene chlorides such as L502 and L513 (Asahi Kasei Kogyo K. K.).

<Other Elements>

In a preferable embodiment, the hydrophilic-polymer-2 containing layer is gelated by temperature decrease, thereby improving the coatability. Since the fluidity of the applied layer is lost during the gelation, the surface of the image-forming layer is hardly affected by the drying air used in the drying process after the coating, so that the photothermographic material with a uniform coating surface can be obtained. To obtain the coating liquid that can be gelated by temperature decrease, the coating liquid for the hydrophilic-polymer-2 containing layer preferably includes a gelling agent.

It is important that the coating liquid be not in the gel state at the coating. In an embodiment, the coating liquid is fluid at the coating, and gelates to lose its fluidity after the coating but before the drying, thereby improving the handling. At the coating, the viscosity of the coating liquid for the hydrophilic-polymer-2 containing layer is preferably 5 to 200 mPa·s, more preferably 10 to 100 mPa·s.

In the invention, the solvent in the coating liquid is an aqueous solvent. The aqueous solvent is water or a mixed solvent comprised of water and a water-miscible organic solvent in an amount of 70 mass % or less based on the amount of the mixed solvent. Examples of the water-miscible organic solvent include alcohol solvents such as methyl alcohol, ethyl alcohol, and propyl alcohol; cellosolve solvents such as methyl cellosolve, ethyl cellosolve, and butyl cellosolve; ethyl acetate; and dimethylformamide.

It is difficult to measure the viscosity of the gelated liquid after the coating but before the drying. The viscosity is supposedly about 200 to about 5,000 mPa·s in general, preferably about 500 to about 5,000 mPa·s.

The gelling temperature, at which the coating liquid gelates, is not particularly limited. The gelling temperature is preferably around room temperature in view of application working efficiency. When the coating liquid having such a gelling temperature is used, the fluidity of the coating liquid can be easily increased by heating, thus enabling easily coating operation; the fluidity can be easily maintained by maintaining the temperature; and the applied liquid can be easily cooled to lose the fluidity. Specifically, the gelling temperature is preferably 0 to 40° C., more preferably 0 to 35° C.

The temperature of the coating liquid at the coating is not particularly limited as long as it is higher than the gelling temperature. Further, the cooling temperature to which the coated liquid is cooled after the coating but before the drying is not particularly limited as long as it is lower than the gelling temperature. However, when the difference between the temperature of the coating liquid and the cooling temperature is small, the liquid often starts to gelate during the coating, resulting in irregular coating. Though the difference can be widened by increasing the temperature of the coating liquid, the solvent in the coating liquid having an excessively high temperature is often vaporized to change the viscosity. Thus, the difference is preferably 5 to 50° C., more preferably 10 to 40° C.

7) Gelling Agent

The gelling agent used in the invention is such a substance that, when it is added to the aqueous solution of the hydrophilic polymer that is not derived from animal protein or to an aqueous latex solution of a hydrophobic polymer and the solution is cooled, the solution is gelated, or a substance which cause gelation when used in combination with a gelation accelerator. The fluidity of the solution is remarkably reduced by the gelation.

The gelling agent may be a water-soluble polysaccharide, and specific examples thereof include agars, κ-carrageenans, ι-carrageenans, alginic acid, alginate salts, agaroses, furcellerans, gellan gums, glucono delta lactones, azotobacter vinelandii gums, xanthan gums, pectins, guar gums, locust bean gums, tara gums, cassia gums, glucomannans, tragacanth gums, karaya gums, pullulans, arabic gums, arabinogalactans, dextrans, carboxymethylcellulose sodium salt, methylcelluloses, psyllium seed gums, starches, chitins, chitosans, and curdlans.

The agars, carrageenans, gellan gums, etc. can form the gel when they are cooled after heating and melting.

More preferred among these gelling agents are K-carrageenans (e.g., K-9F available from Taito Co., Ltd., K-15, K-21 to 24, and I-3 available from Nitta Gelatin Inc., etc.), ι-carrageenans, and agars, and particularly preferred are κ-carrageenans.

The mass ratio of gelling agent to binder polymer is preferably 0.01 to 10.0 mass %, more preferably 0.02 to 5.0 mass %, further preferably 0.05 to 2.0 mass %.

8) Gelation Accelerator

The gelling agent is preferably used in combination with a gelation accelerator. The gelation accelerator used in the invention is such a substance that the gelation accelerator enhances the gelation when brought into contact with a specific gelling agent. A specific combination of the gelling agent and the gelation accelerator enables the gelation accelerator to perform its function. Examples of the combinations of the gelling agent and the gelation accelerator usable in the invention include the following ones:

a combination of a gelation accelerator selected from alkaline metal ions such as a potassium ion and alkaline earth metal ions such as a calcium ion and magnesium ion, and a gelling agent selected from carrageenan, alginate salts, gellan gum, azotobacter vinelandii gum, pectin, carboxymethylcellulose sodium salt, etc.;

a combination of a gelation accelerator selected from boron compounds such as boric acid, and a gelling agent selected from guar gum, locust bean gum, tara gum, cassia gum, etc.;

a combination of a gelation accelerator selected from acids and alkalis, and a gelling agent selected from alginate salts, glucomannan, pectin, chitin, chitosan, curdlan, etc.; and a combination of a gelling agent and a gelation accelerator selected from water-soluble polysaccharides capable of reacting with the gelling agent to form a gel, such as a combination of xanthan gum as a gelling agent and cassia gum as a gelation accelerator, and a combination of carrageenan as a gelling agent and locust bean gum as a gelation accelerator.

Specific examples of the combinations of the gelling agent and the gelation accelerator include the following combinations:

a) combination of κ-carrageenan and potassium;
b) combination of ι-carrageenan and calcium;
c) combination of low methoxyl pectin and calcium;
d) combination of sodium alginate and calcium;
e) combination of gellan gum and calcium;
f) combination of gellan gum and an acid; and
g) combination of locust bean gum and xanthan gum.

A plurality of the combinations may be used simultaneously.

The gelation accelerator and the gelling agent are preferably added to different layers though they may be added to the same layer. In an embodiment, the gelation accelerator is added to a layer which is not in contact with a layer containing the gelling agent. In this embodiment, a layer free from both of the gelling agent and the gelation accelerator is disposed between the layer containing the gelling agent and the layer containing the gelation accelerator.

The mass ratio of gelation accelerator to gelling agent is preferably 0.1 to 200 mass %, more preferably 1.0 to 100 mass %.

The hydrophilic-polymer-2 containing layer may further include other additives such as a surfactant, a pH adjuster, a preservative, a fungicide, a dye, a pigment, and a color tone controlling agent.

9) Hydrophobic-Polymer-Containing Layer:

The "hydrophobic-polymer-containing layer" as referred to in the invention means a layer containing a hydrophobic polymer. The content of hydrophobic polymer is preferably 50 mass % to 100 mass %, more preferably 50 mass % to 75 mass %.

The hydrophobic-polymer-containing layer can be provided as the non-photosensitive intermediate layer or as the outermost layer. Preferably, the hydrophobic-polymer-containing layer is provided as the outermost layer. When the outermost layer is a hydrophobic-polymer-containing layer, it is possible to suppress sticking and change in image quality caused by a finger marks.

The term "hydrophobic polymer" used herein refers to a polymer having an equilibrium moisture content at 25° C. 60% RH of 5 mass % or less. The equilibrium moisture content at 25° C. 60%RH can be represented by the following equation: Equilibrium moisture content at 25° C. 60% RH=$\{(W1-W0)/W0\}\times 100$ (mass %), in which W1 is a weight of a polymer having an equilibrium moisture content in an atmosphere of 25° C. 60%RH, and W0 is a weight of the polymer in the bone-dry state at 25° C.

Definition and measuring methods of the moisture content is described in *Kobunshi Kogaku Koza* 14, *Kobunshi Zairyo Shikenho,* edited by The Society of Polymer Science, Japan, Chijin Shokan Co., Ltd., the disclosure of which is incorporated herein by reference.

The equilibrium moisture content at 25° C. 60% RH of the binder polymer is preferably 2 mass % or lower, more preferably 0.01 to 1.5 mass %, furthermore preferably 0.02 to 1 mass %.

In the invention, the glass transition temperature of the hydrophobic polymer is preferably from 0 ° C. to 80 ° C., more preferably from 10 ° C. to 70 ° C., and further preferably from 15 ° C. to 60 ° C.

Specific examples of the hydrophobic polymer which can be used in the hydrophobic-polymer-containing layer include the foregoing latexes usable in the non-photosensitive intermediate layer A, polyacrylates, polyurethanes, polymethacrylates, and latexes containing copolymers thereof.

Two or more binders may be used as necessary. In an embodiment, a binder having a glass transition temperature of 20 ° C. or higher and a binder having a glass transition point of lower than 20 ° C. are used simultaneously. When a blend of polymers having different Tg's are used, the mass-average Tg is preferably in the above-described range.

In a preferable embodiment, a coating liquid is prepared which includes a solvent comprising water in an amount of 30 mass % or more based on the amount of the solvent, then the coating liquid is applied and dried to form the hydrophobic-polymer-containing layer. The coating liquid preferably has an ionic conductivity of 2.5 mS/cm or lower, and such a coating liquid can be prepared by purifying a synthesized polymer using a separation membrane.

The above water-based solvent is preferably water or a mixed solvent of water and a water-miscible organic solvent, the proportion of the water-miscible organic solvent to the mixed solvent being 70 mass % or lower. Examples of the water-miscible organic solvent include alcohol solvents such as methyl alcohol, ethyl alcohol, and propyl alcohol; cellosolve solvents such as methyl cellosolve, ethyl cellosolve, and butyl cellosolve; ethyl acetate; and dimethylformamide.

The hydrophobic polymer is preferably dispersible in an aqueous solvent. The dispersion state of the polymer in the coating liquid may be a latex in which fine particles of a water-insoluble hydrophobic polymer are dispersed, or a dispersion (or emulsion) liquid in which polymer molecules are dispersed in the molecular or micell state. The latex dispersion is more preferable. The average particle diameter of the dispersed particles is 1 to 50,000 nm, preferably 5 to 1,000 nm, more preferably 10 to 500 nm, and furthermore preferably 50 to 200 nm. The particle size distribution of the dispersed particles is not particularly restricted, and may be a wide or monodisperse distribution. It is preferable to use two or more kinds of particles each having a monodisperse distribution so as to adjust the physical properties of the coating liquid.

Preferred examples of hydrophobic polymers dispersible in the aqueous solvents include hydrophobic polymers such as acrylic polymers, polyesters, rubbers (e.g. SBR resins), polyurethanes, polyvinyl chlorides, polyvinyl acetates, polyvinylidene chlorides, and polyolefins. The polymer may be linear, branched, or cross-linked, and may be a homopolymer derived form one monomer or a copolymer derived form two or more monomers. The copolymer may be a random copolymer or a block copolymer. The number-average molecular weight of the polymer is preferably 5,000 to 1,000,000, more preferably 10,000 to 200,000. When the number-average molecular weight is too small, the resultant image-forming layer tends to have insufficient strength. On the other hand, when the number-average molecular weight is too large, the polymer is poor in the film-forming properties. Further, cross-linkable polymer latexes are particularly preferable.

Specific examples of usable polymer latexes are described below. In the examples, the polymers are represented by the starting monomers, the numerals in parentheses represent the mass ratios (mass %) of the monomers, and the molecular weights are number-average molecular weights. The polymers using multifunctional monomers have cross-linked structures and the concept of the molecular weight cannot be implemented because of the cross-linked structures, whereby such polymers are referred to as cross-linked polymers and explanation of the molecular weight is omitted. Tg represent the glass-transition temperature.

NP-1; Latex of -MMA(70)-EA(27)-MAA(3)- (Molecular weight 37,000, Tg 61° C.)

NP-2; Latex of -MMA(70)-2EHA(20)-St(5)-AA(5)- (Molecular weight 40,000, Tg 59° C.)

NP-3; Latex of -St(50)-Bu(47)-MAA(3)- (Cross-linked polymer, Tg −17° C.)

NP-4; Latex of -St(68)-Bu(29)-AA(3)- (Cross-linked polymer, Tg 17° C.)

NP-5; Latex of -St(71)-Bu(26)-AA(3)- (Cross-linked polymer, Tg 24° C.)

NP-6; Latex of -St(70)-Bu(27)-IA(3)- (Cross-linked polymer)

NP-7; Latex of -St(75)-Bu(24)-AA(1)- (Cross-linked polymer, Tg 29° C.)

NP-8; Latex of -St(60)-Bu(35)-DVB(3)-MAA(2)- (Cross-linked polymer)

NP-9; Latex of -St(70)-Bu(25)-DVB(2)-AA(3)- (Cross-linked polymer)

NP-10; Latex of -VC(50)-MMA(20)-EA(20)-AN(5)-AA(5)- (Molecular weight 80,000)

NP-11; Latex of -VDC(85)-MMA(5)-EA(5)-MAA(5)- (molecular weight 67,000)

NP-12; Latex of -Et(90)-MAA(10)- (Molecular weight 12,000)

NP-13; Latex of -St(70)-2EHA(27)-AA(3)- (Molecular weight 130,000, Tg 43° C.)

NP-14; Latex of -MMA(63)-EA(35)-AA(2)- (Molecular weight 33,000, Tg 47° C.)

NP-15; Latex of -St(70.5)-Bu(26.5)-AA(3)- (Cross-linked polymer, Tg 23° C.)

NP-16; Latex of -St(69.5)-Bu(27.5)-AA(3)- (Cross-linked polymer, Tg 20.5° C.)

NP-17: Latex of -St(61.3)-isoprene(35.5)-AA(3)- (crosslinkable, Tg: 17° C.)

NP-18: Latex of -St(67)-isoprene(28)-Bu(2)-AA(3)- (crosslinkable, Tg: 27° C.)

The abbreviations in the above examples represent the following monomers.

MMA; Methyl methacrylate
EA; Ethyl acrylate
MAA; Methacrylic acid
2EHA; 2-Ethylhexyl acrylate
St; Styrene
Bu; Butadiene
AA; Acrylic acid
DVB; Divinylbenzene
VC; Vinyl chloride
AN; Acrylonitrile
VDC; Vinylidene chloride
Et; Ethylene
IA; Itaconic acid Commercially-available polymer latexes may be used in the invention, and examples thereof include acrylic polymers such as CEBIAN A-4635, 4718, and 4601 (available from Daicel Chemical Industries, Ltd.) and NIPOL LX811, 814, 821, 820, and 857 (available from Nippon Zeon Co., Ltd.); polyesters such as FINETEX ES650, 611, 675, and 850 (available from Dainippon Ink and Chemicals, Inc.) and WD-size and WMS (available from Eastman Chemical Co.); polyurethanes such as HYDRAN AP10, 20, 30, and 40 (available from Dainippon Ink and Chemicals, Inc.); rubbers such as LACSTAR 7310K, 3307B, 4700H, and 7132C (available from Dainippon Ink and Chemicals, Inc.) and NIPOL LX416, 410, 438C, and 2507 (available from Nippon Zeon Co., Ltd.); polyvinyl chlorides such as G351 and G576 (available from Nippon Zeon Co., Ltd.); polyvinylidene chlorides such as L502 and L513 (available from Asahi Kasei Kogyo K. K.); and polyolefins such as CHEMIPEARL S120 and SA100 (available from Mitsui Chemicals, Inc.).

Only a single latex may be used, or a blend of two more latexes may be used as necessary.

<Preferred Latex>

The polymer latex to be used in the hydrophobic polymer layer of the invention is preferably a copolymer of an acrylic polymer, polyester, or polyurethane. Also, the polymer latex to be used in the hydrophobic polymer layer of the invention preferably contains 1 to 6 mass % (more preferably 2 to 5 mass %) of acrylic acid or methacrylic acid. The polymer latex to be used in the hydrophobic polymer layer preferably contains acrylic acid.

The surfactant or high molecular compound such as polyvinyl alcohol and gelatin present in the polymer latex liquid has a function of improving the storage stability of the polymer latex liquid and largely changes the film water absorption and the film moisture absorption described above. For that reason, the type and amount of the surfactant or high molecular compound should be selected such that the polymer latex liquid of the invention is obtained. In that case, for the purpose of improving the stability of the polymer latex liquid, it is important to use an optimum acid species in an optimum amount at synthesis of the polymer latex.

<Coating Amount>

The amount of the hydrophobic polymer to be applied is preferably 0.1 to 10 g/m$^2$, more preferably 0.3 to 3 g/m$^2$, per 1 m$^2$ of the support.

The content of the hydrophobic polymer in the coating liquid is not particularly limited and is preferably controlled such that a viscosity suitable for simultaneous multilayer coating can be obtained. The content is generally 5 to 50 mass %, more preferably 10 to 40 mass %, still more preferably 15 to 30 mass %.

10) Matting Agent

In the invention, a matting agent is preferably added to improve the conveyability. The matting agent is described in JP-A No. 11-65021, Paragraphs 0126 and 0127, the disclosure of which is incorporated herein by reference. The amount of the matting agent to be applied per 1 m$^2$ of the photosensitive material is preferably 1 to 400 mg/m$^2$, more preferably 5 to 300 mg/m$^2$.

The matting agent may be delomorphous or amorphous, and is preferably delomorphous. The matting agent is preferably in a sphere shape.

The volume-weighted average equivalent sphere diameter of the matting agent provided on the emulsion surface is preferably 0.3 to 10 μm, more preferably 0.5 to 7 μm. The variation coefficient of the particle diameter distribution of the matting agent is preferably 5 to 80%, more preferably 20 to 80%. The variation coefficient is obtained according to the equation:

variation coefficient=(standard deviation of particle diameter)/(average particle diameter)×100.

Further, two or more types of the matting agents having different average particle diameters may be provided on the emulsion surface. In this case, the difference of the average particle diameters between the smallest matting agent and the largest matting agent is preferably 2 to 8 μm, more preferably 2 to 6 μm.

The volume-weighted average equivalent sphere diameter of the matting agent provided on the back surface is preferably 1 to 15 μm, more preferably 3 to 10 μm. The variation coefficient of the particle diameter distribution of the matting agent is preferably 3 to 50%, more preferably 5 to 30%. Further, two or more types of the matting agents having different average particle diameters may be provided on the back surface. In this case, the difference of the average particle diameters between the smallest matting agent and the largest matting agent is preferably 2 to 14 μm, more preferably 2 to 9 μm.

The mattness of the emulsion surface is not limited as long as star defects are not caused. The Bekk smoothness of the surface is preferably 30 to 2,000 seconds, particularly preferably 40 to 1,500 seconds. The Bekk smoothness can be easily obtained by *Method for testing smoothness of paper and paperboard* by Bekk tester according to JIS P8119, or TAPPI standard method T479, the disclosures of which are incorporated by reference herein.

The mattness of the back layer is preferably such that the Beck smoothness is 10 to 1,200 seconds. The Beck smoothness is more preferably 20 to 800 seconds, further preferably 40 to 500 seconds.

In the invention, the matting agent is preferably included in a layer or layers selected from the outermost layer, the layer functioning as the outermost layer, and a layer near the outermost layer.

11) Slipping Agent

In the invention, known slipping agents can be used for the purpose of improving the handling property at production and the scratch resistance at heat development. Examples thereof include liquid paraffin, a long-chain fatty acid, a fatty acid amide, and a fatty acid ester. The slipping agent is preferably liquid paraffin from which low-boiling ingredients have been removed, or a fatty acid ester with a molecular weight of 1,000 or more having a branched structure.

The slipping agent is preferably selected from the compounds described in JP-A No. 11-65021, paragraph 0117, JP-A Nos. 2000-5137, 2004-219794, 2004-219802, and 2004-334077, the disclosures of which are incorporated herein by reference.

The amount of the slipping agent may be 1 mg/m$^2$ to 200mg/m$^2$, preferably 10 mg/m$^2$ to 150 mg/m$^2$, more preferably 20 mg/M$^2$ to 100 mg/m$^2$.

The slipping agent may be added to the image-forming layer or to the non-photosensitive layer, preferably to the outermost layer from the viewpoints of improving the conveying property and scratch resistance.

12) Surfactant

Surfactants described in JP-A No. 11-65021 (the disclosure of which is incorporated herein by reference in its entirety), Paragraph 0132, solvents described in ibid, Paragraph 0133, supports described in ibid, Paragraph 0134, antistatic layers and conductive layers described in ibid, Paragraph 0135, methods for forming color images described in ibid, Paragraph 0136, and slipping agents described in JP-A No. 11-84573 (the disclosure of which is incorporated herein by reference in its entirety), Paragraph 0061 to 0064 and JP-A No. 2001-83679 (the disclosure of which is incorporated herein by reference in its entirety) Paragraph 0049 to 0062, can be used in the invention.

In the invention, it is preferable to use a fluorine-based surfactants. Specific examples of the fluorine-based surfactants include compounds described in JP-A Nos. 10-197985, 2000-19680, and 2000-214554, the disclosures of which are incorporated herein by reference. Further, fluorine-containing polymer surfactants described in JP-A No. 9-281636 (the disclosure of which is incorporated herein by reference) are also preferable in the invention. In an embodiment, the fluorine-based surfactants described in JP-A Nos. 2002-82411, 2003-057780, and 2003-149766 (the disclosures of which are incorporated herein by reference) are used in the photothermographic material of the invention. The fluorine-based surfactants described in JP-A Nos. 2003-057780 and 2001-264110 are particularly preferred from the viewpoints of the electrification control, the stability of the coating surface, and the slipping properties in the case of using an aqueous coating liquid. The fluorine-based surfactants described in JP-A No. 2001-264110 are most preferred because they are high in the electrification control ability and are effective even when used in a small amount.

In the invention, the fluorine-based surfactant may be used in the image-forming layer side and/or the back side, and is preferably used in both the image-forming layer side and the back side. It is particularly preferable to use a combination of the fluorine-based surfactant and the above-described conductive layer including a metal oxide. In this case, sufficient performance can be achieved even if the fluorine-based surfactant in the electrically conductive layer side is reduced or removed.

The amount of the fluorine-based surfactant used on each of the image-forming layer side and the back side is preferably 0.1 to 100 mg/m$^2$, more preferably 0.3 to 30 mg/m$^2$, further preferably 1 to 10 mg/m$^2$. In particular, the fluorine-based surfactants described in JP-A No. 2001-264110 can exhibit excellent effects, whereby the amount thereof is preferably 0.01 to 10 mg/m$^2$, more preferably 0.1 to 5 mg/m$^2$.

13) Antihalation Layer

In the photothermographic material of the invention, an antihalation layer may be disposed such that the antihalation layer is farther from the exposure light source than the image-forming layer is.

The antihalation layer is described, for example, in JP-A No. 11-65021, Paragraphs 0123 to 0124, JP-A Nos. 11-223898, 9-230531, 10-36695, 10-104779, 11-231457, 11-352625, and 11-352626, the disclosures of which are incorporated herein by reference.

The antihalation layer includes an antihalation dye having absorption in the exposure wavelength range. When the exposure wavelength is within the infrared range, an infrared-absorbing dye may be used as the antihalation dye, and the infrared-absorbing dye is preferably a dye which does not absorb visible light.

When a dye having absorption in the visible light range is used to prevent the halation, in a preferable embodiment, the color of the dye does not substantially remain after image formation. It is preferable to achromatize the dye by heat at the heat development. In a more preferable embodiment, a base precursor and a thermally-achromatizable dye are added to a non-photosensitive layer so as to impart the antihalation function to the non-photosensitive layer. These techniques are described, for example in JP-A No. 11-231457, the disclosure of which is incorporated by reference herein.

The amount of the achromatizable dye to be applied may be determined depending on the purpose. Generally, the amount of the achromatizable dye is selected such that the optical density (the absorbance) exceeds 0.1 at the desired wavelength. The optical density is preferably 0.15 to 2, more preferably 0.2 to 1. The amount of the dye required for obtaining such an optical density is generally 0.001 to 1 g/m$^2$.

When the dye is achromatized in this manner, the optical density after the heat development can be lowered to 0.1 or lower. In an embodiment, two or more achromatizable dyes are used in combination in a thermally achromatizable recording material or a photothermographic material. Similarly, two or more base precursors may be used in combination.

In the thermal achromatization, it is preferable to use an achromatizable dye, a base precursor, and a substance which can lower the melting point of the base precursor by 3° C. or more when mixed with the base precursor, in view of the thermal achromatizability, as described in JP-A No. 11-352626, the disclosure of which is incorporated by reference herein. Examples of the substance include diphenylsulfone, 4-chlorophenyl(phenyl)sulfone, and 2-naphtyl benzoate.

14) Polymer Latex

When the photothermographic material of the invention is used for printing, in which dimensional change is problematic, it is preferable to use a polymer latex in a surface protective layer and/or a back layer. Such a polymer latex is described, for example, in *Gosei Jushi Emulsion,* (compiled by Taira Okuda and Hiroshi Inagaki, issued by Kobunshi Kanko Kai (1978)); *Gosei Latex no Oyo,* (compiled by Takaaki Sugimura, Yasuo Kataoka, Souichi Suzuki, and Keishi Kasahara, issued by Kobunshi Kanko Kai (1993); *Gosei Latekkusu no Kagaku* (written by Soichi Muroi, issued by Kobunshi Kanko Kai (1970)), the disclosures of which are incorporated herein by reference. Specific examples thereof include latex of methyl methacrylate (33.5 mass %)—ethyl acrylate (50 mass %)—methacrylic acid (16.5 mass %) copolymer, latex of methyl methacrylate (47.5 mass %)—butadiene (47.5 mass %)—itaconic acid (5 mass %) copolymer, latex of ethyl acrylate—methacrylic acid copolymer, latex of methyl methacrylate (58.9 mass %)—2-ethylhexyl acrylate (25.4 mass %)—styrene (8.6 mass %)—2-hydroxyethyl methacrylate (5.1 mass %)—acrylic acid (2.0 mass %) copolymer, and latex of methyl methacrylate (64.0 mass %)—styrene (9.0 mass %)—butyl acrylate (20.0 mass %)—2-hydroxyethyl methacrylate (5.0 mass %)—acrylic acid (2.0 mass %) copolymer. Further, regarding the binder for the surface protective layer, the combinations of polymer latexes described in JP-A No. 2000-267226, the technique described in paragraph Nos. 0021 to 0025 of JP-A No. 2000-267226, the technique described in paragraph nos. 0027 to 0028 of Japanese Patent Application No. 11-6872, and the technique described in paragraph Nos. 0023 to 0041 of JP-A No. 2000-19678 may also be applied, the disclosures of which are incorporated herein by reference. The proportion of amount of the polymer latex to the total amount of binder in the surface protective layer is preferably 10 mass % to 90 mass %, more preferably 20 mass % to 80 mass %.

15) Film Surface pH

The photothermographic material of the invention before heat development preferably has a film surface pH of 7.0 or lower. The film surface pH is more preferably 6.6 or lower. The lower limit of the film surface pH may be approximately 3, though it is not particularly restricted. The film surface pH is still more preferably 4 to 6.2. It is preferable to adjust the film surface pH using an organic acid such as a phthalic acid derivative, a nonvolatile acid such as sulfuric acid, or a volatile base such as ammonia, from the viewpoint of lowering the film surface pH. In order to achieve a low film surface pH, it is preferable to use ammonia since ammonia is high in volatility and can be removed during coating or before heat development. It is also preferable to use ammonia in combination with a nonvolatile base such as sodium hydroxide, potassium hydroxide, or lithium hydroxide. Methods for measuring the film surface pH are described in JP-A No. 2000-284399, Paragraph 0123, the disclosure of which is incorporated herein by reference.

16) Antistatic Agent

The photothermographic material of the invention preferably comprises an electrically conducting layer including an electrically conductive material such as a metal oxide or an electrically conductive polymer. The electrically conducting layer (antistatic layer) may be the same layer as a layer selected from the undercoat layer, the back surface protective layer, and the like, or may be provided as a separate layer which is different from those layers. The conductive material in the antistatic layer is preferably a metal oxide whose conductivity has been heightened by incorporation of oxygen defects and/or hetero-metal atoms.

The metal oxide is preferably ZnO, $TiO_2$, or $SnO_2$. It is preferable to add Al or In to ZnO. It is preferable to add Sb, Nb, P, a halogen atom, or the like to $SnO_2$. It is preferable to add Nb, Ta, or the like to $TiO_2$. $SnO_2$ to which Sb has been added is particularly preferable conductive substance for the electrically conducting layer. The amount of the hetero atom is preferably 0.01 to 30 mol %, more preferably 0.1 to 10 mol %. The particles of the metal oxide may be in a spherical shape, in a needle shape, or in a plate shape. The metal oxide particles are preferably needle-shaped particles with the ratio of the major axis to the minor axis of 2.0 or higher in view of the conductivity, and the ratio is more preferably 3.0 to 50. The amount of the metal oxide is preferably 1 to 1,000 mg/m 2, more preferably 10 to 500 mg/$m^2$, furthermore preferably 20 to 200 mg/$m^2$. The antistatic layer may be provided on the image-forming layer side or on the back side. In a preferable embodiment, the antistatic layer is provided between the support and the back layer. Specific examples of the antistatic layer are described in JP-A No. 11-65021, Paragraph 0135; JP-A Nos. 56-143430, 56-143431, 58-62646, and 56-120519; JP-A No. 11-84573, Paragraph 0040 to 0051; U.S. Pat. No. 5,575,957; and JP-A No. 11-223898, Paragraph 0078 to 0084; the disclosures of which are incorporated herein by reference.

17) Support

The support comprises preferably a heat-treated polyester, particularly a polyethylene terephthalate, which is subjected to a heat treatment at 130 to 185° C. so as to relax the internal strains of the film generated during biaxial stretching, thereby eliminating the heat shrinkage strains during heat development. In the case of a photothermographic material for medical use, the support may be colored with a blue dye (e.g., Dye-1 described in Examples of JP-A No. 8-240877, the disclosure of which is incorporated herein by reference) or uncolored. The support is preferably undercoated, for example, with a water-soluble polyester described in JP-A No. 11-84574, a styrene-butadiene copolymer described in JP-A No. 10-186565, a vinylidene chloride copolymer described in JP-A No. 2000-39684 or Japanese Patent Application No. 11-106881, Paragraph 0063 to 0080, the disclosures of which are incorporated herein by reference. When the support is coated with the image-forming layer or the back layer, the support preferably has a moisture content of 0.5 mass % or lower.

18) Other Additives

The photothermographic material of the invention may further include additives such as antioxidants, stabilizing agents, plasticizers, UV absorbers, and coating aids. The additives may be added to any one of the image-forming layer and the non-photosensitive layers. The additives may be used with reference to WO 98/36322, EP-A 803764A1, JP-A Nos. 10-186567 and 10-18568, the disclosures of which are incorporated herein by reference.

19) Other Technologies

Other technologies usable for the photothermographic material of the invention include those described in EP-A 803764A1, EP-A 883022A1, WO 98/36322, and JP-A Nos. 56-62648, 58-62644, 9-43766, 9-281637, 9-297367, 9-304869, 9-311405, 9-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, 2001-200414, 2001-234635, 2002-020699, 2001-275471, 2001-275461, 2000-313204, 2001-292844, 2000-324888, 2001-293864, 2001-348546, and 2000-187298, the disclosures of which are incorporated herein by reference.

Image Forming Method

1) Exposure

The exposure light source may be a red to infrared emission laser such as a He—Ne laser and a red semiconductor laser, or a blue to greed emission laser such as an $Ar^+$ laser, an He—Ne laser, an He—Cd laser, and a blue semiconductor laser. The laser is preferably a red to infrared emission semiconductor laser, and the peak wavelength of the laser is 600 to 900 nm, preferably 620 to 850 nm.

In recent years, a blue semiconductor laser and a module comprising an SHG (Second Harmonic Generator) and a semiconductor laser have been developed, and thus laser output units with short wavelength ranges have attracted a lot of attention. Blue semiconductor lasers can form a highly fine image, can increase recording density, is long-lived, and has stable output, whereby the demand for blue semiconductor lasers is expected to be increased. The peak wavelength of the blue laser is preferably 300 to 500 nm, more preferably 400 to 500 nm.

In a preferable embodiment, the laser light is emitted in vertical multimode by high frequency superposition, etc.

2) Heat Development

The photothermographic material of the invention may be developed by any method, but is generally exposed imagewise and then heat-developed. The development temperature is preferably 80 to 250° C., more preferably 100 to 140° C., further preferably 110 to 130° C. The development time is preferably 1 to 60 seconds, more preferably 3 to 30 seconds, furthermore preferably 5 to 25 seconds, particularly preferably 7 to 15 seconds.

Heat development may be conducted by a drum heater or a plate heater, preferably by a plate heater. A heat development method using a heat development apparatus comprising a plate heater described in JP-A No. 11-133572 (the disclosure of which is incorporated herein by reference) can be preferably used in the invention. The heat development apparatus comprises a heat developing section, and a visible image is formed by: forming a latent image on a photothermographic material, and bringing the material into contact with a heating unit in the heat developing section. In the heat development apparatus, the heating unit comprises the plate heater, a plurality of press rollers facing each other are arranged along one surface of the plate heater, and the photothermographic material is passed between the press rollers and the plate heater to be heat-developed. In a preferable embodiment, the plate heater is divided into two to six stages and the temperature of the end part is lowered by approximately 1 to 10° C. For example, four plate heaters may be independently controlled at 112° C., 119° C., 121° C., and 120° C. Such a method is described also in JP-A No. 54-30032, the disclosure of which is incorporated by reference herein. In the method, water and organic solvents included in the photothermographic material can be removed, and deformation of the support caused by rapid heating can be prevented.

To reduce the size of the heat development apparatus and the heat development time, more stable control of the heater is preferred. In an embodiment, the heat development of the leading end of the photothermographic material is started before the rear end is exposed. Rapid processing type imagers preferred for the invention are described in JP-A Nos. 2002-289804 and 2003-285455, the disclosures of which are incorporated herein by reference. When such an imager is used, for example, the photothermographic material can be heat-developed in 14 seconds by a plate heater having three stages controlled at 107° C., 121° C., and 121° C. respectively, and the first sheet of the material can be outputted in about 60 seconds. In such rapid development, it is preferable to use the photothermographic material of the invention, which is high in the sensitivity and hardly affected by ambient temperature.

3) System

Fuji Medical Dry Laser Imager FM-DPL and DRYPIX 7000 and Kodak DRYVIEW 8700 Laser Imager Plus are known as laser imagers for medical use comprising an exposure region and a heat developing region. FM-DPL is described in *Fuji Medical Review,* No. 8, Page 39 to 55 (the disclosure of which is incorporated herein by reference), and the technologies disclosed therein can be applied to the invention. The photothermographic material of the invention can be used for the laser imager in AD Network, proposed by Fuji Film Medical Co., Ltd. as a network system according to DICOM Standards.

(Application of the Invention)

The photothermographic material of the invention forms black and white images of silver and is preferably used as a photothermographic material for medical diagnosis, industrial photography, printing, or COM.

EXAMPLES

The present invention is to be described specifically by way of Examples. However, Examples should not be construed as limiting the invention.

Example 1

1. Preparation of PET Support

1) Film Preparation

PET with an inherent viscosity IV=0.66 (measured in phenol/tetrachloroethane=6/4 (weight ratio) at 25° C.) was prepared using terephthalic acid and ethylene glycol in accordance with a usual method. After pelleting the product, it was dried at 130° C. for 4 hours, melted at 300° C., and then extruded from a T die and cooled rapidly to prepare a non-stretched film.

The film was stretched longitudinally by 3.3 times at 110° C. using rolls of different circumferential speeds and then stretched laterally by 4.5 times at 130° C. by a tenter. Subsequently, it was thermally set at 240° C. for 20 sec and then relaxed by 4% in the lateral direction at the same temperature. Then, after slitting the chuck portion of the tenter, both ends thereof were knurled, and the film was taken up under 4 kg/cm$^2$, to obtain a roll with a thickness of 175 μm.

2) Surface Corona Treatment

Both surfaces of the support were treated by a solid state corona processing machine model 6 KVA manufactured by Pillar Co. at room temperature at 20 m/min. Based on the measured current and voltage, it was found that a treatment at 0.375 kV·A·min/m$^2$ was applied to the support. The processing frequency was 9.6 kHz and the gap clearance between the electrode and the dielectric roll was 1.6 mm.

3) Undercoating

| Preparation of undercoating layer coating liquid | |
|---|---|
| Formulation (1) (for undercoating layer on the image-forming layer side) | |
| PESRESIN A-520 (30 mass % solution) manufactured by Takamatsu Oils and Fats Co., Ltd. | 46.8 g |
| VYLONAL MD-1200 manufactured by Toyo Boseki Co. | 10.4 g |
| 1 mass % solution of polyethylene glycol mono nonyl phenyl ether (average ethylene oxide number = 8.5) | 11.0 g |
| MP-1000 (PMMA fine polymer particles, average particle diameter 0.4 μm) manufactured by Soken Kagaku Co. | 0.91 g |
| Distilled water | 931 ml |
| Formulation (2) (for first layer on back surface) | |
| Styrene-butadiene copolymer latex (solid content 40 mass %, styrene/butadiene mass ratio = 68/32) | 130.8 g |
| Aqueous 8 mass % solution of sodium salt of 2.4-dichloro-6-hydroxy-S-triazine | 5.2 g |
| Aqueous 1 mass % solution of sodium lauryl benzene sulfonate | 10 ml |
| Polystyrene particle dispersion (average particle diameter 2 μm, 20 mass %) | 0.5 g |
| Distilled water | 854 ml |

-continued

| Preparation of undercoating layer coating liquid | |
|---|---|
| Formulation (3) (for second layer on back surface) | |
| $SnO_2$/SbO (9/1 mass ratio, average particle diameter 0.5 μm, 17 mass % dispersion) | 84 g |
| Gelatin | 7.9 g |
| METROSE TC-5 (aqueous 2 mass % solution) manufactured by Shinetsu Chemical Industry Co. | 10 g |
| Aqueous 1 mass % solution of sodium dodecylbenzene sulfonate | 10 ml |
| NaOH (1 mass %) | 7 g |
| PROXEL (manufactured by Avecia Co.) | 0.5 g |
| Distilled water | 881 ml |

Undercoating

After applying the corona discharging treatment described above to both surfaces of the biaxially stretched polyethylene terephthalate support having a thickness of 175 μm, the undercoating coating liquid formulation (1) described above was coated on one side (side on which image-forming layer was to be provided) by a wire bar in a wet coating amount of 6.6 ml/$m^2$ (per one side), and then dried at 180° C. for 5 min. Then, the undercoating coating liquid formulation (2) described above was coated on the rear face (back side) thereof by a wire bar in a wet coating amount of 5.7 ml/$m^2$ and dried at 180° C. for 5 min. Further, the undercoating coating liquid formulation (3) described above was coated on the rear face (back side) by a wire bar in a wet coating amount of 8.4 ml/$m^2$, and dried at 180° C. for 6 min to prepare an undercoated support.

Back Layer

1) Preparation of Back Layer Coating Liquid (Preparation of Solid Fine Particle Dispersion Liquid (a) of Base Precursor)

2.5 kg of a base precursor compound 1, 300 g of a surfactant (trade name: DEMOL N, manufactured by Kao Corporation), 800 g of diphenylsulfone, 1.0 g of a benzoisothiazolinone sodium salt, and distilled water to make the total amount to 8.0 kg were mixed, and the mixed solution was dispersed with beads by using a lateral sand mill (UVM-2, manufactured by Aimex Co., Ltd.). In the dispersing, the mixed solution was fed into UVM-2 charged with zirconia beads having a mean diameter of 0.5 mm by a diaphragm pump and dispersed at an inner pressure of 50 hPa or more until a desired mean particle size was obtained.

The dispersing operation was continued until the dispersion liquid, when subjected to spectral absorption measurement, had a ratio of absorbance at 450 nm to absorbance at 650 nm ($D_{450}/D_{650}$) of 3.0. The resulting dispersion liquid was diluted with distilled water such that the concentration of the base precursor became 25 mass %. In order to eliminate contaminants, the diluted dispersion liquid was filtered (by using a polypropylene-made filter having an average pore size of 3 μm) and then put into practical use.

2) Preparation of Dye Solid Particle Dispersion Liquid 6.0 kg of a cyanine dye compound 1, 3.0 kg of sodium p-dodecylbenzene sulfonate, 0.6 kg of a surfactant DEMOL SNB (manufactured by Kao Corporation), and 0.15 kg of a defoaming agent (a trade name: SURFYNOL 104E, manufactured by Nissin Chemical Industry Co., Ltd.) were mixed with distilled water to make the total liquid amount to 60 kg. The mixed solution was dispersed with 0.5-mm zirconia beads by using a lateral sand mill (UVM-2, manufactured by Aimex Co., Ltd.).

The dispersing operation was continued until the dispersion, when subjected to spectral absorption measurement, had a ratio of absorbance at 650 nm to absorbance at 750 nm ($D_{650}/D_{750}$) of 5.0 or higher. The resulting dispersion was diluted with distilled water such that the concentration of the cyanine dye became 6 mass %. In order to eliminate contaminants, the diluted dispersion was filtered by using a filter (average pore size: 1 μm) and then put into practical use.

3) Preparation of Antihalation Layer Coating Liquid

A vessel was kept at a temperature of 40° C. 37 g of gelatin with an isoelectric point of 6.6 (ABA Gelatin, manufactured by Miyagi Chemical Industry Co.), 0.1 g of benzoisothiazolinone and water were added to the vessel, and the gelatin was dissolved. Further, 36 g of the foregoing dye solid particle dispersion liquid, 73 g of the foregoing solid fine particle dispersion liquid (a) of base precursor, 43 ml of an aqueous 3 mass % solution of sodium polystyrene sulfonate, and 82 g of a 10 mass % liquid of SBR latex (styrene/butadiene/acrylic acid copolymer; mass ratio 68.3/28.7/3.0), were added thereto to give 773 ml of an anantihalation layer coating liquid. The pH value of the obtained antihalation layer coating liquid was 6.3.

4) Preparation of Back Surface Protective Layer Coating Liquid

A vessel was kept at a temperature of 40° C. 43 g of gelatin with an isoelectric point of 4.8 (PZ Gelatin, manufactured by Miyagi Chemical Industry Co.), 0.21 g of benzoisothiazolinone and water were added to the vessel and the gelatin was dissolved. Further, 8.1 ml of a 1 mol/L aqueous solution of sodium acetate, 0.93 g of fine particles of mono-dispersed poly(ethylene glycol dimethacrylate-co-methylmethacrylate) (average particle diameter: 7.7 μm , standard deviation of particle diameter: 0.3 μm), 5 g of a 10 mass % emulsion of liquid paraffin, 10 g of a 10 mass % emulsion of dipentaerythritol hexaisostearate, 10 ml of an aqueous 5 mass % solution of sodium salt of di(2-ethylhexyl) sulfosuccinate, 17 ml of an aqueous 3 mass % solution of sodium polystyrene sulfonate, 2.4 ml of a 2 mass % solution of a fluorine-based surfactant (F-1), 2.4 ml of a 2 mass % solution of a fluorine-based surfactant (F-2), and 30 ml of a 20 mass % latex of ethyl acrylate/acrylic acid copolymer (copolymerization mass ratio 96.4/3.6) were mixed with the gelatin solution. Just before coating, 50 ml of an aqueous 4 mass % solution of N,N-ethylenebis(vinylsulfone acetamide) was added thereto to form a back surface protective layer coating liquid with a final liquid quantity of 855 ml. The pH value of the obtained liquid was 6.2.

5) Coating of Back Layer

On the back surface of the undercoated support, the antihalation layer coating liquid and the back surface protective layer coating liquid were simultaneously coated by multi-layer coating method, and then dried to form a back layer. The coating amount of the antihalation layer coating liquid was such an amount that the gelatin coating amount was 0.54 g/m$^2$. The coating amount of the back surface protective layer coating liquid was such an amount that the gelatin coating amount was 1.85 g/m$^2$.

(Image-Forming Layer, Intermediate Layer and Surface Protective Layer)

1. Preparation of Coating Material

1. Preparation of Coating Material:

1) Silver Halide Emulsion

<Preparation of Silver Halide Emulsion 1>

3.1 ml of 1 mass % potassium bromide solution was added to 1421 ml of distilled water. Then, 3.5 ml of sulfuric acid at 0.5 mol/l concentration and 31.7 g of phthalated gelatin were added thereto. The mixture was stirred in a stainless steel reaction pot while its temperature was kept at 30° C. Separately, a solution A was prepared by adding distilled water to 22.22 g of silver nitrate such that the total volume became 95.4 ml. A solution B was prepared by adding distilled water to 15.3 g of potassium bromide and 0.8 g of potassium iodide such that the total volume became 97.4 ml. The entire solution A and the entire solution B were added to the reaction pot at a constant flow rate over 45 sec.

Then, 10 ml of an aqueous 3.5 mass % hydrogen peroxide solution was added thereto and, further, 10.8 ml of an aqueous 10 mass % benzimidazole solution was added thereto. Separately, a solution C was prepared by adding distilled water to 51.86 g of silver nitrate such that the total volume became 317.5 ml. A solution D was prepared by adding distilled water to 44.2 g of potassium bromide and 2.2 g of potassium iodide such that the total volume became 400 ml. The solutions C and D were added to the above mixture by a controlled double jet method; the entire solution C was added at a constant flow rate over 20 min, and the solution D was added while pAg of the solution D was maintained at 8.1.

Potassium hexachloro iridate (III) was added to the above mixture 10 min after the start of addition of the solutions C and D such that its concentration became $1\times10^{-4}$ mol per one mol of silver. Further, an aqueous solution of potassium hexacyano ferrate (II) was added in an amount of $3\times10^{-4}$ mol per one mol of silver 5 sec after the completion of addition of the solution C. The pH of the mixture was adjusted to 3.8 using sulfuric acid at 0.5 mol/L concentration, and stirring was stopped. Then, sedimentation, desalting, and water washing were conducted. The pH was adjusted to 5.9 using sodium hydroxide at 1 mol/L concentration to prepare a silver halide dispersion having a pAg of 8.0.

The silver halide dispersion was kept at 38° C. while stirred. 5 ml of 0.34 mass % solution of 1,2-benzoisothiazoline-3-one in methanol was added thereto. 40 min later, the temperature of the dispersion was elevated to 47° C. 20 min after the temperature elevation, a solution of sodium benzenethiosulfonate in methanol was added thereto such that the concentration of sodium benzenethiosulfonate became $7.6\times10^{-5}$ mol per one mol of silver. 5 min later, a solution of a tellurium sensitizer C in methanol was added thereto such that the concentration of tellurium sensitizer C became $2.9\times10^{-4}$ mol per one mol of silver. Then, the dispersion was subjected to aging for 91 min.

Then, a methanol solution of spectral sensitizing dyes A and B in a molar ratio of 3:1 was added to the dispersion such that the total quantity of the sensitizing dyes A and B became $1.2\times10^{-3}$ mol per one mol of silver. One min later, 1.3 ml of a 0.8 mass % solution of N,N'-dihydroxy-N"-ethylmelamine in methanol was added to the dispersion. 4 min later, a solution of 5-methyl-2-mercaptobenzimidazole in methanol, a solution of 1-phenyl -2-heptyl-5-mercapto-1,3,4-triazole in methanol, and a solution of 1-(3-methylureidophenyl)-5-mercaptotetrazole in water were added to the dispersion such that the concentration of 5-methyl-2-mercaptobenzimidazole became $4.8\times10^{-3}$ mol per one mol of silver, the concentration of 1-phenyl-2-heptyl-5-mercapto-1,3,4-triazole became $5.4\times10^{-3}$ mol per one mol of silver, and the concentration of an aqueous solution of 1-(3-methylureidophenyl)-5-mercaptotetrazole was $8.5\times10^{-3}$ mol per one mol of silver. In this way, a silver halide emulsion 1 was obtained.

The grains in the silver halide emulsion thus prepared were silver iodobromide grains with an average equivalent sphere diameter of 0.042 μm and a variation coefficient of equivalent sphere diameter of 20% homogeneously containing 3.5 mol % of iodide. The grain diameter and the like were determined based on the average of 1000 grains using an electron microscope. The [100] face ratio of the grain was determined by the Kubelka-Munk method, and was found to be 80%.

<Preparation of Silver Halide Emulsion 2>

A silver halide emulsion 2 was prepared in the same manner as in the preparation of the silver halide emulsion 1 except that the liquid temperature upon grain formation was changed from 30° C. to 47° C., that the solution B was obtained by adding distilled water to 15.9 g of potassium bromide to make the total volume 97.4 ml, that the solution D was obtained by adding distilled water to 45.8 g of potassium bromide to make the total volume 400 ml, that the addition time of the solution C was changed to 30 min, and that potassium hexacyano ferrate (II) was omitted. Sedimentation, desalting, water washing, and dispersing operations were conducted in the same manner as in the preparation of the silver halide emulsion 1. Spectral sensitization, chemical sensitization, and addition of 5-methyl-2-mercaptobenzimidazole and 1-phenyl-2-heptyl-5-mercapto-1,3,4-triazole was conducted in the same manner as in the preparation of the silver halide emulsion 1 except that the addition amount of the tellurium sensitizer C was changed to $1.1\times10^{-4}$ mol per one mol of silver, that the addition amount of the methanol solution of the spectral sensitizing dyes A and B in the molar ratio of 3:1 was changed to $7.0\times10^{-4}$ mol per one mol of silver in terms of the total amount of the sensitizing dyes A and B, that the addition amount of 1-phenyl-2-heptyl-5-mercapto-1,3,4-triazole was changed to $3.3\times10^{-3}$ mol per one mol of silver, and that the addition amount of 1-(3-methylureidophenyl)-5-mercaptotetrazole was changed to $4.7\times10^{-3}$ mol per one mol of silver. The silver halide emulsion 2 was obtained in this manner.

The emulsion grains of the silver halide emulsion 2 were pure silver bromide cubic grains with an average equivalent sphere diameter of 0.080 μm and a variation coefficient of the equivalent sphere diameter of 20%.

<Preparation of Silver Halide Emulsion 3>

A silver halide emulsion 3 was prepared in the same manner as in the preparation of the silver halide emulsion 1 except for changing the liquid temperature upon grain formation from 30° C. to 27° C.

Sedimentation, desalting, water washing, and dispersion operations were conducted in the same manner as in the preparation of the silver halide emulsion 1. A silver halide emulsion 3 was obtained in the same manner as in the preparation of the silver halide emulsion 1 except that the addition amount of the tellurium sensitizer C was changed to $5.2\times10^{-4}$ mol per one mol of silver, that a solid dispersion (in aqueous gelatin solution) of the spectral sensitizing dyes A and B in the molar ratio of 1:1 was added in an amount of $6.0\times10^{-3}$ mol per one mol of silver in terms of the total amount of the sensitizing dyes A and B instead of the methanol solution of the spectral sensitizing dyes A and B, that $5\times10^{-4}$ mol of bromoauric acid per one mol of silver and $2\times10^{-3}$ mol of potassium thiocyanate per one mol of silver were added 3 min after the addition of the tellurium sensitizer. The emulsion grains of the silver halide emulsion 3 were silver iodobromide grains with an average equivalent sphere diameter of 0.034 μm and with a variation coefficient of the equivalent sphere diameter of 20% homogeneously containing 3.5 mol % of iodide.

(Preparation of Mixed Emulsion A for Coating Liquid)

70 mass % of the silver halide emulsion 1, 15 mass % of the silver halide emulsion 2, and 15 mass % of the silver halide emulsion 3 were mixed, and an aqueous 1 mass % solution of benzothiazolium iodide was added thereto such that the concentration of the benzothiazolium iodide became $7\times10^{-3}$ mol per one mol of silver.

Then, compound 1, 2, and 3 whose 1-electron oxidized forms formed by 1-electron oxidation each can release 1 electron or more electrons were added thereto each in an amount of $2\times10^{-3}$ mol per 1 mol of silver halide. Further, adsorbent redox compounds 1 and 2 each in an amount of $5\times10^{-3}$ mol per 1 mol of silver halide were added thereto. The adsorbent redox compounds 1 and 2 each had an adsorbent group and a reducing group.

Thereafter, water was added such that the content of the silver halide per 1 kg of the mixed emulsion for coating liquid was 38.2 g in terms of the silver amount. Further, 1-(3-Methylureidophenyl)-5-mercaptotetrazole in an amount of 0.34 g per 1 kg of the mixed emulsion for coating liquid was further added.

<<Preparation of Fatty acid Silver Salt Dispersion>>

88 kg of recrystallized behenic acid, 422 L of distilled water, 49.2 L of a 5 mol/L aqueous solution of NaOH and 120 L of t-butyl alcohol were mixed and allowed to react at 75° C. for one hour under stirring to form a sodium behenate solution B. Separately, 206.2 L of an aqueous solution (pH 4.0) containing 40.4 kg of silver nitrate was prepared and kept at 10° C. To a mixture of 635 L of distilled water and 30 L of t-butyl alcohol contained in a reaction vessel kept at 30° C. were added the entire volume of the above-mentioned sodium behenate solution B and the entire volume of the aqueous silver nitrate solution under sufficient stirring at constant flow rates over the periods of 93 minutes and 15 seconds, and 90 minutes, respectively; in this operation, only the aqueous silver nitrate solution was added during a period within 11 minutes from the initiation of the addition of the aqueous silver nitrate solution, and then the addition of the sodium behenate solution B was started, and then the addition of the aqueous silver nitrate solution was completed, so that only the sodium behenate solution B was added during a period within 14 minutes and 15 seconds from the completion of the addition of the aqueous silver nitrate solution. In this operation, the outside temperature was controlled so that the temperature in the reaction vessel was maintained at 30° C. and the liquid temperature was kept constant. The pipe of the addition system for the sodium behenate solution B was warmed by circulating warmed water in the space between the outer pipe and the inner pipe of a double pipe, and temperature was controlled such that the liquid temperature at the outlet orifice of the addition nozzle was 75° C. The pipe of the addition system for the aqueous silver nitrate solution was maintained at a constant temperature by circulating cold water in the space between the outer pipe and the inner pipe of a double pipe. The addition position of the sodium behenate solution B and the addition position of the aqueous silver nitrate solution were arranged symmetrically with respect to the stirring axis as a center, and the positions had such heights as not to contact with the reaction solution.

After finishing the addition of the sodium behenate solution B, the mixture was left under stirring for 20 minutes at the same temperature, and then the temperature was increased to 35° C. over 30 minutes, followed by aging for 210 minutes. After finishing the aging, the solid content was immediately separated by centrifugal filtration and washed with water until an electric conductivity of the filtrate became 30 μS/cm. Thus, a fatty acid silver salt was obtained. The obtained solid content was stored as a wet cake without being dried.

When the shape of the obtained silver behenate grains was evaluated by electron microscopic photography, it was found that the grains were crystals having a=0.21 μm, b=0.4 μm, and c=0.4 μm in average values, an average aspect ratio of 2.1, and an average equivalent-sphere diameter variation coefficient of 11% (a, b and c have the meanings defined above).

To the wet cake corresponding to 260 kg of the dry solid content were added 19.3 kg of polyvinyl alcohol (trade name: PVA-217) and water to make the total amount 1000 kg, and the mixture was made into slurry by a dissolver fin and further pre-dispersed by a pipeline mixer (PM-10 type, manufactured by Mizuho Industrial Co., Ltd.).

Then, the pre-dispersed liquid was dispersed three times by using a disperser (trade name: Microfluidizer M-610, manufactured by Microfluidex International Corporation, using Z type interaction chamber) with a pressure controlled at 1150 kg/cm$^2$ to obtain a silver behenate dispersion. A dispersion temperature of 18° C. was achieved by providing coiled heat exchangers fixed in front of and behind the interaction chamber and controlling the temperature of refrigerant.

3) Preparation of Reducing Agent Dispersion

<Preparation of Reducing Agent 1 Dispersion>

10 kg of water was added to a mixture of 10 kg of a reducing agent 1 (2,2'-methylenebis-(4-ethyl-6-tert-butylphenol)) and 16 kg of an aqueous 10 mass % solution of modified polyvinyl alcohol (POVAL MP203, manufactured by Kuraray Co.) and they were mixed thoroughly to form a slurry. The slurry was fed by a diaphragm pump, and was dispersed for 3 hrs by a horizontal sand mil (UVM-2; manufactured by Imex Co.) filled with zirconia beads with an average diameter of 0.5 mm. Then 0.2 g of sodium salt of benzoisothiazolinone and water were added thereto such that the concentration of the reducing agent became 25 mass %. The obtained dispersion was heated to 60° C. and kept at 60° C. for 5 hours to form a reducing agent 1 dispersion. The reducing agent particles contained in the thus obtained reducing agent dispersion had a median diameter of 0.40 μm and a maximum particle diameter of 1.4 μm or less. The obtained reducing agent dispersion was filtered through a polypropylene filter of 3.0 μm pore size so that contaminants such as dusts were removed. The reducing agent dispersion was then stored.

<Preparation of Reducing Agent 2 Dispersion>

10 kg of water was added to a mixture of 10 kg of a reducing agent 2 (6,6'-di-t-butyl-4,4'-dimethyl-2,2'-butylidene diphenol) and 16 kg of an aqueous 10 mass % solution of modified polyvinyl alcohol (POVAL MP203, manufactured by Kuraray Co.) and they were mixed thoroughly to form a slurry. The slurry was fed by a diaphragm pump, and was dispersed for 3 hrs and 30 min by a horizontal sand mil (UVM-2; manufactured by Imex Co.) filled with zirconia beads with an average diameter of 0.5 mm. Then 0.2 g of sodium salt of benzoisothiazolinone and water were added thereto such that the concentration of the reducing agent became 25 mass %. The obtained dispersion was heated to 40° C. and maintained at 40° C. for 1 hour. Then, the temperature of the dispersion was raised to 80 ° C. and maintained at 80° C. for 1 hour to form a reducing agent 2 dispersion. The reducing agent particles contained in the thus obtained reducing agent dispersion had a median diameter of 0.50 μm and a maximum particle diameter of 1.6 μm or less. The obtained reducing agent dispersion was filtered through a polypropylene filter of 3.0 μm pore size so that contaminants such as dusts were removed. The reducing agent dispersion was then stored.

4) Preparation of Hydrogen-Bonding Compound 1 Dispersion 10 kg of water was sufficiently mixed with 10 kg of a hydrogen-bonding compound 1 (tri(4-t-butylphenyl)phosphine oxide) and 16 kg of a 10 mass % aqueous solution of a modified polyvinyl alcohol POVAL MP203 available from Kuraray Co., Ltd., to form a slurry. The slurry was transported by a diaphragm pump to a horizontal-type sand mill UVM-2 manufactured by Imex Co., which was packed with zirconia beads having an average diameter of 0.5 mm, and dispersed for 4 hours. Then, 0.2 g of benzoisothiazolinone sodium salt and water were added to the dispersed slurry such that the content of the hydrogen-bonding compound was 25 mass %. Thus-obtained dispersion liquid was maintained at 40° C. for 1 hour, and further maintained at 80° C. for 1 hour to obtain a hydrogen-bonding compound 1 dispersion. The hydrogen-bonding compound 1 dispersion included hydrogen-bonding compound particles having a median size of 0.45 μm and a maximum particle size of 1.3 μm or smaller. The hydrogen-bonding compound 1 dispersion was filtrated by a polypropylene filter having a pore diameter of 3.0 μm to remove extraneous substances such as dust, and then stored.

5) Preparation of Development Accelerator 1 Dispersion 10 kg of water was sufficiently mixed with 10 kg of a development accelerator 1 and 20 kg of a 10 mass % aqueous solution of a modified polyvinyl alcohol POVAL MP203 available from Kuraray Co., Ltd., to form a slurry. The slurry was transported by a diaphragm pump to a horizontal-type sand mill UVM-2 manufactured by Imex Co., which was packed with zirconia beads having an average diameter of 0.5 mm, and dispersed for 3.5 hours. Then, 0.2 g of benzoisothiazolinone sodium salt and water were added to the dispersed slurry such that the content of the development accelerator was 20 mass %, to obtain a development accelerator 1 dispersion. The development accelerator 1 dispersion included development accelerator particles having a median size of 0.48 μm and a maximum particle size of 1.4 μm or less. The development accelerator 1 dispersion was filtrated by a polypropylene filter having a pore diameter of 3.0 μm to remove extraneous substances such as dust, and then stored.

6) Preparation of Development Accelerator 2 Dispersion and Color Tone Controlling Agent 1 Dispersion A 20 mass % solid dispersion of a development accelerator 2 and a 15 mass % solid dispersion of a color tone controlling agent 1 were respectively prepared in a similar manner to the preparation of the development accelerator 1.

7) Preparation of Polyhalogen Compounds

<Preparation of Organic Polyhalogen Compound 1 Dispersion>

10 kg of an organic polyhalogen compound 1 (tribromomethanesulfonylbenzene), 10 kg of a 20 mass % aqueous solution of a modified polyvinyl alcohol POVAL MP203 available from Kuraray Co., Ltd., 0.4 kg of a 20 mass % aqueous solution of sodium triisopropylnaphthalenesulfonate, and 14 kg of water were sufficiently mixed to form a slurry. The slurry was transported by a diaphragm pump to a horizontal-type sand mill UVM-2 manufactured by Imex Co. which was packed with zirconia beads having an average diameter of 0.5 mm, and dispersed for 5 hours. Then, 0.2 g of benzoisothiazolinone sodium salt and water were added to the dispersed slurry such that the content of the organic polyhalogen compound was 26 mass %, to obtain an organic polyhalogen compound 1 dispersion. The organic polyhalogen compound 1 dispersion included organic polyhalogen compound particles having a median size of 0.41 μm and a maximum particle size of 2.0 μm or less. The organic polyhalogen compound 1 dispersion was filtrated by a polypropylene filter having a pore diameter of 10.0 μm to remove extraneous substances such as dust, and then stored.

<Preparation of Organic Polyhalogen Compound 2 Dispersion>

10 kg of an organic polyhalogen compound 2 (N-butyl-3-tribromomethanesulfonylbenzoamide), 20 kg of a 10 mass % aqueous solution of a modified polyvinyl alcohol POVAL MP203 available from Kuraray Co., Ltd., and 0.4 kg of a 20 mass % aqueous solution of sodium triisopropylnaphthalenesulfonate were sufficiently mixed to obtain a slurry. The slurry was transported by a diaphragm pump to a horizontal-type sand mill UVM-2 manufactured by Imex Co. which was packed with zirconia beads having an average diameter of 0.5 mm, and dispersed for 5 hours. Then, 0.2 g of benzoisothiazolinone sodium salt and water were added to the dispersed slurry such that the content of the organic polyhalogen compound was 30 mass %, and the liquid was maintained at 40° C. for 5 hours to obtain an organic polyhalogen compound 2 dispersion. The organic polyhalogen compound 2 dispersion included organic polyhalogen compound particles having a median size of 0.40 μm and a maximum particle size of 1.3 μm or smaller. The organic polyhalogen compound 2 dispersion was filtrated by a polypropylene filter having a pore diameter of 3.0 μm to remove extraneous substances such as dust, and then stored.

8) Preparation of Phthalazine Compound 1 Solution 8 kg of a modified polyvinyl alcohol MP203 available from Kuraray Co., Ltd. was dissolved in 174.57 kg of water. To the solution were added 3.15 kg of a 20 mass % aqueous solution of sodium triisopropylnaphthalenesulfonate and 14.28 kg of a 70 mass % aqueous solution of the phthalazine compound 1 (6-isopropylphthalazine), to prepare a 5 mass % phthalazine compound 1 solution.

9) Preparation of Mercapto Compounds

<Preparation of Aqueous Mercapto Compound 1 Solution>

7 g of a mercapto compound 1 (1-(3-sulfophenyl)-5-mercaptotetrazole sodium salt) was dissolved in 993 g of water to obtain a 0.7 mass % aqueous solution of the mercapto compound 1.

<Preparation of Aqueous Mercapto Compound 2 Solution>

20 g of a mercapto compound 2 (1-(3-methylureidophenyl)-5-mercaptotetrazole) was dissolved in 980 g of water to obtain a 2.0 mass % aqueous solution of the mercapto compound 2.

10) Preparation of Pigment 1 Dispersion 250 g of water was sufficiently mixed with 64 g of C. I. Pigment Blue 60 and 6.4 g of DEMOL N available from Kao Corporation, to obtain a slurry. The slurry was placed in a vessel together with 800 g of zirconia beads having an average diameter of 0.5 mm, and dispersed for 25 hours by a dispersion apparatus 1/4G sand grinder mill manufactured by Imex Co. The pigment content of the dispersed slurry was adjusted to 5 mass % by addition of water, to prepare a pigment 1 dispersion. The pigment 1 dispersion comprised pigment particles having an average particle diameter of 0.21 μm.

11) Preparation of SBR Latex Liquid 287 g of distilled water, 7.73 g of a surfactant PIONINE A-43-S available from Takemoto Oil & Fat Co., Ltd. (solid content 48.5 mass %), 14.06 ml of a 1 mol/l NaOH solution, 0.15 g of tetrasodium ethylenediaminetetraacetate, 255 g of styrene, 11.25 g of acrylic acid, and 3.0 g of tert-dodecylmercaptan were placed in a polymerization kettle of a gas monomer reactor TAS-2J manufactured by Taiatsu Techno Corporation. The polymerization kettle was closed and the contents were stirred at a stirring rate of 200 rpm. The resultant mixture was degassed by a vacuum pump, the inner atmosphere of the kettle was replaced with nitrogen gas several times, 108.75 g of 1,3-butadiene was added to the mixture, and the inner temperature was raised to 60° C. Then, a solution prepared by dissolving 1.875 g of ammonium persulfate in 50 ml of water was added to the mixture and stirred for 5 hours.

The mixture was heated to 90° C. and further stirred for 3 hours, and the inner temperature was reduced to the room temperature after the reaction. To the resultant mixture were added 1 mol/l solution of NaOH and 1 mol/l solution of $NH_4OH$ such that the mole ratio of $Na^+$ ion/$NH_4^+$ ion was 1/5.3, whereby the pH value of the mixture was adjusted to 8.4. Then, the mixture was filtrated by a polypropylene filter having a pore diameter of 1.0 μm to remove extraneous substances such as dust, whereby 774.7 g of an SBR latex TP-1 was obtained. As a result of measuring the halogen ion content of the SBR latex by an ion chromatography, the chloride ion content was found to be 3 ppm. As a result of measuring the chelating agent content of the SBR latex by a high performance liquid chromatography, the chelating agent content was found to be 145 ppm.

The latex had a gelling ratio of 73 mass %, an average particle diameter of 90 nm, Tg of 17° C., a solid content of 44 mass %, an equilibrium moisture content of 0.6 mass % under the conditions of 25° C. and 60% RH, and an ionic conductivity of 4.80 mS/cm (measured at 25° C. by a conductivity meter CM-30S available from DKK-TOA Co).

2. Preparation of Coating Liquids

1) Preparation of Image-Forming Layer Coating Liquid 1,000 g of the fatty acid silver salt dispersion, 135 ml of water, 36 g of the pigment 1 dispersion, 25 g of the organic polyhalogen compound 1 dispersion, 39 g of the organic polyhalogen compound 2 dispersion, 171 g of the phthalazine compound 1 solution, 1,060 g of the SBR latex liquid, 77 g of the reducing agent 1 dispersion, 77 g of the reducing agent 2 dispersion, 22 g of the hydrogen-bonding compound 1 dispersion, 4.8 g of the development accelerator 1 dispersion, 5.2 g of the development accelerator 2 dispersion, 2.1 g of the color tone controlling agent 1 dispersion, and 8 ml of the aqueous mercapto compound 2 solution were successively mixed, and 140 g of the silver halide mixed emulsion A was added to the mixture and mixed well immediately before the application. Thus obtained image-forming layer coating liquid was directly transported to a coating die and applied.

The image-forming layer coating liquid had a viscosity of 35 mPa·s, measured by a B-type viscometer available from Tokyo Keiki Co,. Ltd. at 40° C. (No. 1 rotor, 60 rpm).

The viscosity of the image-forming layer coating liquid, obtained by RheoStress RS150 manufactured by Haake at 38° C., was 38, 49, 48, 34, and 25 [mPa·s] at a shear rate of 0.1, 1, 10, 100, and 1000 [1/second], respectively.

The zirconium content of the image-forming layer coating liquid was 0.30 mg per 1 g of silver.

2) Preparation of Intermediate Layer A Coating Liquid

<Preparation of Intermediate Layer A Coating Liquid 1>

To a mixture of 1,000 g of polyvinyl alcohol PVA-205 available from Kuraray Co., Ltd., 163 g of the pigment 1 dispersion, 33 g of a 18.5 mass % aqueous solution of a blue dye 1 (KAYAFECT TURQUOISE RN LIQUID 150 available from Nippon Kayaku Co., Ltd.), 27 ml of a 5 mass % aqueous solution of sodium di(2-ethylhexyl)sulfosuccinate, and 4,200 ml of a 19 mass % latex liquid of a methyl methacrylate/styrene/butyl acrylate/hydroxyethyl methacrylate/acrylic acid copolymer (copolymerization weight ratio 57/8/28/5/2), 27 ml of a 5 mass % aqueous solution of AEROSOL OT available from American Cyanamid Co., 135 ml of a 20 mass % aqueous solution of diammonium phthalate, and water were added such that the total amount was 10,000 g. The pH value of the resultant mixture was adjusted to 7.5 with NaOH to obtain an intermediate layer coating liquid. The intermediate layer coating liquid was transported to a coating die such that the amount of the liquid was 8.9 ml/$m^2$.

The intermediate layer A coating liquid 1 had a viscosity of 58 mPa s, measured by a B-type viscometer at 40° C. (No. 1 rotor, 60 rpm).

<Preparation of Intermediate Layer A Coating Liquids 2 to 6>

Intermediate layer A coating liquids 2 to 6 were prepared in the same manner as the intermediate layer coating liquid 1 except for using the binders shown in Table 3 instead of the polyvinyl alcohol PVA-205 and the methyl methacrylate/styrene/butyl acrylate/hydroxyethyl methacrylate/acrylic acid copolymer.

Among the coating liquids for intermediate layer A, latex liquids P-3, P-6 and P-9 are comparative latex A samples. In the preparation of P-1, 7.21 g of a surfactant (PIONIN A-43-S, manufactured by Takemoto Oil & Fat Co., Ltd.) was added at the time of start of the synthesis, while in the preparation of P-3, P-6 and P-9, 5.2 g of this surfactant was further added after completion of the synthesis. The water absorption is shown in Table 1.

3) Preparation of Intermediate Layer B Coating Liquid

<Preparation of Intermediate Layer B Coating Liquid 1>

100 g of inert gelatin and 10 mg of benzoisothiazolinone were dissolved in 840 ml of water, and to this were added 180 g of a 19 mass % latex liquid of a methyl methacrylate/styrene/butyl acrylate/hydroxyethyl methacrylate/acrylic acid copolymer (copolymerization weight ratio 57/8/28/5/2), 46 ml of a 15 mass % methanol solution of phthalic acid, and 5.4 ml of a 5 mass % aqueous solution of sodium di(2-ethylhexyl)sulfosuccinate. Immediately before the application, the mixture was mixed with 40 ml of a 4 mass % chromium alum by a static mixer to prepare an intermediate layer B coating liquid 1. The intermediate layer B coating liquid 1 was transported to a coating die such that the coating amount of the liquid was 26.1 ml/m$^2$.

The intermediate layer B coating liquid 1 had a viscosity of 20 mPa·s, measured by a B-type viscometer at 40° C. (No. 1 rotor, 60 rpm).

<Preparation of Intermediate Layer B Coating Liquid 2>

An intermediate layer B coating liquid 2 was prepared in the same manner as the preparation of the intermediate layer B coating liquid 1 except for using polyvinyl alcohol PVA-205 instead of inert gelatin.

4) Preparation of Outermost Layer Coating Liquid 100 g of inert gelatin and 10 mg of benzoisothiazolinone were dissolved in 800 ml of water, and to this were added 40 g of a 10 mass % emulsion of a liquid paraffin, 40 g of a 10 mass % emulsion of dipentaerythrityl hexaisostearate, 180 g of a 19 mass % latex liquid of a methyl methacrylate/styrene/butyl acrylate/hydroxyethyl methacrylate/acrylic acid copolymer (copolymerization weight ratio 57/8/28/5/2), 40 ml of a 15 mass % methanol solution of phthalic acid, 5.5 ml of a 1 mass % solution of the fluorochemical surfactant (FF-1), 5.5 ml of a 1 mass % aqueous solution of the fluorochemical surfactant (FF-2), 28 ml of a 5 mass % aqueous solution of sodium di(2-ethylhexyl)sulfosuccinate, 4 g of fine polymethyl methacrylate particles (average particle diameter 0.7 μm, the average particle diameter corresponding to 30% point on the cumulative volume-weighted diameter distribution), and 21 g of fine polymethyl methacrylate particles (average particle diameter 3.6 μm, the average particle diameter corresponding to 60% point on the cumulative volume-weighted diamenter distribution) to prepare a surface protective layer coating liquid. The coating liquid was transported to a coating die such that the coating amount of the liquid was 8.3 ml/m$^2$.

The coating liquid had a viscosity of 19 mPa·s, measured by a B-type viscometer at 40° C. (No. 1 rotor, 60 rpm).

3. Production of Photothermographic Materials

1) Production of Photothermographic Materials 1 to 14

The image-forming layer coating liquid, the intermediate layer A coating liquid, the intermediate layer B coating liquid, and the outermost layer coating liquid were applied in this order onto the surface of the support opposite to the back surface by simultaneous multilayer coating using a slide-bead application method, to produce a photothermographic material. In the coating, the image-forming layer coating liquid and the intermediate layer A coating liquid were controlled at 31° C., the intermediate layer B coating liquid was controlled at 36° C., and the outermost layer coating liquid was controlled at 37° C.

Combinations of the coating liquids used for making the respective photothermographic materials are shown in Table 3.

The coating amounts (g/m$^2$) of the components of the image-forming layer were as follows.

| | |
|---|---|
| Organic silver salt | 5.02 |
| Pigment (C.I. Pigment Blue 60) | 0.0324 |
| Polyhalogen compound 1 | 0.108 |
| Polyhalogen compound 2 | 0.225 |
| Phthalazine compound 1 | 0.161 |
| SBR latex | 8.73 |
| Reducing agent 1 | 0.36 |
| Reducing agent 2 | 0.36 |
| Hydrogen-bonding compound 1 | 0.522 |
| Development accelerator 1 | 0.019 |
| Development accelerator 2 | 0.016 |
| Color tone controlling agent 1 | 0.006 |
| Mercapto compound 1 | 0.0018 |
| Mercapto compound 2 | 0.0108 |
| Silver halide (Ag content) | 0.09 |

The conditions for the coating and drying were as follows.

The coating was carried out at the rate of 160 m/min. The distance between the support and the tip of the coating die was 0.10 to 0.30 mm. The inner pressure of the decompression chamber was 196 to 882 Pa lower than the atmospheric pressure. The support was subjected to electrical neutralization by an ionic wind before the application.

The coating liquid was cooled by a wind having a dry-bulb temperature of 10 to 20° C. in the subsequent chilling zone. Then the coating liquid was transported in a non-contact manner and dried by a helical type non-contact-type drying apparatus using a drying wind having the dry-bulb temperature of 23 to 45° C. and the wet-bulb temperature of 15 to 21° C.

After the drying, the moisture content was controlled by leaving the photothermographic material in a condition of 25° C., 40 to 60% RH. Then, the dried layer was heated to 70 to 90° C. and then cooled to 25° C.

The thus prepared photothermographic material had a matte degree of 550 seconds on the surface on the image-forming layer side and 130 seconds on the back surface, in terms of Bekk smoothness. Also, the pH of the film surface on the image-forming layer side was measured and found to be 6.0.

The chemical structures of the compounds used in the Examples of the invention are shown below.

Spectral Sensitizing Dye A

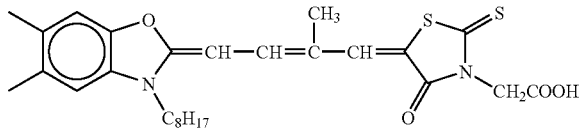

Spectral Sensitizing Dye B

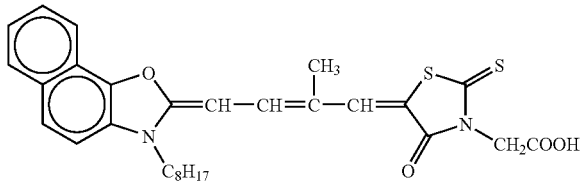

Tellurium Sensitizer C

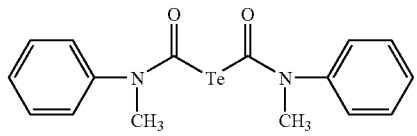

-continued

Base Precursor Compound 1

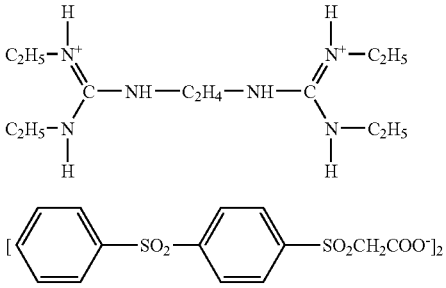

Cyanine Dye Compound 1

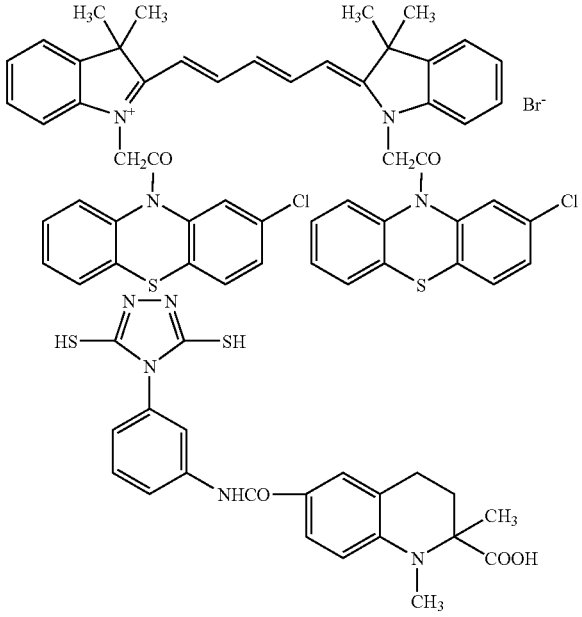

Compound 1 whose one-electron oxidized form can release one or more electron(s)

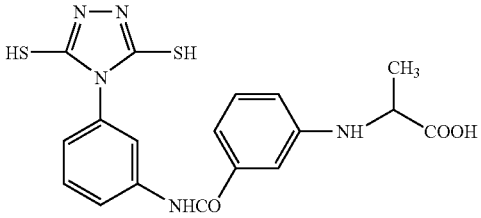

Compound 2 whose one-electron oxidized form can release one or more electron(s)

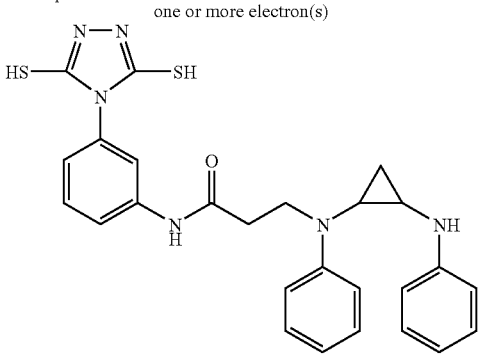

Compound 3 whose one-electron oxidized form can release one or more electron(s)

-continued

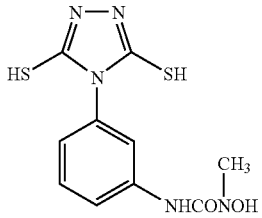

Compound 1 having an adsorbent group and a reducing group

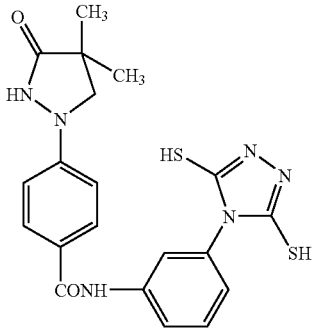

Compound 2 having an adsorbent group and a reducing group

Blue Dye Compound 1

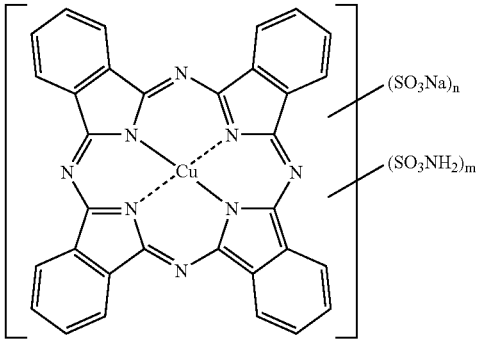

n = 0.5~2.0
m = 0.5~2.5

Reducing Agent 1

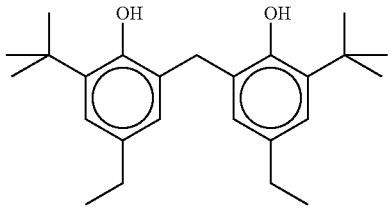

Reducing Agent 2

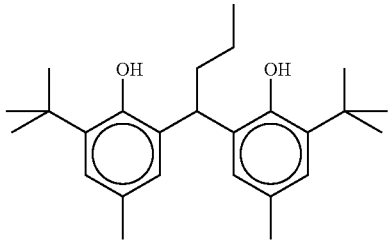

-continued

Hydrogen-bonding Compound 1

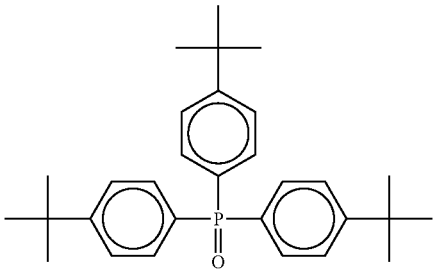

Polyhalogen Compound 1

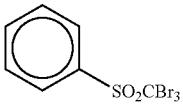

Polyhalogen Compound 2

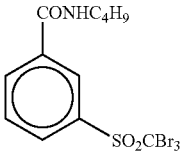

Mercapto Compound 1

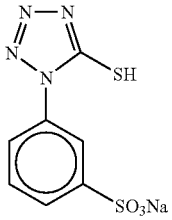

Mercapto Compound 2

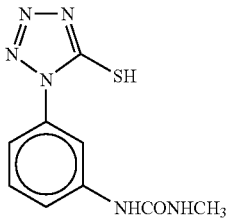

Phthalazine Compound 1

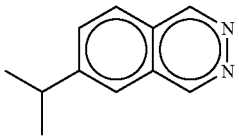

-continued

Development Accelerator 1

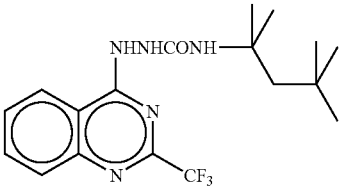

Development Accelerator 2

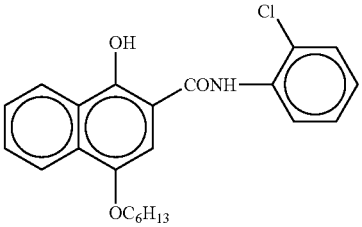

Color Tone Controlling Agent 1

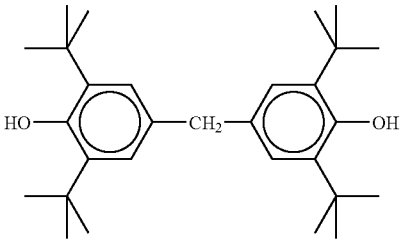

(F-1)

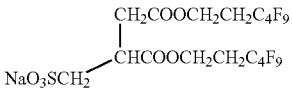

(F-2)

Mixture of

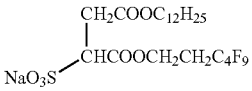

And

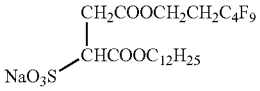

TABLE 3

| | Intermediate layer A | | | | Intermediate layer B | | Outermost layer | | |
|---|---|---|---|---|---|---|---|---|---|
| Sample No. | Coating liquid No. | Binder (mass ratio) | Water absorption (%) | Moisture absorption (%) | Coating liquid No. | Binder (mass ratio) | Coating liquid No. | Binder (mass ratio) | Remark |
| 1 | 1 | PVA/latex (10/8) | Measurement impossible because of dissolution of binder | 100 | — | — | 1 | Gelatin/latex (100/34.2) | Comp. Ex. |
| 2 | 2 | Latex (P-1) | 3.2 | 1.6 | — | — | 1 | Gelatin/latex (100/34.2) | Invention |

TABLE 3-continued

| | Intermediate layer A | | | | Intermediate layer B | | Outermost layer | | |
|---|---|---|---|---|---|---|---|---|---|
| Sample No. | Coating liquid No. | Binder (mass ratio) | Water absorption (%) | Moisture absorption (%) | Coating liquid No. | Binder (mass ratio) | Coating liquid No. | Binder (mass ratio) | Remark |
| 3 | 3 | Latex (P-2) | 4.8 | 2.5 | — | — | 1 | Gelatin/latex (100/34.2) | Invention |
| 4 | 4 | Latex (P-3) | 6.2 | 3.2 | — | — | 1 | Gelatin/latex (100/34.2) | Comp. Ex. |
| 5 | 5 | Latex (P-4) | 3.2 | 1.6 | — | — | 1 | Gelatin/latex (100/34.2) | Invention |
| 6 | 6 | Latex (P-5) | 4.8 | 2.5 | — | — | 1 | Gelatin/latex (100/34.2) | Invention |
| 7 | 3 | Latex (P-6) | 6.2 | 3.2 | — | — | 1 | Gelatin/latex (100/34.2) | Comp. Ex. |
| 8 | 4 | Latex (P-7) | 2.9 | 1.4 | — | — | 1 | Gelatin/latex (100/34.2) | Invention |
| 9 | 5 | Latex (P-8) | 4.5 | 1.9 | — | — | 1 | Gelatin/latex (100/34.2) | Invention |
| 10 | 6 | Latex (P-9) | 5.8 | 3 | — | — | 1 | Gelatin/latex (100/34.2) | Comp. Ex. |
| 11 | 2 | Latex (P-1) | 3.2 | 1.6 | 2 | PVA/latex (10/8) | 1 1 | Gelatin/latex (100/34.2) | Invention |
| 12 | 4 | Latex (P-3) | 6.2 | 3.2 | 2 | PVA/latex (10/8) | 1 1 | Gelatin/latex (100/34.2) | Comp. Ex. |
| 13 | 2 | Latex (P-1) | 3.2 | 1.6 | 1 | Gelatin/latex (100/34.2) | 1 1 | Gelatin/latex (100/34.2) | Invention |
| 14 | 4 | Latex (P-3) | 6.2 | 3.2 | 1 | Gelatin/latex (100/34.2) | 1 1 | Gelatin/latex (100/34.2) | Comp. Ex. |

4. Evaluation of Photographic Performance:

1) Preparation:

Each of the obtained samples was cut into the half size (43 cm in length×35 cm in width), and then packed in the following packaging material in an environment of 25° C., 50% RH. Thereafter, each sample was stored at normal temperature for 2 weeks, and then the following evaluations were conducted.

<Packaging Material>

Laminate film comprising (PET 10 μm)-(PE 12 μm)-(aluminum foil 9 μm)-(Ny 15 μm)-(polyethylene 50 μm containing 3 mass % of carbon):

oxygen permeability: 0.02 ml/atm·$m^2$·25° C. day moisture permeability: 0.10 g/atm·$m^2$·25° C. day 2) Exposure and Development of Photographic Material:

Each photothermographic material was exposed and heat-developed by Fuji Medical Dry Laser Imager DRYPIX 7000 equipped with a 660 nm semiconductor laser having the maximum output of 50 mW (IIIB). The material was heat-developed for 14 seconds in total using three panel heaters controlled at 107° C., 121° C., and 121° C. respectively. Thus-obtained image was evaluated by a densitometer.

3) Evaluation of Photographic Performance:

(Fog)

The density of the unexposed area is defined as fog.

(Dmax)

Maximum density (saturation density) measured by increasing the exposure.

(Sensitivity)

Sensitivity is based on the reciprocal of such exposure as to give the image density which is the fog density +1.0. The sensitivity of each sample is indicated by a relative value assuming the sensitivity of the sample No. 1 is 100.

4) Evaluation of Image Storability:

The exposed and developed sample having a density of 2.0 was stored at 50° C. for 3 days. After the storage, the changes in density and in color tone were measured. The change in color tone was evaluated according to the following criteria by using a film viewer of 18,000 Lux.

A: No change in color tone is observed.

B: A practically-acceptable change in color tone is observed.

C: A practically-unacceptable change in color tone is observed.

5) Evaluation Results:

The obtained results are shown in Table 4. As shown in Table 4, the samples of the invention have superior image storability while retaining photographic properties equivalent to the photographic properties of Comparative Examples.

TABLE 4

| | Photographic properties | | | Image storability | | |
|---|---|---|---|---|---|---|
| Sample No. | Fog | Dmax | Sensitivity | ΔDensity | Change in color tone | Remark |
| 1 | 0.18 | 4.1 | 100 | 0.25 | C | Comp. Ex. |
| 2 | 0.18 | 4.1 | 100 | 0.09 | A | Invention |

TABLE 4-continued

| | Photographic properties | | | Image storability | | |
|---|---|---|---|---|---|---|
| Sample No. | Fog | Dmax | Sensitivity | ΔDensity | Change in color tone | Remark |
| 3 | 0.18 | 4.1 | 100 | 0.12 | B | Invention |
| 4 | 0.18 | 4.1 | 100 | 0.24 | C | Comp. Ex. |
| 5 | 0.18 | 4.1 | 100 | 0.09 | A | Invention |
| 6 | 0.18 | 4.1 | 100 | 0.12 | B | Invention |
| 7 | 0.18 | 4.1 | 100 | 0.24 | C | Comp. Ex. |
| 8 | 0.18 | 4.1 | 100 | 0.07 | A | Invention |
| 9 | 0.18 | 4.1 | 100 | 0.11 | A | Invention |
| 10 | 0.18 | 4.1 | 100 | 0.22 | C | Comp. Ex. |
| 11 | 0.18 | 4 | 98 | 0.06 | A | Invention |
| 12 | 0.18 | 4 | 98 | 0.21 | C | Comp. Ex. |
| 13 | 0.18 | 4 | 98 | 0.07 | A | Invention |
| 14 | 0.18 | 4 | 98 | 0.22 | C | Comp. Ex. |

According to the invention, a photothermographic material is provided which has high sensitivity, and which can give an image with high image density and excellent image storage stability.

What is claimed is:

1. A photothermographic material comprising a support and an image-forming layer, a non-photosensitive intermediate layer A, and an outermost layer provided in this order on at least one side of the support, wherein the image-forming layer comprises a photosensitive silver halide, a non-photosensitive organic silver salt, a reducing agent, and a binder, and at least 50 mass % of a binder in the non-photosensitive intermediate layer A is a polymer latex having a film water absorption of 5% or lower.

2. The photothermographic material according to claim 1, wherein the non-photosensitive intermediate layer A is disposed adjacent to the image-forming layer.

3. The photothermographic material according to claim 1, wherein a non-photosensitive intermediate layer B is provided between the non-photosensitive intermediate layer A and the outermost layer, and a binder of at least one of the outermost layer and the non-photosensitive intermediate layer B includes at least 50 mass % of a hydrophilic polymer derived from animal protein.

4. The photothermographic material according to claim 3, wherein at least 50 mass % of the binder of the non-photosensitive intermediate layer B is a hydrophilic polymer derived from animal protein and at least 50 mass % of the binder of the outermost layer is a hydrophobic polymer.

5. The photothermographic material according to claim 3, wherein the non-photosensitive intermediate layer B comprises a first non-photosensitive intermediate layer and a second non-photosensitive intermediate layer, the first non-photosensitive intermediate layer B includes at least 50 mass % of a hydrophilic polymer which is not derived from animal protein, the second non-photosensitive intermediate layer includes at least 50 mass % of a hydrophilic polymer derived from animal protein, and the first non-photosensitive intermediate layer is nearer to the intermediate layer A than the second non-photosensitive intermediate layer is.

6. The photothermographic material according to claim 1, wherein at least 50 mass % of the binder of the non-photosensitive intermediate layer A is a polymer including 10 mass % to 70 mass % of a monomer component represented by the following formula (M):

$$CH_2{=}CR^{01}{-}CR^{02}{=}CH_2 \qquad \text{Formula (M)}$$

wherein in the formula (M), $R^{01}$ and $R^{02}$ each independently represent a hydrogen atom, an alkyl group having 1 to 6 carbon atoms, a halogen atom, or a cyano group.

7. The photothermographic material according to claim 6, wherein $R^{01}$ and $R^{02}$ both represent hydrogen atoms, or one of $R^{01}$ and $R^{02}$ represents a hydrogen atom and the other represents a methyl group.

8. The photothermographic material according to claim 1, wherein a binder of the outermost layer comprises a hydrophobic polymer or a hydrophilic polymer derived from animal protein.

9. The photothermographic material according to claim 8, wherein the binder of the outermost layer comprises a hydrophilic polymer derived from animal protein.

10. The photothermographic material according to claim 3, wherein the hydrophilic polymer derived from animal protein is gelatin.

11. A photothermographic material comprising a support and an image-forming layer, a non-photosensitive intermediate layer A, and an outermost layer provided in this order on at least one side of the support, wherein the image-forming layer comprises a photosensitive silver halide, a non-photosensitive organic silver salt, a reducing agent, and a binder, and at least 50 mass % of a binder in the non-photosensitive intermediate layer A is a polymer latex having a film moisture absorption of 3% or lower.

12. The photothermographic material according to claim 11, wherein the non-photosensitive intermediate layer A is disposed adjacent to the image-forming layer.

13. The photothermographic material according to claim 11, wherein a non-photosensitive intermediate layer B is provided between the non-photosensitive intermediate layer A and the outermost layer, and a binder of at least one of the outermost layer and the non-photosensitive intermediate layer B includes at least 50 mass % of a hydrophilic polymer derived from animal protein.

14. The photothermographic material according to claim 13, wherein at least 50 mass % of the binder of the non-photosensitive intermediate layer B is a hydrophilic polymer derived from animal protein and at least 50 mass % of the binder of the outermost layer is a hydrophobic polymer.

15. The photothermographic material according to claim 13, wherein the non-photosensitive intermediate layer B comprises a first non-photosensitive intermediate layer and a second non-photosensitive intermediate layer, the first non-photosensitive intermediate layer B includes at least 50 mass % of a hydrophilic polymer which is not derived from animal protein, the second non-photosensitive intermediate layer includes at least 50 mass % of a hydrophilic polymer derived from animal protein, and the first non-photosensitive intermediate layer is nearer to the intermediate layer A than the second non-photosensitive intermediate layer is.

16. The photothermographic material according to claim 11, wherein at least 50 mass % of the binder of the non-photosensitive intermediate layer A is a polymer including 10 mass % to 70 mass % of a monomer component represented by the following formula (M):

$$CH_2{=}CR^{01}{-}CR^{02}{=}CH_2 \qquad \text{Formula (M)}$$

wherein in the formula (M), $R^{01}$ and $R^{02}$ each independently represent a hydrogen atom, an alkyl group having 1 to 6 carbon atoms, a halogen atom, or a cyano group.

17. The photothermographic material according to claim 16, wherein $R^{01}$ and $R^{02}$ both represent hydrogen atoms, or one of $R^{01}$ and $R^{02}$ represents a hydrogen atom and the other represents a methyl group.

18. The photothermographic material according to claim 11, wherein a binder of the outermost layer comprises a hydrophobic polymer or a hydrophilic polymer derived from animal protein.

19. The photothermographic material according to claim 18, wherein the binder of the outermost layer comprises a hydrophilic polymer derived from animal protein.

20. A photothermographic material comprising a support and an image-forming layer, a non-photosensitive intermediate layer A, and an outermost layer provided in this order on at least one side of the support, wherein the image-forming layer comprises a photosensitive silver halide, a non-photosensitive organic silver salt, a reducing agent, and a binder, and at least 50 mass % of a binder in the non-photosensitive intermediate layer A is a polymer latex having a film water absorption of 5% or lower and a film moisture absorption of 3% or lower.

* * * * *